US005501046A

United States Patent [19]

Hattingh et al.

[11] Patent Number: 5,501,046

[45] Date of Patent: Mar. 26, 1996

[54] BUILDING

[75] Inventors: Lukas M. Hattingh, Transvaal; Marthinus G. Kruger, Pretoria, both of South Africa

[73] Assignee: ECO Innovations Ltd., Road Town, Virgin Islands (Br.)

[21] Appl. No.: 87,068

[22] Filed: Jul. 7, 1993

[30] Foreign Application Priority Data

Jul. 8, 1992 [ZA] South Africa ..... 92/0101

[51] Int. Cl.[6] ..... E04B 1/343

[52] U.S. Cl. ..... 52/266; 52/79.1; 52/284; 52/293.3; 52/270; 52/271

[58] Field of Search ..... 52/79.1, 274, 272, 52/284, 293.3, 270, 266, 271, 261

[56] References Cited

U.S. PATENT DOCUMENTS

| | | | |
|---|---|---|---|
| 945,596 | 1/1910 | Prendergast | 52/270 |
| 2,278,956 | 4/1942 | Wagner | 52/79.4 X |
| 2,733,784 | 2/1956 | Berry | 52/293.3 X |
| 3,176,432 | 4/1965 | Doolittle, Jr. | 52/293.3 |
| 4,207,714 | 6/1980 | Mehls | 52/79.1 X |
| 4,285,174 | 8/1981 | Knight . | |
| 4,365,453 | 12/1982 | Lowe . | |
| 4,523,418 | 6/1985 | McLaughlin | 52/284 |
| 4,914,874 | 4/1990 | Graham, Jr. | 52/79.1 |
| 5,261,197 | 11/1993 | Pickle, Sr. | 52/79.1 X |
| 5,293,725 | 3/1994 | Matticks et al. | 52/266 X |
| 5,331,778 | 7/1994 | Mazpule et al. | 52/266 X |
| 5,361,556 | 11/1994 | Menchetti | 52/271 X |

FOREIGN PATENT DOCUMENTS

| | | | |
|---|---|---|---|
| 2596788 | 10/1987 | France | 52/79.1 |
| 2142057 | 1/1985 | United Kingdom | 52/79.1 |

OTHER PUBLICATIONS

South Africa, No. 920,006, Jan. 8, 1992.

Abstract, Great Britain Patent No. 1 330 508, Oct. 19, 1970.

Abstract, German Patent No. DT 2950–719, Jul. 3, 1980, F. Schlatter.

*Primary Examiner*—Wynn E. Wood

*Attorney, Agent, or Firm*—Oblon, Spivak, McClelland, Maier & Neustadt

[57] ABSTRACT

In a preferred embodiment a frameless building includes a first set of four walls each in the form of a profiled trapezoidal shaped wall panel. Each panel includes a left and right side set of sub-panels each set comprising a bottom, middle and a top sub-panel. The left side edge or one panel is attached to the right side edge of another panel. All the panels are attached in this manner to lean towards one another and towards the inside of the building. A profile between the top and bottom edges of each panel defines a plurality of Ls. One L proceeds into another L, a first leg of an L facing upwards and a second leg of the L outwards when travelling between the top and bottom edges. This profile allows for thermal insulating screed to be applied to the outer surfaces of each panel; structural rigidity; stackability of similar sub-panels and for solar heating. Alternative to the screed a second set can be arranged over the first set of wall panels and insulating filler material provided between the two sets. The invention extends to the sub-panels for use in the building and to a method of constructing the building.

24 Claims, 31 Drawing Sheets

66A

BUILDING

BACKGROUND OF THE INVENTION

1. Field of the Invention

This invention relates to a building. More particularly, the invention relates to a building suitable for use in mass-housing. The invention extends to panels for use as the structural elements of the building and further to a method of constructing the building.

2. Description of the Prior Art

Conventional buildings used for low-cost mass-housing are still relatively expensive mainly due to the type of structure employed which necessitates long construction periods and usually the employment of skilled labour. The basic structure of some types of houses employs bricks and mortar which houses are inevitably relatively expensive to build due to the high labour input needed. Other houses mainly employ pre-fabricated structural elements which can pose transport problems due to the mass and volume of these elements and the lack of stackability. Further, the conventional houses pose thermal shortcomings and lend themselves only in a limited way for aesthetic and ecological inter-action with the environment and the inhabitants. In the aforementioned context one can typically refer to houses erected in squatter camps. It will be appreciated that urbanisation and adverse economic conditions presently lead to a growing squatter problem which consequently, of course, has an extremely negative effect on the environment and the inhabitants themselves. A further shortcoming of most conventional houses used for mass-housing is the lack of extending and upgrading especially the lack of providing thermal insulation on the outsides thereof.

Internationally, more than half of the world population is without adequate shelter. Various governments annually spend billions of dollars to alleviate the housing problem, but with limited success, mainly due to the problems, mentioned above, of transport, construction and further of supervision. The long construction periods create further backlogs which result in further social and economic delay.

The applicant is aware of the following patents showing various forms of buildings:

German Patent No. DT 2950-719, Dec. 18, 1978 to Schlather F. discloses a building composed of corrugated sections supported by an extra timber structure which is essential to this building. Disadvantages of this building thus include the vast number of components necessary to construct it which makes this building less suitable for mass-housing as longer construction periods are needed. Further, cavities in the structure are needed for filling with polystyrene granules as insulation material. Also a special type of foundation is needed, that is, comprising an aerated concrete with polystyrene granules thus further adding to the cost of this building.

French Patent No. 2 529 928, Jul. 9, 1982 to Chazal P. discloses a compact, trapezoidal structure consisting of seven panels which generally form a tunnel which is non-optimal for solar heating as only the two sloping walls of the four walls can be used for solar heating. The respective panels are articulately attached to each other for packing and transport purposes. A disadvantage of this building includes the complexity of the plurality of attachments which will render this building relatively expensive.

Great Britian Patent No. 1 330 508 to Universal Papertech Corp, Oct. 19, 1970 discloses a pre-fabricated building with also only two sloping walls which building has a general tunnel shape as mentioned above, and only the two sloping walls of the four walls can be used for solar heating. This building too is constructed of a vast number of components and insulation is attempted by filling the cavity walls with an insulating material. Insulation here is attempted from the inside of the building.

U.S. Pat. No. 4,285,174 to Knight B. V. Aug. 25, 1981 discloses a free-standing building with trapezoidal-shaped panelling. This building is especially designed for bulk storage of materials and not for human occupation. Apart from the aforementioned limitation the profile of the walls does not enhance the use of insulation material and is non-optimal for solar heating.

U.S. Pat. No. 4,365,453 to Lowe F. L., Dec. 28, 1982 discloses a frameless metal building with corrugated rectangular panelling. A crane is, however, needed for ease of construction thus increasing cost of construction. The shape of the panels is further non-optimal for solar heating. Insulation may possibly be accomplished for which cavities in the structure are needed. A further disadvantage of this building is the excessive thermal bridging between the inner and outer wall panels.

A general shortcoming of the abovementioned prior art buildings is the lack of providing a basic unit which can be upgraded in a simple way, for example, by providing thermal insulation on the outside surfaces. The prior art buildings which can be insulated essentially need cavities to be filled by material, for example, granules. A further shortcoming of the prior art buildings is the lack of expanding the building to provide a multi-building. Another shortcoming is the lack of stackability of the various components employed.

There accordingly exists a need for a relatively inexpensive, environment-friendly building which can be used in mass-housing projects and which building can be thermally upgraded in a simple manner and further expanded. A further need exists for stackable panels readily transportable, the panels for use in the construction of the building.

OBJECTS AND SUMMARY OF THE INVENTION

It is an object of the present invention to provide a relatively inexpensive, environment-friendly building suitable for use in mass-housing projects.

It is a further object of the invention to provide a building in the form of a basic unit which can simply be thermally upgraded by providing thermal insulation on the outside walls and roof of the building or by providing a second set of walls over and on the outside of the walls of the basic unit, the second set of walls spaced from the walls of the basic unit.

Another object of the invention is to provide profiled, structural panels for use in the construction of the building in accordance with the invention, which panels can be readily transported, for example, by means of a light delivery van.

It is yet a further object of the invention to provide a method of constructing the building in accordance with the invention.

Further objects and advantages of the invention will become more apparent from a reading of the following statements of the invention and of the detailed description in conjunction with the appended drawings.

A building in accordance with the present invention includes:

a roof;

a first set of at least four trapezoidal shaped walls each wall in the form of a wall panel each wall panel comprising;

a left side edge;

a right side edge which is opposite the left side edge the left and right side edges extending between the ground and the roof;

a bottom edge at the ground and extending between the left and right side edges; and a top edge at the roof the top edge opposite and generally parallel to the bottom edge and extending between the left side and right side edges, with the left side edge of one wall panel adjacent and attached to the right side edge of one other wall panel, all the wall panels arranged in this manner so that the wall panels lean towards one another and towards the inside of the building; and an opening provided in any one of the wall panels which opening can give access to the inside of the building.

An important feature is thus that the building of this invention can be constructed without the use of a frame to support the wall panels. A flameless building can thus be established.

In order to expand the building it may further include an upright, elongate removable panel provided in any one of the wall panels not being the wall panel having an access opening the removable panel having a bottom edge thereof at the ground. After removal of such a removable panel the building can be linked to another similar building or garage as will be explained in the detailed description of the drawings. A multi-building can thus be established.

It is preferred that each wall panel is suitably profiled to, for example, impart structural rigidity to the wall panels.

In a preferred embodiment of this invention a cross-section extending between the bottom and top edges of each wall panel presents a profile defining a plurality of Ls with each L comprising:

a first upstanding leg having a distal end; and a second leg which is transverse to the first leg and directed to the outside of the building when travelling from the top edge to the bottom edge of the wall panel along its profile and which second leg has a distal end;

the first leg of the L longer than the second leg of the L, the distal end of a first leg of an L attached to the distal end of a second leg of another L, the majority of Ls arranged in this manner.

An important advantage of the L-shaped profile of each wall panel is that it provides structural rigidity. A further important advantage of the L-shaped profile, in particular the orientation of the transverse second legs of the Ls is that a suitable insulating screed can be applied on to the outside of a wall panel. The applied screed can be arrested on and by the second transverse legs of the Ls. Another important advantage of the L-shaped profile is that it renders the wall panels stackable. The L-shaped profile is further advantageous regarding the heating of water in the bores of tubes suitably located on the outside of a wall panel as will be explained in detail later.

Preferably, the left side edge has a left side flange and the right side edge has a right side flange the left side flange of the left side edge of one wall panel attached to an adjacent right side flange of a right side edge of one other wall panel all the wall panels attached in this manner.

In a preferred embodiment of the invention each wall panel includes a plurality of sub-panels. In this embodiment of the invention, each wall panel comprises a left side set and a right side set of trapezoidal shaped sub-panels each set comprising three sub-panels namely a bottom sub-panel, a middle sub-panel and a top sub-panel each of the three sub-panels comprising:

an outer side edge;

an inner side edge which is opposite the outer side edge the outer side and inner side edges extending between the ground and the roof;

bottom edge extending between the outer side and inner side edges; and a top edge opposite and generally parallel to the bottom edge and extending between the outer and inner side edges;

the three sub-panels of each set arranged so that:

the bottom sub-panel is located adjacent the ground with its bottom edge at the ground;

the top sub-panel is located adjacent the roof with its top edge at the roof;

the middle sub-panel is located between the bottom and top sub-panels with the bottom edge of the middle sub-panel adjoined to the top edge of the bottom sub-panel, the top edge of the middle sub-panel adjoined to the bottom edge of the top sub-panel, and for each wall panel:

the outer side edges of the three sub-panels of a left side set aligned with one another to form the left side edge of the wall panel, the outer side edges of the three sub-panels of a right side set aligned with one another to form the right side edge of the wall panel, the bottom edges of the two bottom sub-panels of said left side and right side sets aligned with each other to form the bottom edge of the wall panel, the top edges of the two top sub-panels of said left side and right side sets aligned with each other to form the top edge of the one wall panel.

As a further feature of this invention there may be provided a plurality of support members on the ground with the inner side edges of a bottom and middle sub-panel of a set of sub-panels aligned with each other and attached to a support member.

Each of the support members, preferably, is in the form of a profiled triangle each support member having a sloping side edge and an upright side edge the sloping side edge having a support flange with the aligned inner side edges of the bottom and middle sub-panels each having a flange these flanges of said bottom and middle sub-panels adjoined to the support flange of a support member, the upright side edge of each support member having a longitudinally extending rebate to accommodate an upright edge of a door.

It is preferred that the building includes a base which is provided with a plurality of slits in its top surface and the bottom edge of each wall panel or each bottom sub-panel having a depending flange which fits into a co-acting slit in the base, the wall panels thereby attached to the base.

The building may further comprise a plurality of elongate ceiling support members for supporting a ceiling of the building each of the support members having a rectangular cross-section and comprises strengthening means in the form of a plurality of pressed out areas between the two long sides of the support member each pressed out area having a hole through it.

Preferably, the building includes a suitable insulating screed on the outside surface of each wall panel or each sub-panel thereby thermally upgrading the building.

The building may further include a second set of at least four profiled, trapezoidal shaped walls over the first set of walls, each wall of the second set in the form of a wall panel with a wall panel of the second set spaced from and generally parallel to a wall panel of the first set each wall panel of the second set comprising:

a left side edge;

a right side edge which is opposite the left side edge the left and right side edges extending between the ground and the roof;

a bottom edge at the ground and extending between the left side and right side edges; and a top edge at the roof the top edge opposite and generally parallel to the bottom edge and extending between the left and right side edges, with the left side edge of one wall panel of the second set adjacent and attached to the right side edge of one other wall panel of the second set all the wall panels of the second set arranged in this manner so that the wall panels of the second set lean towards one another and towards the inside of the building; and an opening in any one of the wall panels of the second set which wall panel is located over the wall panel of the first set having the access opening the two openings aligned with each other so that they can give access to the inside of the building.

Preferably, each wall panel of the second set includes a plurality of sub-panels each sub-panel having a profile defining a plurality of Ls with each L comprising:

a first upstanding leg having a distal end; and a second leg which is transverse to the first leg and directed to the outside of the building when travelling from the top edge to the bottom edge of the wall panel along its profile and which second leg has a distal end;

the first leg of the L longer than the second leg of the L, the distal end of a first leg of an L attached to the distal end of a second leg of another L, the majority of Ls arranged in this manner.

A suitable loose insulating filler material, for example, granules can be provided between the first and second sets of wall panels. Thus, the second set of wall panels with the provided insulating filler material can be used as an alternative thermal upgrading to the building having only a first set of wall panels with the screed applied thereto.

As a further feature of this invention, the building may be provided with a gutter which extends between and along the top edges of a first set wall panel and a second set wall panel which second set wall panel is located over the first set wall panel.

The present invention extends to a sub-panel for use in the building in accordance with this invention which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile the distal end of a first leg of an L attached to the distal end of a second leg of another L, the majority of the Ls arranged in this manner.

Preferably, the sub-panel has a trapezoidal shape.

The present invention extends to a sub-panel for use as the bottom sub-panel of a set of sub-panels of the building of this invention, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile, the distal end of a first leg of an L attached to the distal end of a second leg of another L, the majority of the Ls arranged in this manner, the bottom sub-panel having:

an outer flange at its outer side edge;

an inner flange at its inner side edge;

bottom flange at its bottom edge; and a top attachment formation at its top edge, the outer flange attachable to an outer flange of a bottom sub-panel of an adjacent wall panel, the inner flange attachable to a support member, the bottom flange attachable at the ground and the top attachment formation of the top edge attachable to a bottom attachment formation of the bottom edge of the middle sub-panel of the set of sub-panels.

Preferably, the bottom flange is a depending flange which can be fitted into a co-acting slit of a base of the building.

The present invention extends to a sub-panel for use as the middle sub-panel of a set of sub-panels of the building of this invention, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use the directed to the outside of the building when travelling from the top edge to the bottom edge of the wall panel along its profile, the distal end of a first leg of an L attached to the distal end of a second leg of another L, the majority of the Ls arranged in this manner, the middle sub-panel having:

an outer flange at its outer side edge;

an inner flange at its inner side edge;

a bottom attachment formation at its bottom edge; and a top attachment formation at its top edge, the outer flange attachable to an outer flange of a middle sub-panel of an adjacent wall panel, the inner flange attachable to a support member, the bottom attachment formation of the bottom edge attachable to a top attachment formation of the top edge of the bottom sub-panel of the set of sub-panels and the top attachment formation of the top edge attachable to a bottom attachment formation of the bottom edge of the top sub-panel of the set of sub-panels.

The present invention extends to a sub-panel for use as the top sub-panel of a set of sub-panels of the building of this invention, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile, the distal end of a first leg of an L attached to the distal end of a second leg of another L, the majority of the Ls arranged in this manner, the top sub-panel having:

an outer flange at its outer side edge;

an inner flange at its inner side edge;

a top attachment formation at its top edge; and a bottom attachment formation at its bottom edge, the outer flange attachable to an outer flange of a top sub-panel of an adjacent wall panel, the inner flange attachable to an inner flange of a top sub-panel of another set of sub-panels of the same wall panel, the bottom attachment formation of the bottom edge attachable to a top attachment formation of the top edge of the middle sub-panel of the set of sub-panels and the top attachment formation of the top edge attachable to the roof.

It is an advantage of the L-shaped profile that similar sub-panels can be stacked.

The invention extends to a support member for use in the building of this invention which support member is profiled and generally in the form of a triangle the support member having a sloping side edge having a support flange which support flange is attachable to the aligned inner flanges of the inner edges of the bottom and middle sub-panels of a set of sub-panels the support member further having an upright side edge having rebate to accommodate an upright edge of a door when the support member is in use.

The invention extends to a ceiling support member for use in the building of this invention which ceiling support member has a rectangular cross-section and comprises strengthening means in the form of a plurality of pressed out areas between the two long sides of the support member each pressed out area having a hole through it.

The invention extends to a method of constructing the building of this invention which method includes the steps of:

preparing a site on which the building is to be constructed;

providing the site with a base to which the bottom edges of the wall panels are to be attached;

attaching the bottom edges of the wall panels to the base and attaching the left side edge of a wall panel to the right side edge of another wall panel until all the wall panels are attached in this manner so that the wall panels lean towards one another and towards the inside of the building; and providing the roof.

In the case where the building includes left side and right side sets of sub-panels and the base with the slits and each bottom sub-panel having a depending flange the method of constructing the building includes the steps mentioned in the previous paragraph in which method the bottom edges of the bottom sub-panels are attached to the base by sliding each of the depending flanges of the respective bottom sub-panels into its co-acting slit in the base.

In the case where the building includes the base with the slits and the bottom edge of each wall panel has a depending flange the method of constructing the building of this invention includes the steps of:

preparing a site on which the building is to be constructed;

providing the site with the base to which the bottom edges of the wall panels are to be attached;

sliding each of the depending flanges of the respective wall panels into its co-acting slit in the base;

attaching the left side edge of a wall panel to the right side edge of another wall panel until all the wall panels are attached in this manner so that the wall panels lean towards one another and towards the inside of the building; and providing the roof.

In the case where the building includes left side and right side sets of sub-panels and a plurality of support members the method of constructing the building of this invention includes the steps of:

preparing a site on which the building is to be constructed;

providing the site with a base to which the bottom edges of the bottom sub-panels are to be attached;

providing on the base pairs of support members a pair for each of the to be constructed wall panels;

for each wall panel:

attaching the bottom edges of the bottom sub-panels to the base;

attaching the outer edge of the bottom sub-panel of the left side set to the outer edge of a bottom sub-panel of a right side set of an adjacent wall panel;

attaching the inner edge of the bottom sub-panel of the left side set to a first support member;

attaching the outer edge of the bottom sub-panel of the right side set to the outer edge of a bottom sub-panel of a left side set of another adjacent wall panel; and attaching the inner edge of the bottom sub-panel of the right side set to a second support member, so that the bottom sub-panels lean towards one another and towards the inside of the building;

for each wall panel;

attaching the bottom edge of the middle sub-panel of the left side set to the top edge of the bottom sub-panel of the left side set;

attaching the outer edge of the middle sub-panel of the left side set to the outer edge of a middle sub-panel of the right side set of the adjacent wall panel;

attaching the inner edge of the middle sub panel of the left side set to the first support member;

attaching the bottom edge of the middle sub-panel of the right side set to the top edge of the bottom sub-panel of the right side set;

attaching the outer edge of the middle sub-panel of the right side set to the outer edge of the middle sub-panel of the left side set of the other adjacent wall panel; and attaching the inner edge of the middle sub-panel of the right side set to the second support member, so that the middle sub-panels lean towards one another and towards the inside of the building;

for each wall panel;

attaching the bottom edge of the top sub-panel of the left side set to the top edge of the middle sub-panel of the left side set;

attaching the outer edge of the top sub-panel of the left side set to the outer edge of a top sub-panel of the right side set of the adjacent wall panel;

attaching the inner edge of the top sub-panel of the left side set to an adjacent inner edge of the top sub-panel of the right side set of the wall panel;

attacking the bottom edge of the top sub-panel of the right side to the top edge of the middle sub-panel of the right side set;

attaching the outer edge of the top sub-panel of the right side set to the outer edge of a top sub-panel of the left side set of the other adjacent wall panel, so that the top sub-panels lean towards one another and towards the inside of the building; and providing the roof.

The invention extends to a method of constructing the building of this invention which method includes a step of providing a suitable insulating screed on the outside surface of each wall panel or sub-panel after the wall panel or sub-panels had been constructed and leaning towards one another and towards the inside of the building.

BRIEF DESCRIPTION OF THE DRAWINGS

The invention will now be described, by way of example only, with reference to the accompanying drawings, in which.

DETAILED DESCRIPTION OF THE DRAWINGS

Figure 1:
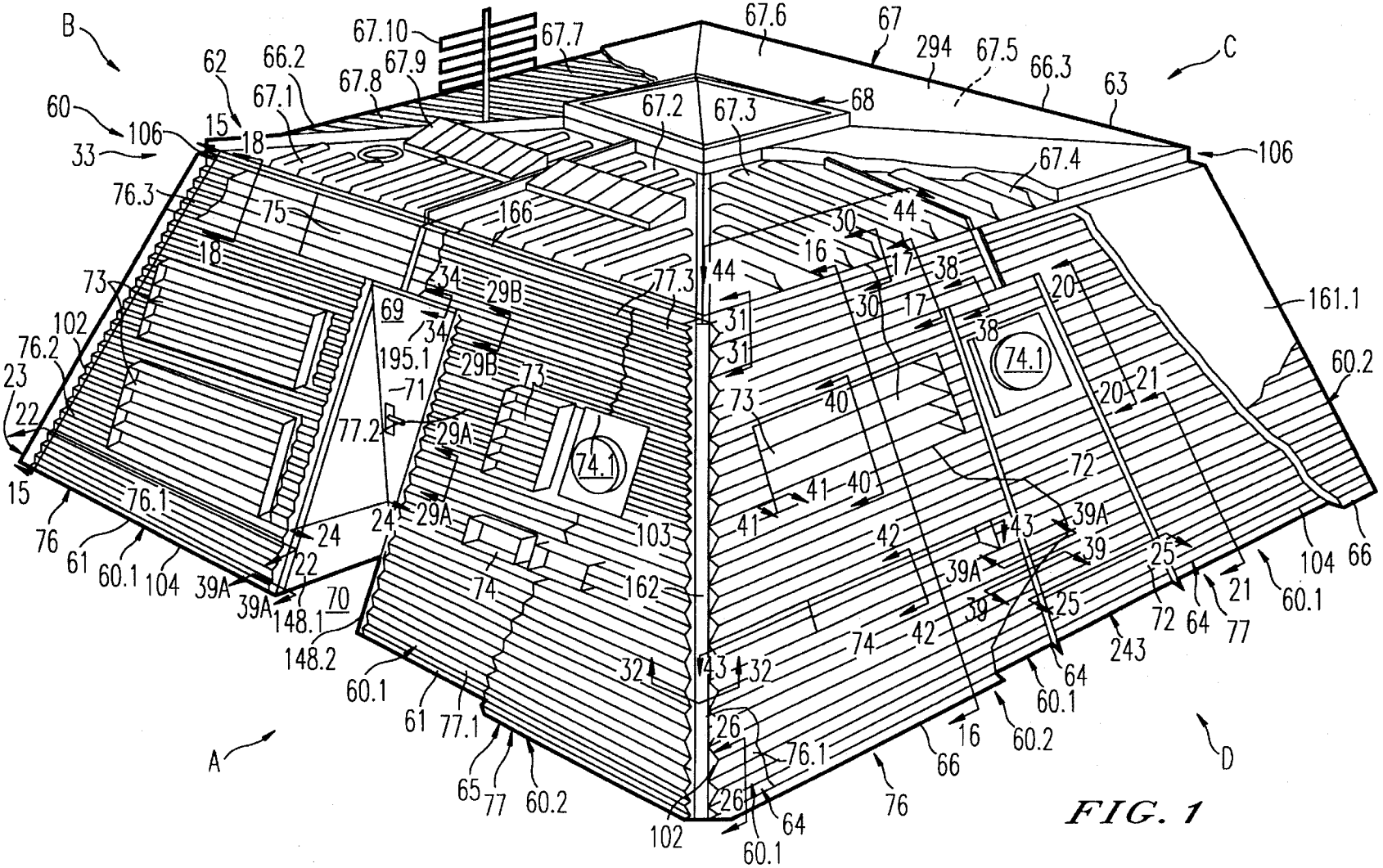
FIG. 1 is a fragmentary isometric view of a preferred embodiment of a building which is in accordance with the present invention.

Referring to FIG. 1 reference numeral 60 generally indicates a building in accordance with the present invention.

The building 60 includes two sets of walls, namely a first set 60.1 which comprises four profiled, trapezoidal shaped wall panels 61 to 64 and a second set 60.2 which also comprises four profiled, trapezoidal shaped wall panels of which only two, namely 65, 66 are fragmentarily shown in FIG. 1. It will be understood that the other two wall panels 66.2, 66.3 of the second set 60.2 of wall panels are located at the side B and C indicated in FIG. 1. The second set 60.2 of wall panels 65, 66; 66.2, 66.3 is located over the first set 60.1 of wall panels 61 to 64 with a wall panel of the second set 60.2 spaced from and generally parallel to a wall panel of the first set 60.1. The wall panels (61 to 66 shown) all generally have the same trapezoidal shape and profiles which profiles will be discussed later in this specification.

The first set 60.1 of wall panels 61 to 64, form the walls of a basic unit 66A shown in FIGS. 2 to 8, 10 and 11. The basic unit 66A can be upgraded by adding the second set 60.2 of wall panels 65, 66, 66.2, 66.3 over the first set 60.1 of wall panels 61 to 64.

The wall panels of opposite walls are arranged to lean towards one another and towards the inside 66.1 of the building 60, 66A. The preferred angle of a wall panel (61 to 66, 66.2, 66.3) to the ground 105 on the inside 66.1 of the building 60, 66A is 67°30'.

A roof 67 comprising eight roof sub-panels 67.1 to 67.8 and a dome 68 are provided on top of the wall panels 61 to 66, 66.2, 66.3.

FIG. 1 further generally shows that two photo-voltaic panels 67.9 and an antenna 67.10 are provided on the roof 67.

The two wall panels 61, 65 are each provided with an opening 69, 70 with the opening 69 closed by a door 71 as shown in FIG. 1. When the door 71 is open the two aligned openings 69, 70 give access to the inside 66.1 of the building 60.

Figure 38:
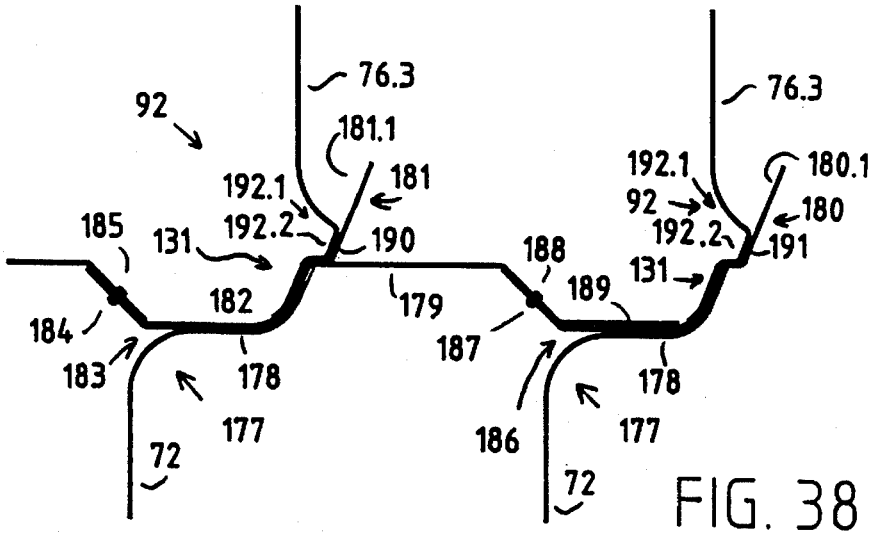
FIG. 38 is an elevation on section 38—38 shown in FIG. 1 through two top panels, two gutters and two removable panels.
Figure 39:
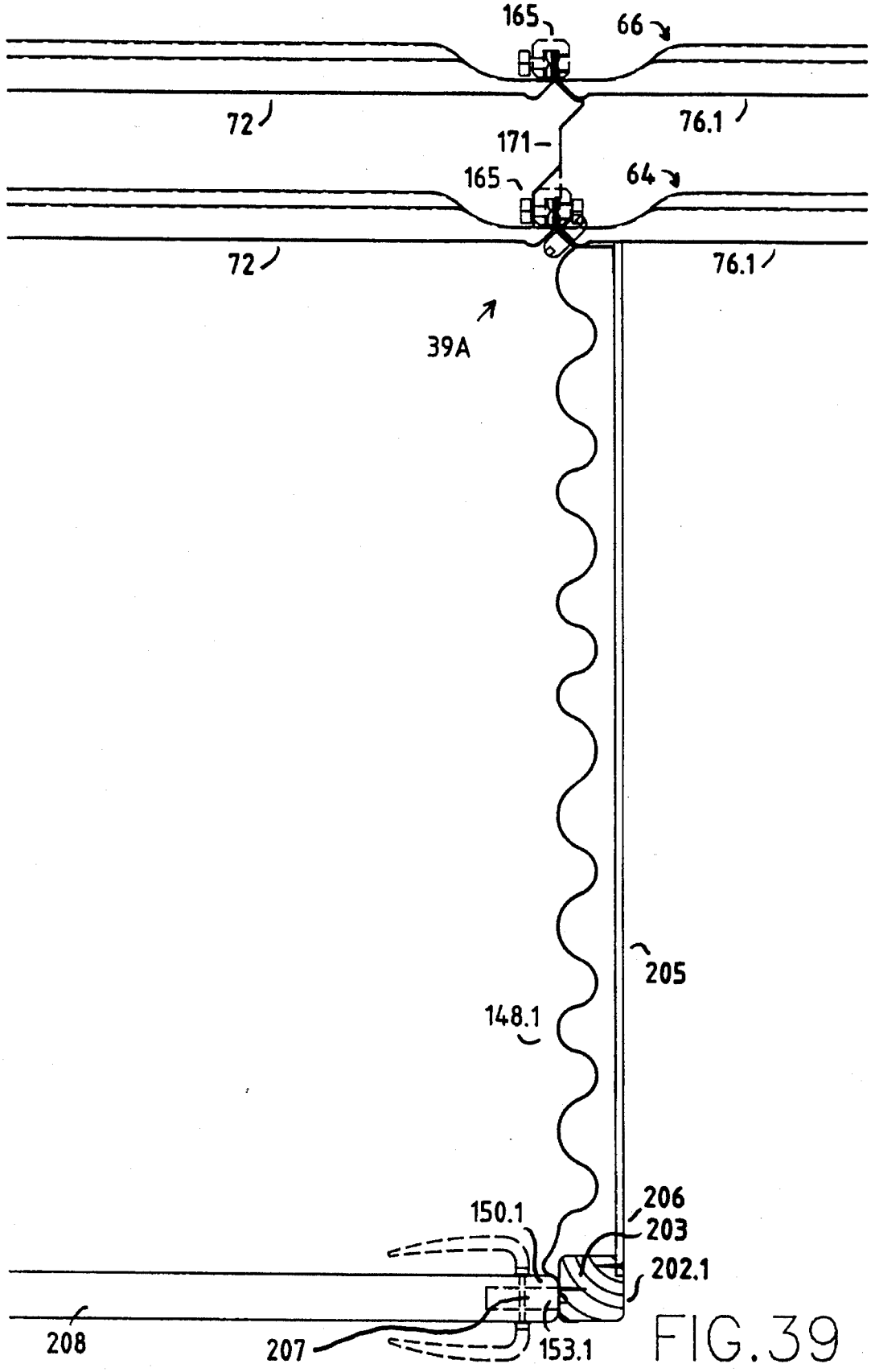
FIG. 39 is an elevation on section 39—39 shown in FIG. 1 through a support element, two removable panels and two bottom sub-panels towards the inside of the building.
Figure 39A:
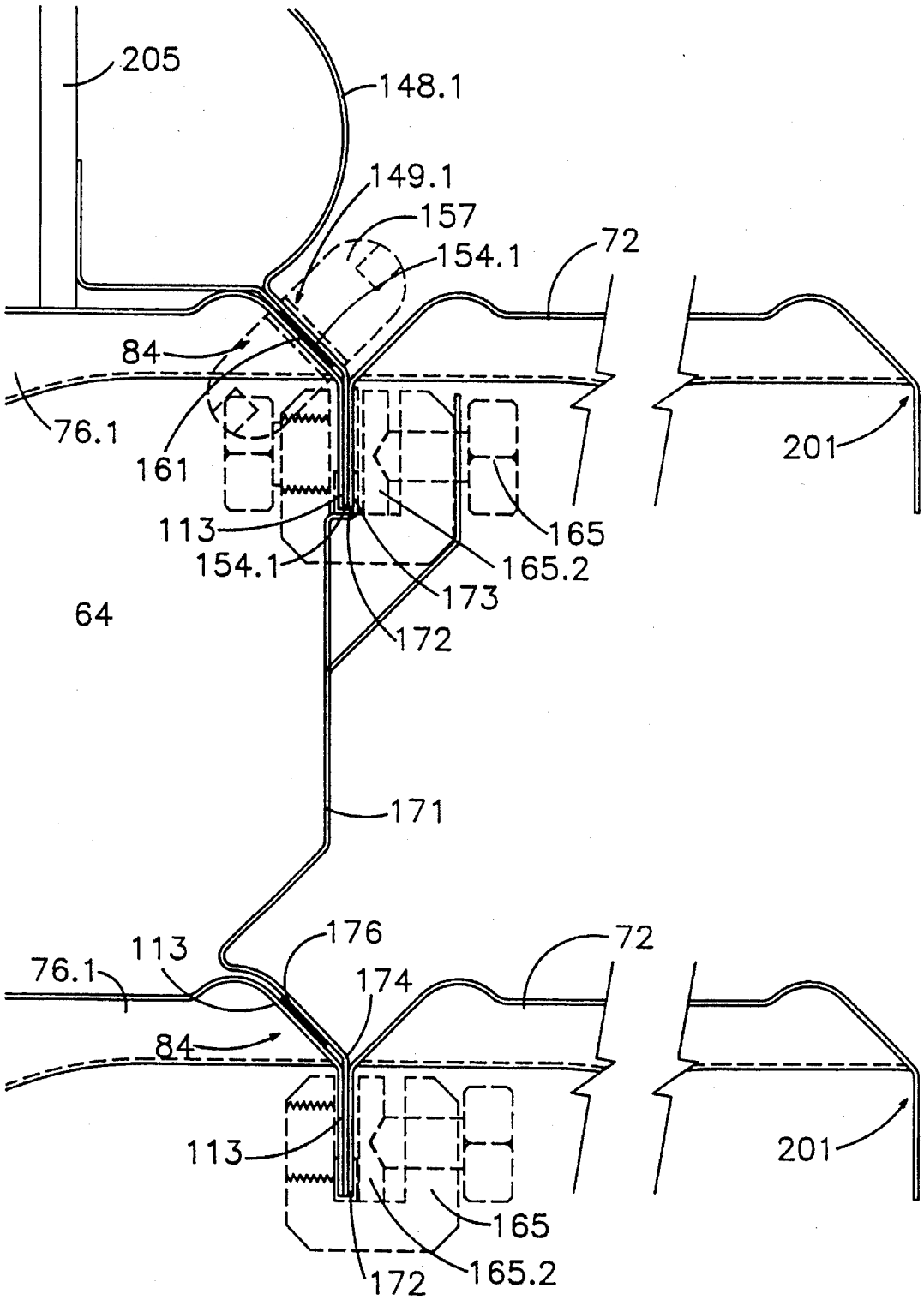
FIG. 39A is an enlarged view of the arrangement in the direction of arrow 39A, shown in FIG. 39.

The three other wall panels 62, 63, 64 of the first set 60.1 and the three other wall panels 66, 66.2, 66.3 of the second set 60.2 are each typically provided with a removable panel 72 (only the removable panel 72 in wall pane 64 shown in FIG. 1). The removable panels 72 in the wall panels 65, 66, 66.2, 66.3 of the second set 60.2 are parallel to, spaced from and generally the same as the removable wall panels 72 of the wall panels 61 to 64, of the first set 60.1. FIGS. 38, 39 and 39A more clearly show the orientation of two removable panels 72 to each other.

Windows 73 and air inlets 74 are provided in the respective wall panels 61 to 66.

The two shapes 74.1 represent pressed out areas considered as duds.

Solar heating means 75 is provided at the top part of the wall panel 61. The discussion of FIGS. 18 and 19 will elaborate on the solar heating means 75.

Figure 1A:
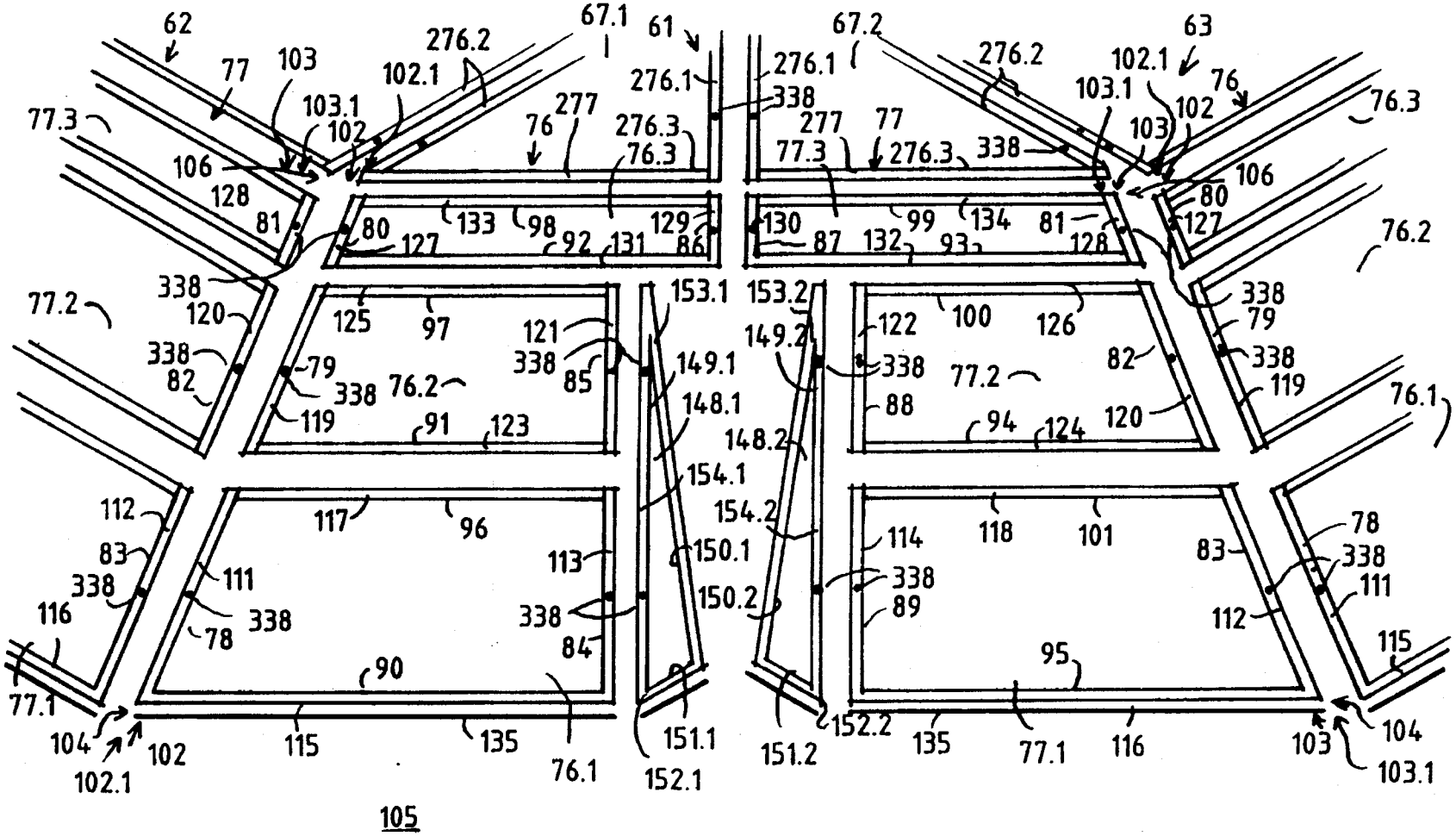
FIG. 1A schematically and in an exploded way shows the typical arrangement of a left set and a right set of sub-panels of a wall panel of the building shown in FIG. 1.
Figure 2:
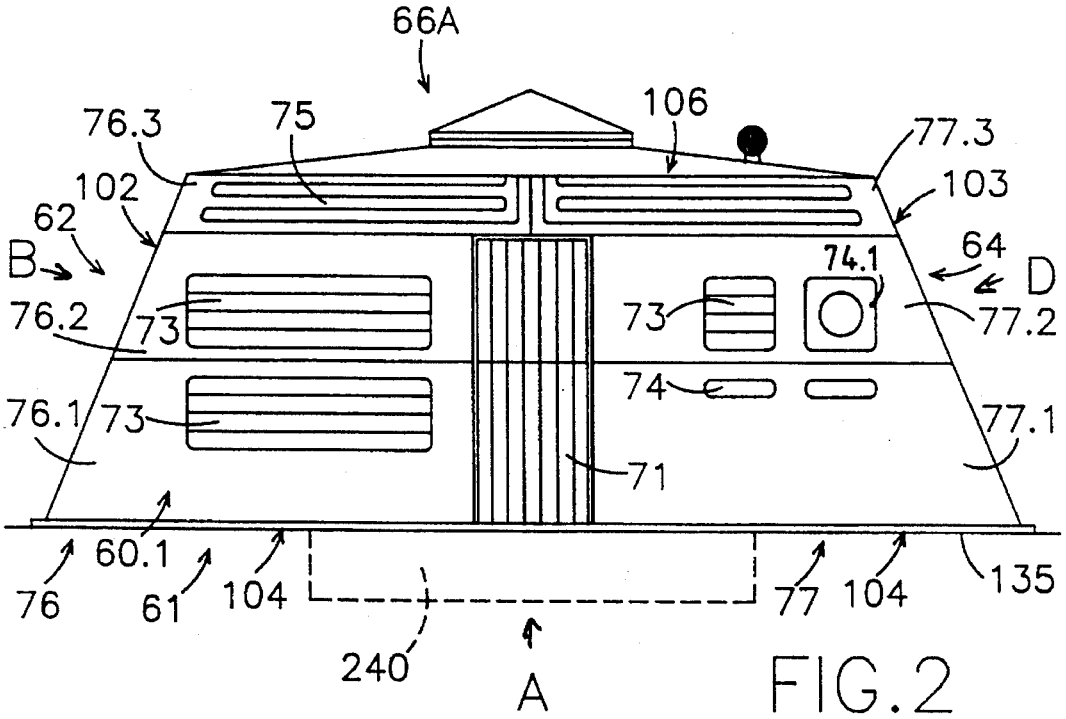
FIG. 2 is a side elevation in the direction A of a basic unit of the building shown in FIG. 1 which basic unit comprises a first set of wall panels.
Figure 3:
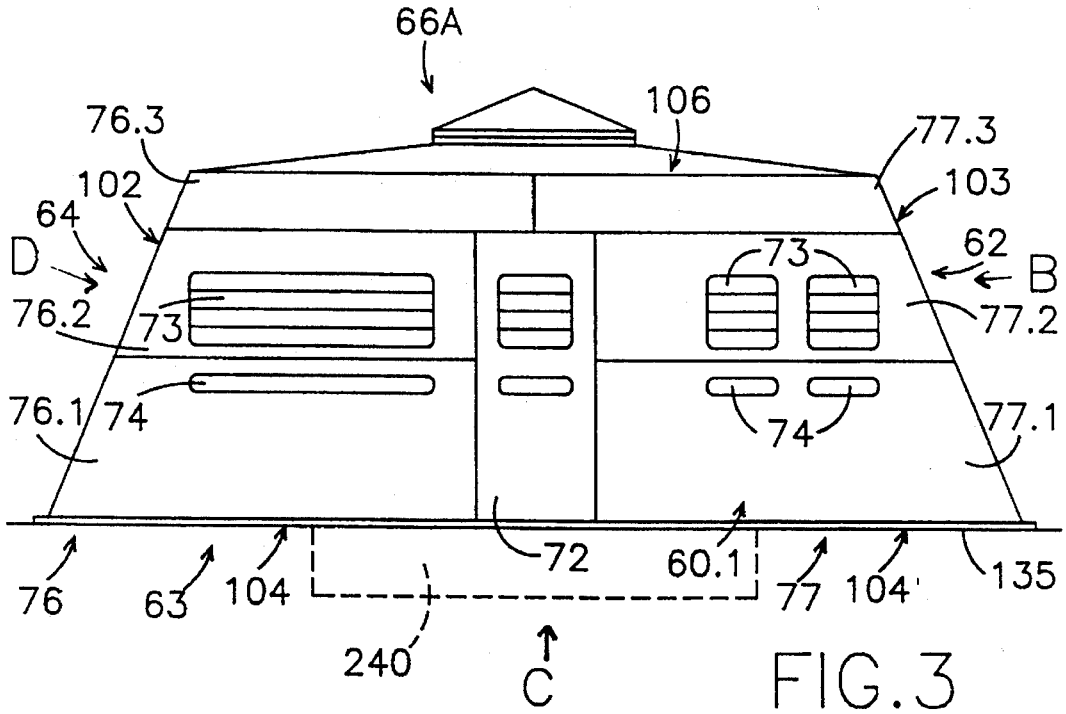
FIG. 3 is a side elevation in the direction C of the basic unit.
Figure 4:
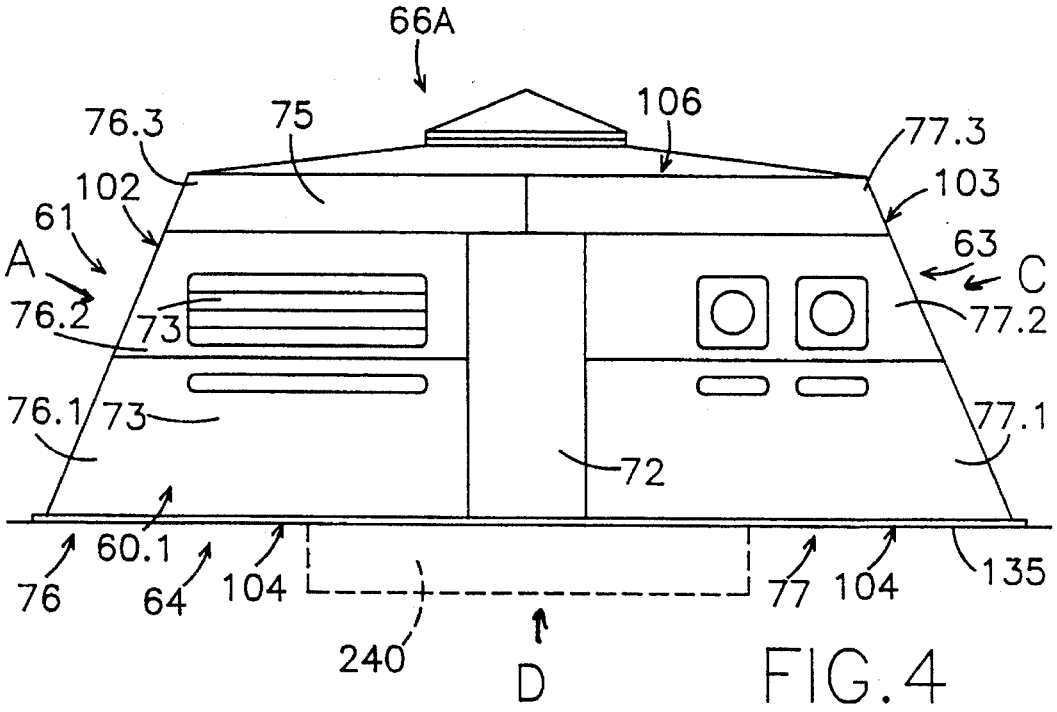
FIG. 4 is a side elevation in the direction D of the basic unit.
Figure 5:
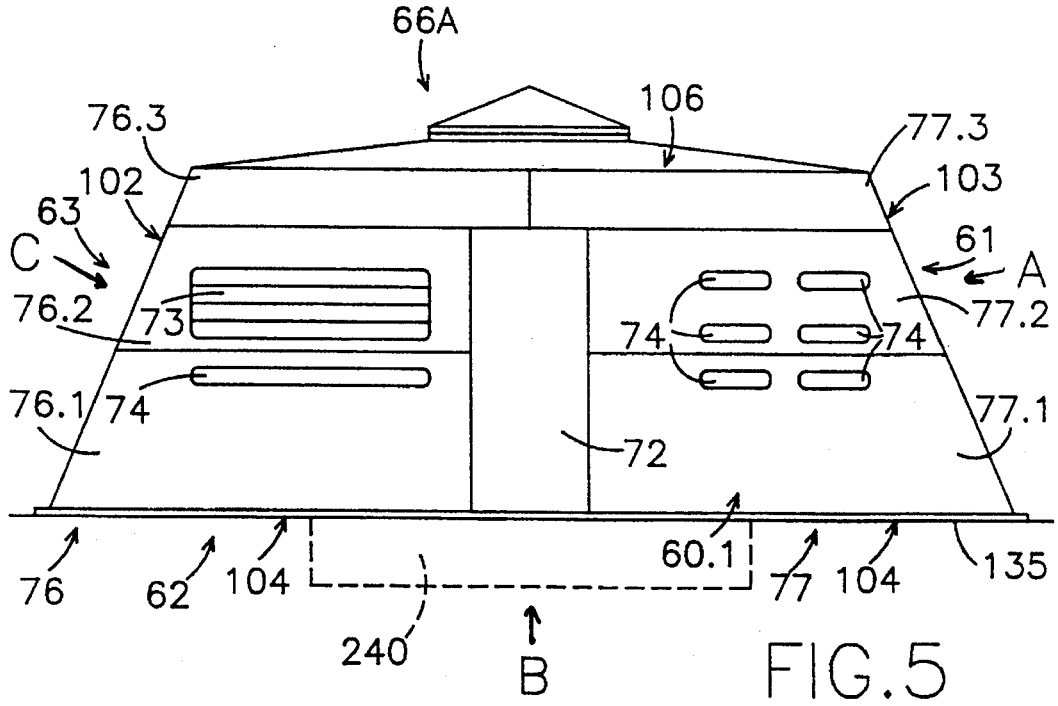
FIG. 5 is a side elevation in the direction B of the basic unit.

Each wall panel 61 to 66, 66.2, 66.3 comprises a left set 76 and a right set 77 of profiled, trapezoidal shaped sub-panels. FIG. 1A schematically and in an exploded way shows the arrangement of the left and right sets 76, 77 of sub-panels for any one wall panel 61 to 66, 66.2, 66.3 of the first and second sets 60.1, 60.2 of wall panels.

The left and right sets 76, 77 of sub-panels each comprises three sub-panels. The left set 76 of sub-panels comprises a bottom sub-panel 76.1, a middle sub-panel 76.2 and a top sub-panel 76.3. The right set 77 of sub-panels comprises a bottom sub-panel 77.1, a middle sub-panel 77.2 and a top sub-panel 77.3.

Each of the bottom, middle and top sub-panels 76.1, 76.2, 76.3, 77.1, 77.2, 77.3 of the first and second sets 60.1, 60.2 comprises an outer side edge 78 to 83, an inner side edge 84 to 89, a bottom edge 90 to 95 and a top edge 96 to 101.

Reverting to FIGS. 1 and 1A it will be understood that regarding trapezoidal shape and profile the bottom sub-panels 76.1, 77.1 have mirror images, the middle sub-panels 76.2, 77.2 have mirror images and so the top sub-panels 76.3, 77.3

Figure 6:
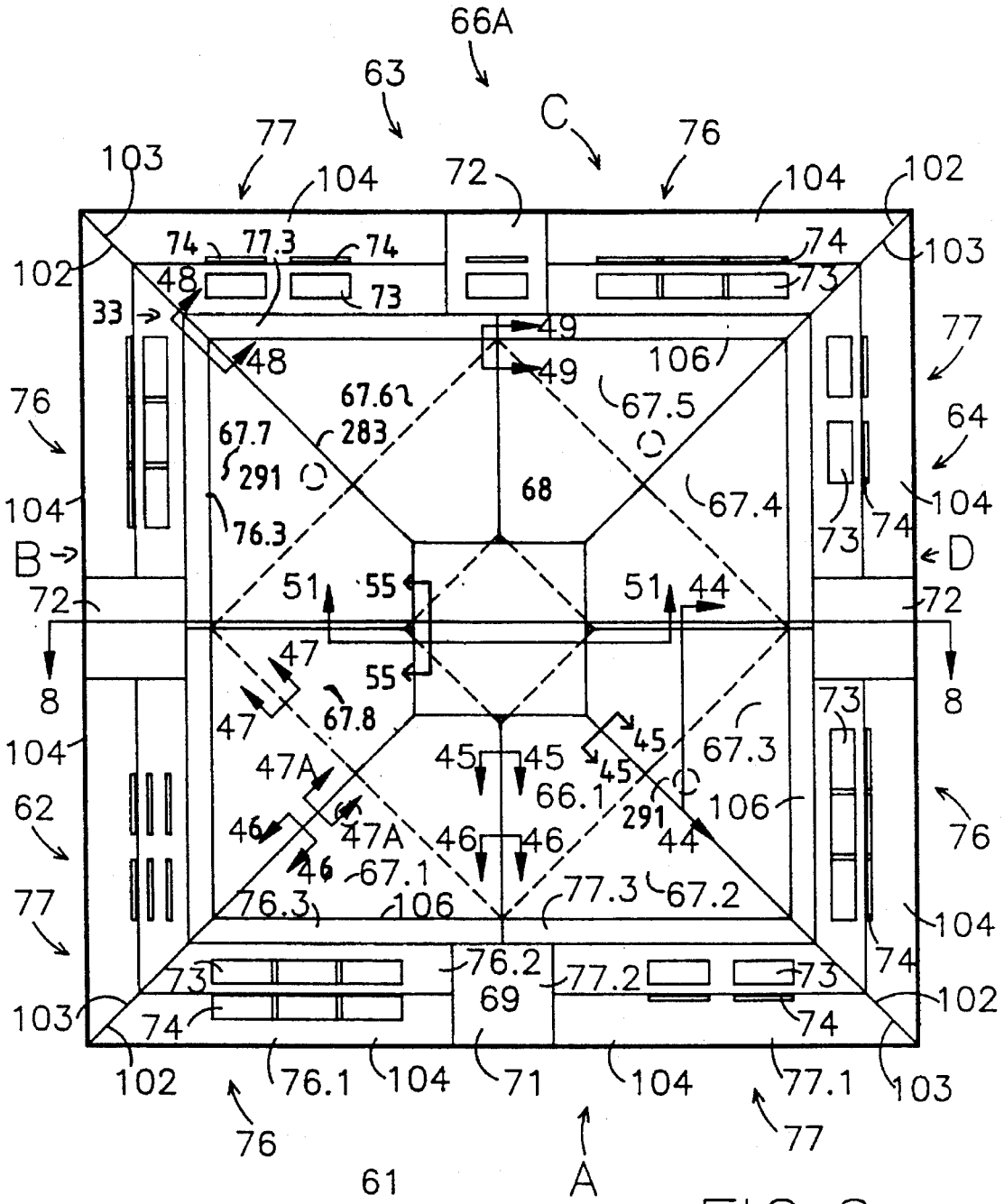
FIG. 6 is a plan view of the basic unit of the building shown in FIG. 1.

Referring to FIG. 1A, it can be seen that each wall panel 61 to 64, 66.2, 66.3 of the first set 60.1 and second set 60.2 of wall panels comprises a left side edge 102 having a left side flange 102.1, a right side edge 103 having a right side flange 103.1 which is opposite to the left side edge 102, a bottom edge 104 at the ground 105 and extending between the left and right side edges 102, 103, and a top edge 106 at the roof 67. The top edge 106 is opposite and generally parallel to the bottom edge 104. Typically, the left side edge 102 of one wall panel is adjoined to the right side edge 103 of one other adjacent wall panel via the left and right side flanges 102.1, 103.1. FIG. 6 typically shows that all the wall panels 61 to 64 are attached in this manner so that they lean towards one another and towards the inside 66.1 of the basic unit 66A and thus also towards the inside of the building 60.

Referring to FIG. 1A it is schematically shown that each of the bottom panels 76.1, 77.1 has an outer flange 111, 112 on its outer edge 78, 83; an inner flange 113, 114 at its inner edge 84, 89; a depending bottom flange 115, 116 at its bottom edge 90, 95 and a top attachment formation 117, 118 at its top edge 96, 101.

Each of the middle sub-panels 76.2, 77.2 has an outer flange 119, 120 at its outer edge 79, 82; an inner flange 121, 122 at its inner edge 85, 88; a bottom attachment formation 123, 124 at its bottom edge 91, 94 and a top attachment formation 125, 126 at its top edge 97, 100.

Each of the top sub-panels 76.3, 77.3 has an outer flange 127, 128 at its outer edge 80, 81; an inner flange 129, 130 at its inner edge 86, 87; a bottom attachment formation 131, 132 at its bottom edge 92, 93 and a top attachment formation 133, 134 at its top edge 98, 99.

The profiles of the respective sub-panels of the building 60, 60A will be described in more detail later in the detail description.

Figure 15:
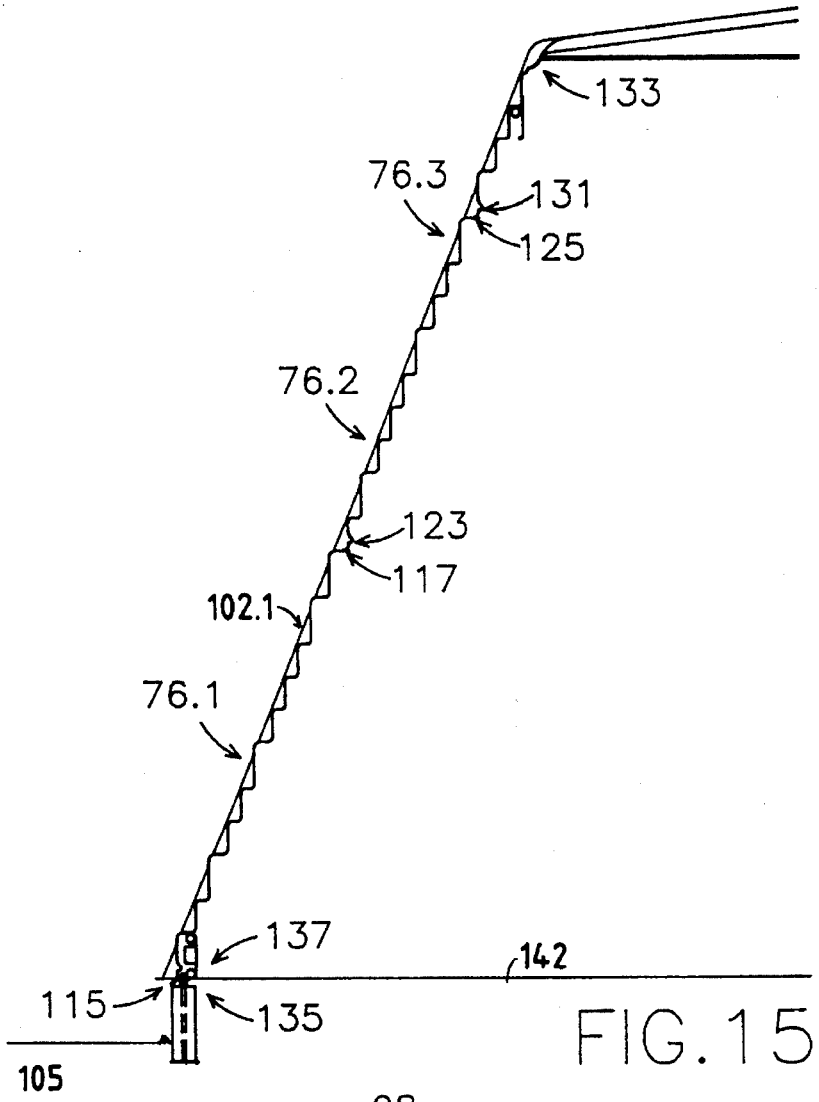
FIG. 15 is an elevation of a typical wall-panel on section 15—15 shown in FIG. 1.
Figure 16:
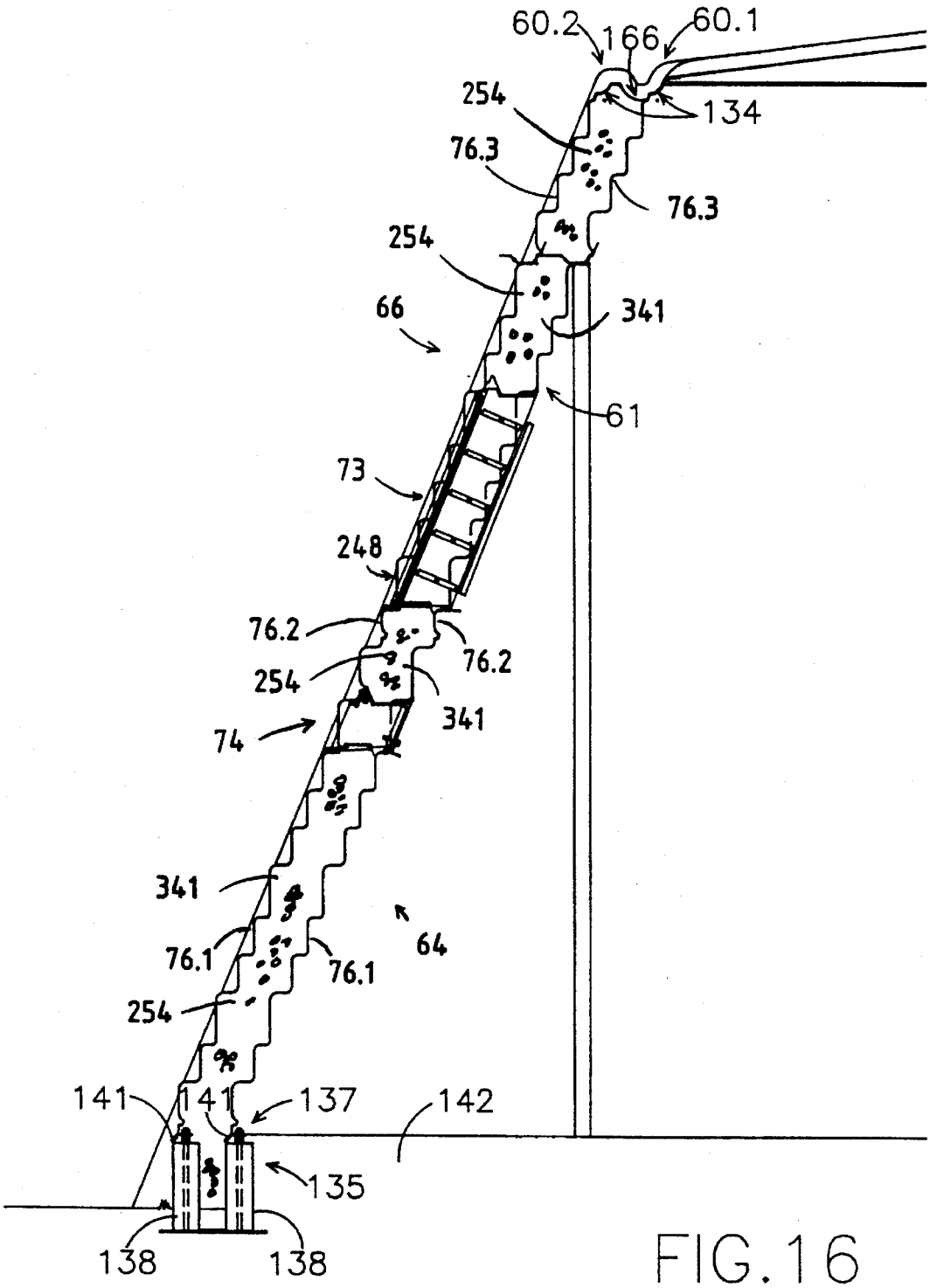
FIG. 16 is an elevation on section 16—16 shown in FIG. 1 through a wall panel including a window and an air inlet.
Figure 26:
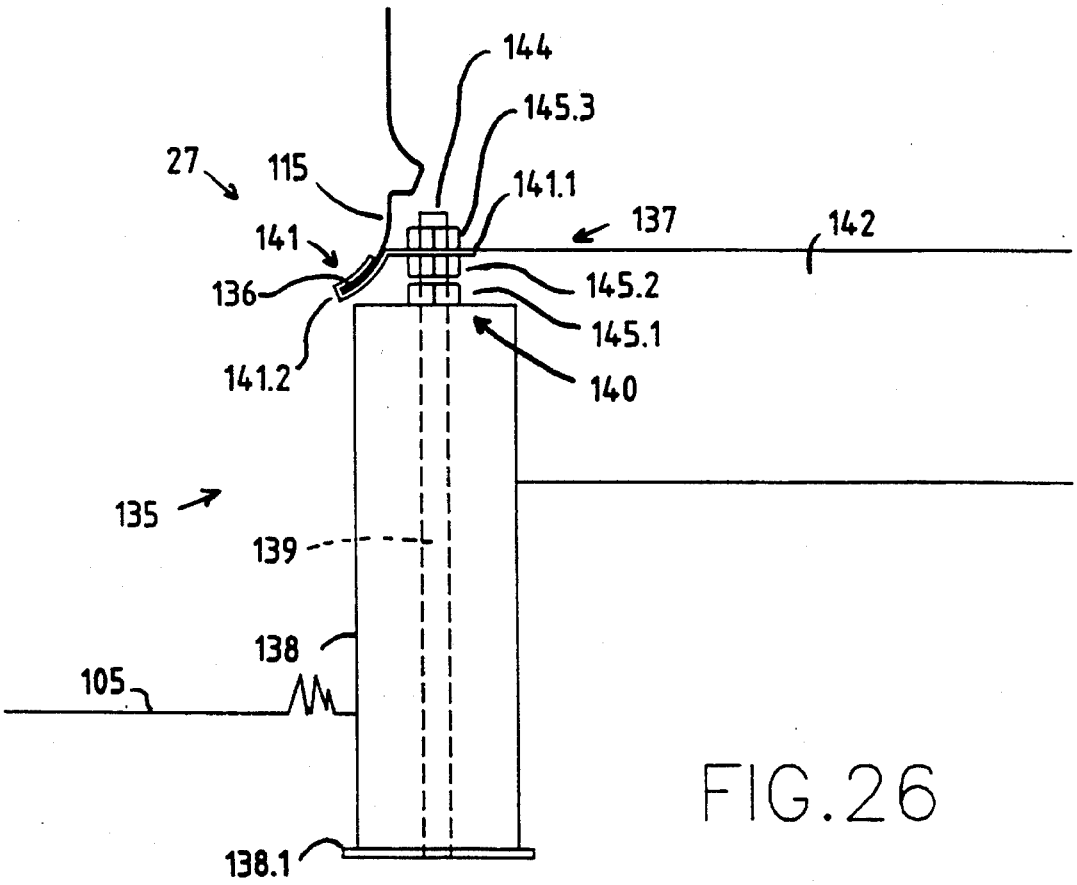
FIG. 26 is an elevation on section 26—26 shown in FIG. 1 through one bottom sub-panel and a base of the building.
Figure 27:
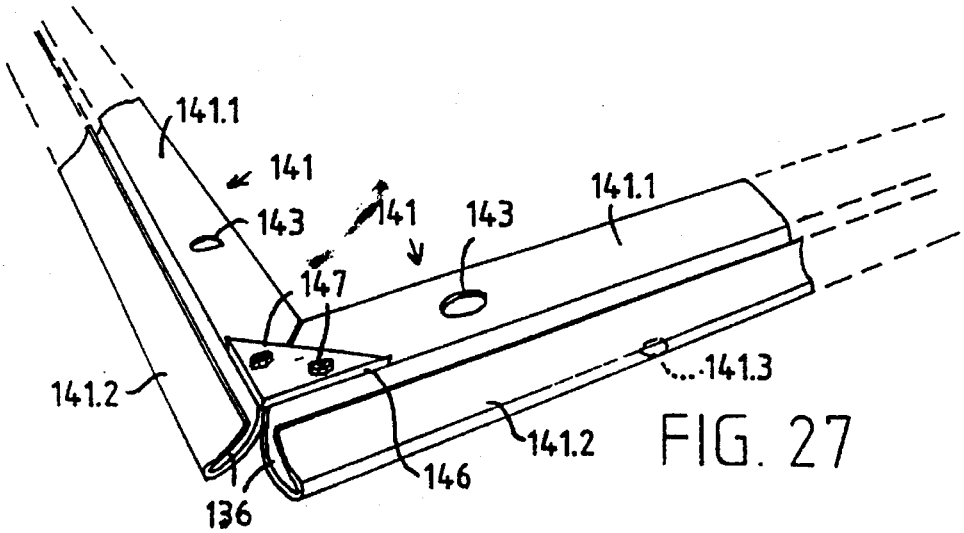
FIG. 27 is an isometric view generally in the direction of arrow 27 of two anchor base members used as part of the base shown in FIG. 26 only one anchor base member shown in FIG. 26.
Figure 28:
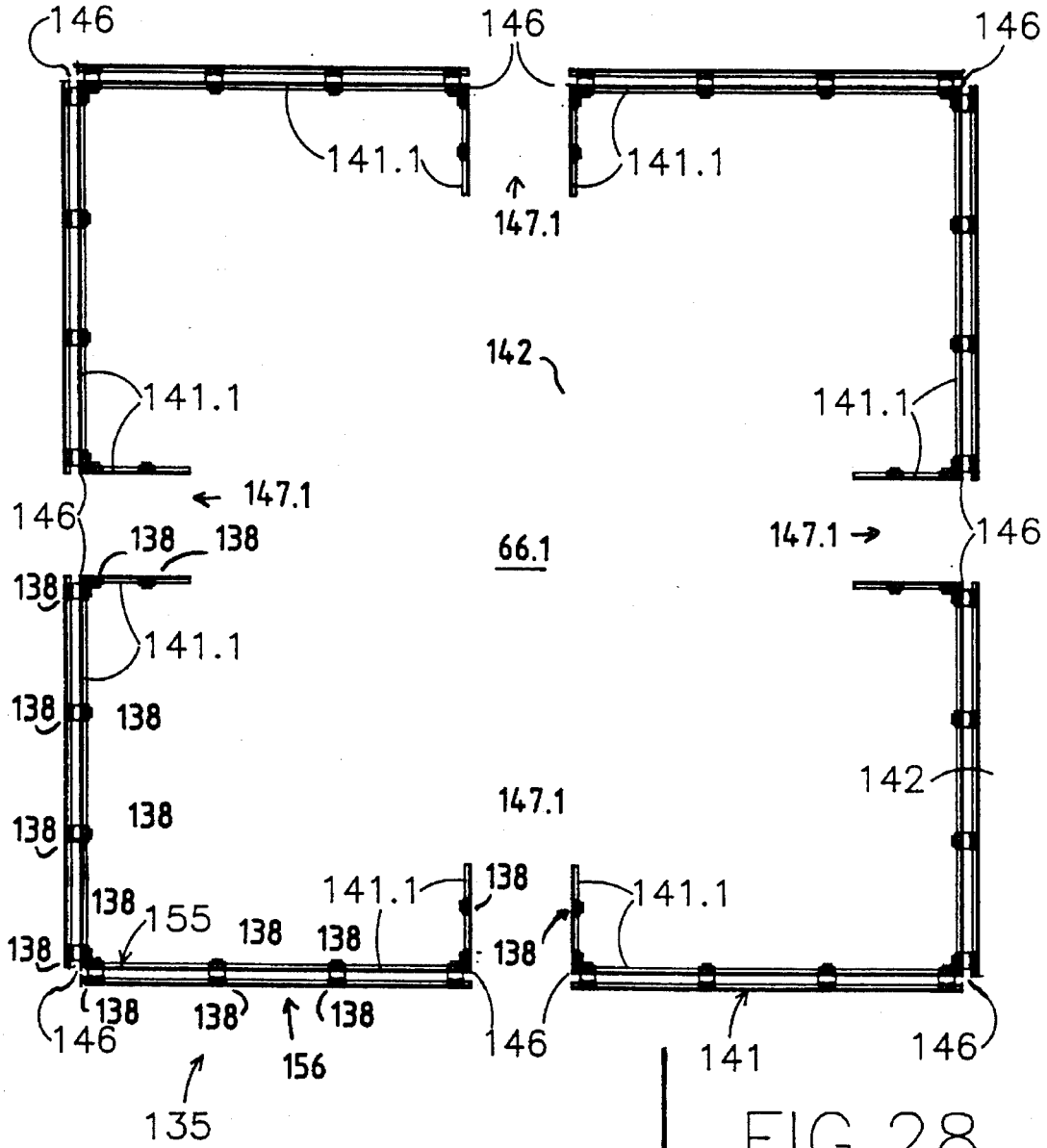
FIG. 28 is a plan view of a preferred arrangement of a plurality of an anchor base members which form part of a base of the building shown in FIG. 1, the bottom sub-panels to be slid into the respective anchor base members.

Referring to FIGS. 15, 16 and particularly FIG. 26 it is shown that the building 60, 60A further comprises a base 135 comprising a rectangular anchor column 138 on a base plate 138.1, the column having a threaded bolt 139 which protrudes from its top end 140, an elongate metal anchor base member 141 defining a slit 136 and further a concrete floor 142. As an alternative the floor 142 can be made of bitumen. A preferred floor area is less than fifty square meters, preferably forty-six comma two (46,2) square meters. As shown in FIGS. 26 and 27 the anchor base member 141 comprises a strip 141.1 and a flange 141.2 depending from the strip 141.1. The depending flange 141.2 is bent over to define the slit 136. Each strip 141.1 is typically provided with a drain hole 141.3 at the bottom of the slit 136. The strip 141.1 has a hole 143 which allows the strip 141.1 to be located over the protruding end 144 of the bolt 139. Three nuts 145.1, 145.2, 145.3 are provided, the nut 145.2 used for levelling during construction of the building 60, 66A. A triangular corner plate 146 and two bolts 147 are used to attach two adjacent anchor base members 141 to each other. Shown in FIG. 28 is an arrangement of a plurality of the anchor base members 141. The anchor base members 141 forming a square 155 are used for the respective bottom members 76.1, 77.1 while the inwardly directed anchor base members 141 indicated by the arrows 147.1 are used for pairs of profiled triangular support members 148.1; 148.2 shown in FIGS. 1A, 7 and 8. An alternative to the plurality of columns 138 elongate concrete bar.

For the second set 60.2 of wall panels 65, 66, 66.2, 66.3 over the first set 60.1 of wall panels 61 to 64 another set of anchor columns 138 with slitted base members 141 attached thereto is employed. One such anchor column 138 and base member 141 for a second set wall panel 66 is shown in FIG. 16. Thus, a second square 156 of base members 141 is located on the outside of the first square 155 of base members 141 as shown in FIG. 28.

The support members 148.1, 148.2 schematically shown in FIG. 1A each has a sloping side edge 149.1, 149.2, an upright side edge 150.1, 150.2 and a bottom edge 151.1, 151.2. Each sloping side edge 149.1, 149.2 has a support flange 154.1, 154.2 for attachment of the respective bottom and middle sub-panels 76.1, 76.2, 77.1, 77.2 as will be explained later. The bottom edges 151.1, 151.2 each has a depending flange 152.1, 152.2 which are attached to the base 135 of the building 60, 66A by sliding each of the depending flanges 152.1, 152.2 into a co-acting slit 136 of an inwardly directed 147.1 anchor base member 141. Each upright side edge 150.1, 150.2 has a longitudinally extending rebate 153.1, 153.2 for the respective upright edges 153.3, 153.4 of door, one such door 71 shown in FIGS. 1 and 8 and more clearly in FIG. 37. The support members 148.1, 148.2 are minor images of each other.

In the constructed arrangement shown in FIGS. 1 to 7 and also specifically referring to FIG. 1A the respective sub-wall panels 76.1, 76.2, 76.3, 77.1, 77.2, 77.3 of each wall panel 61 to 66, 66.2 66.3 are attached in the following manner:

The bottom sub-panels 76.1, 77.1, with their bottom edges 90, 95 aligned with each other, are attached to the base 135 (refer to FIGS. 15, 16, 26, 27 and 28 of the building 60, 66A by sliding each of the depending flanges 115, 116 into a co-acting slit 136 in the top surface 137 of the base 135 specifically a slit 136 in an anchor base member 141.

Figure 32:
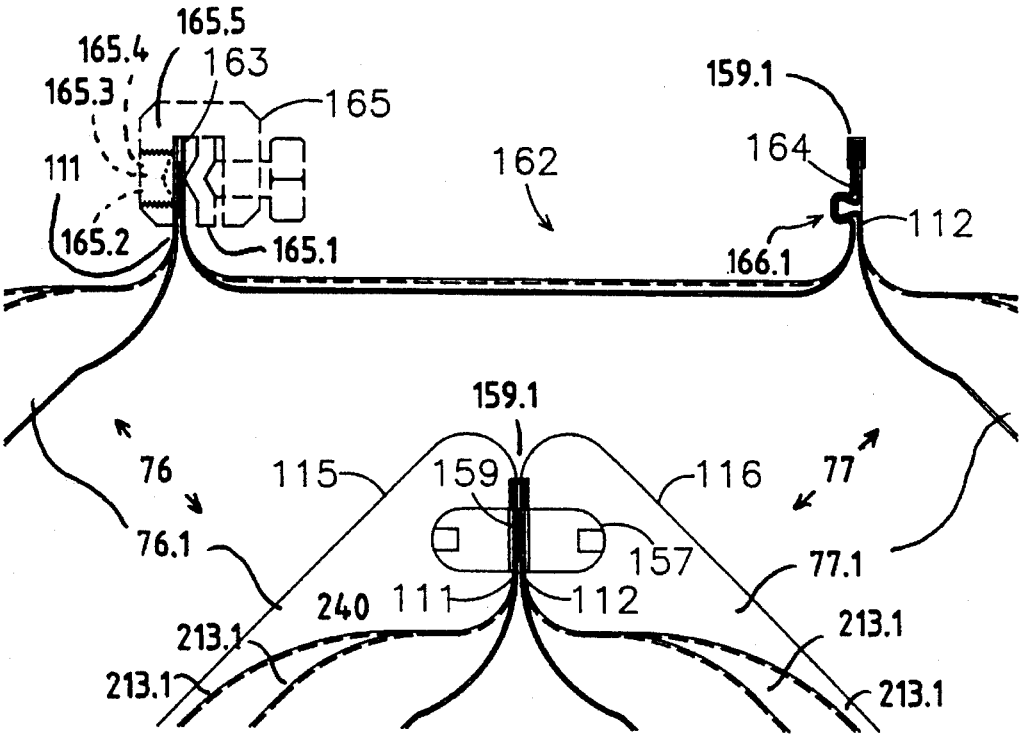
FIG. 32 is an elevation on section 32—32 shown in FIG. 1 through a corner formed by the wall panels, section 32—32 in a plane towards the ground on the inside of the building, the angle between the ground and the plane being 22°30'.
Figure 32A:
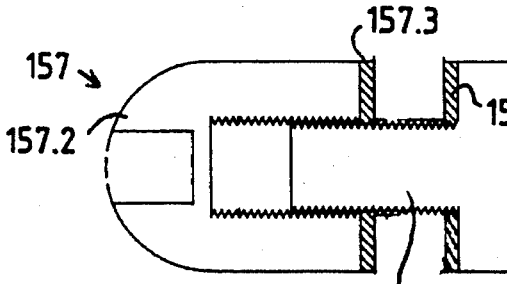
FIG. 32A is a plan view of a typical fastener 157 shown in FIG. 32.

The outer flange 111 of the bottom sub-panel 76.1 of the left set 76 is attached to the outer flange 112 of the bottom sub-panel 77.1 of the right set 77 of the adjacent wall panel 62 by means of fasteners, one fastener 157 shown in FIGS. 32 and 32A. The Velcro 159 shown is used during construction for alignment. The inner flange 113 of the bottom sub-panel 76.1 is attached to the support flange 154.1 of the support member 148.1 by means of fasteners, one fastener 165 shown in FIGS. 39 and 39A. The fastener 157 shown in FIG. 32A comprises a male part 157.1 and a female part 157.2. Teflon washers 157.3, 157.4 are also provided. Of course, the protrusion 157.5 in use extends through holes in the relevant flanges of the panels. Attachment is established by rotating the male and female parts 157.1, 157.2 towards one another. FIG. 32 also shows sealing strips 159.1 having a U-shaped cross-section and which are arranged over the adjacent flanges 111, 112. Alternatively, any suitable material can be pressed over and on to the adjacent flanges 11, 112 to cause sealing. It will be appreciated that the sealing strips 159.1 will also be used over other suitable adjacent flanges on the outside of the building 60, 66A to minimise leakage of rain water.

The outer flange 112 of the bottom sub-panel 77.1 of the right set 77 is attached to the outer flange 111 of the bottom sub-panel 76.1 of the left set 76 of another adjacent wall panel 63. The typical arrangement shown in FIG. 32 is applicable here. The inner flange 114 of the bottom sub-panel 77.1 is attached to the support flange 154.2 of the support member 148.2. The mirror images of the arrangements shown in FIG. 39 and 39A are applicable here.

All the bottom sub-panels 76.1, 77.1 are attached in the abovementioned manner so that they lean towards one another and towards the inside of the building 60, 66A.

Figure 29:
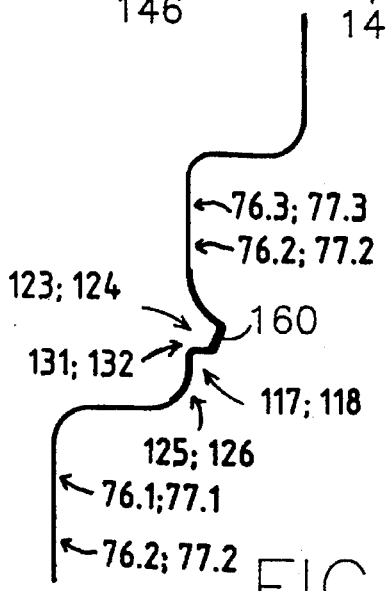
FIG. 29 is a typical elevation on sections 29A—29A and 29B—29B shown in FIG. 1 of respectively an attachment of a bottom sub-panel to a middle panel and of an attachment of a top sub-panel to a middle sub-panel.

The middle sub-panels 76.2, 77.2 are attached to the bottom sub-panels 76.1, 77.2. Also the middle sub-panels 76.2, 77.2 lean towards one another and towards the inside of the building 60, 66A. More specifically:

The respective bottom attachment formations 123, 124 of the middle sub-panels 76.2, 77.2 are attached by means of Velcro 160 to the respective top attachment formations 117, 118 of the bottom sub-panels 76.1, 77.1 typically as shown in FIG. 29. The respective outer flanges 119, 120 of the middle sub-panels 76.2, 77.3 are attached to the respective outer flanges 119, 120 of the adjacent wall panels 62, 63. The typical arrangement shown in FIG. 32 and the mirror image thereof are equally applicable here. The respective inner flanges 121, 122 are attached to the respective support flanges 154.1, 154.2 of the support members 148.1, 148.2. The arrangements shown in FIGS. 39 and 39A and the mirror image thereof are equally applicable here. The Velcro 161 shown in FIG. 39A assists during construction.

Further, the top sub-panels 76.3, 77.3 are attached to the middle sub-panels 76.2, 77.2. The top sub-panels 76.3, 77.3 also lean towards one another and towards the inside of the building 60. More specifically:

The respective bottom attachment formations 131,132 of the top sub-panels are attached to the respective top attachment members 125, 126 of the middle sub-panels 76.2, 77.2. The arrangement shown in FIG. 29 is equally applicable here. The respective outer flanges 127, 128 are attached to the respective outer flanges 127, 128 of the adjacent wall panels 62, 63. The arrangement shown in FIG. 32 and its mirror image are equally applicable here. The respective adjacent inner flanges 129, 130 are attached to each other.

From the above arrangement of the bottom, middle and top sub-panels 76.1 to 76.3 and 77.1 to 77.3 it will be understood that the aligned outer edges 78, 79, 80 of the bottom, middle and top sub-panels 76.1, 76.2, 76.3 of the left set 76 form the left side edge 102 of each of the wall panels 61 to 65, 66.2, 66.3. The aligned outer edges 81, 82, 83 of the bottom, middle and top sub-panels 77.1, 77.2, 73.3 of the right set 77 form the right side edge 103 of each of the wall panels 61 to 65, 66.2, 66.3. The aligned top edges 98, 99 of the two top sub-panels 76.3, 77.3 form the top edge 106 of each of the wall panels 61 to 65, 66.2, 66.3. The aligned bottom edges 90, 95 form the bottom edge 104 of a wall panel 61 to 65, 66.2, 66.3.

An important advantage of the sub-panels 76.1, 76.2, 76.3, 77.1, 77.2, 77.3 being arranged and attached in the aforegoing manner is that no upwardly extending frame is needed to support the sub-panels 76.1, 76.2, 76.3, 77.1, 77.2, 77.3. The attachments of the outer flanges to each other as explained above obviate the need of an upwardly extending frame. A frameless building 60, 66A is thus provided.

The roof panels 67.1 to 67.8 are attached to the top sub-panels 76.3, 77.3. These attachments will be described later.

The outer, second set 60.2 of wall panels 65, 66, 66.2, 66.3 have their respective bottom, middle and top sub-panels 76.1, 76.2, 76.3, 77.1, 77.2, 77.3 arranged relative to one another and attached to one another in the same way as for the inner, first set 60.1 of wall panels 61 to 64. However, the attachment of a wall panel of the second set 60.2 of wall panels to another wall panel of the second set differs. FIG. 32 shows that the respective outer flanges 111, 112 are attached to each other by means of a channel shaped chute 162 between them. The respective webs 163, 164 of the chute 162 are attached to the outer flanges 111, 112 either by means of fasteners, one of which is shown by the numeral 165 or by deforming the outer flange 111, 112 into the web 163, 164 as typically shown at 166.1 in FIG. 32. Last-mentioned deformation attachment 166.1 can also be suitably employed for attachment of the other flanges of sub-panels to each other where possible and if desired. This type of attachment will render a permanent joint while the other type of fasteners, typically 157, 165 can be of temporary use. FIG. 32 shows that the fastener 165 which functions as a clamp has a V-shaped clamp plate 165.1 which deforms the web 163 and outer flange 111 as indicated by the dotted lines 165.3 into a V-shaped hole 165.4 in the base 165.5 of the fastener 165. The chute 162 shown extends between the ground 105 and the roof 67 where it is suitably attached as will be described later. Thus, the outer flanges 119, 120 of adjacent middle sub-panels 76.2, 77.2 and the outer flanges 127, 128 of adjacent top sub-panels 76.3, 77.3 are also attached to the webs 163, 164 of the chute 162. The attachment of the chute 162 at the top corner 33 of the building 66 shown in FIG. 33 will be discussed later.

The outer, second set 60.2 of wall panels is further attached to the inner, first set 60.1 of wall panels 60.1 as typically shown in FIGS. 16, 31, 38 and 39.

Figure 31:
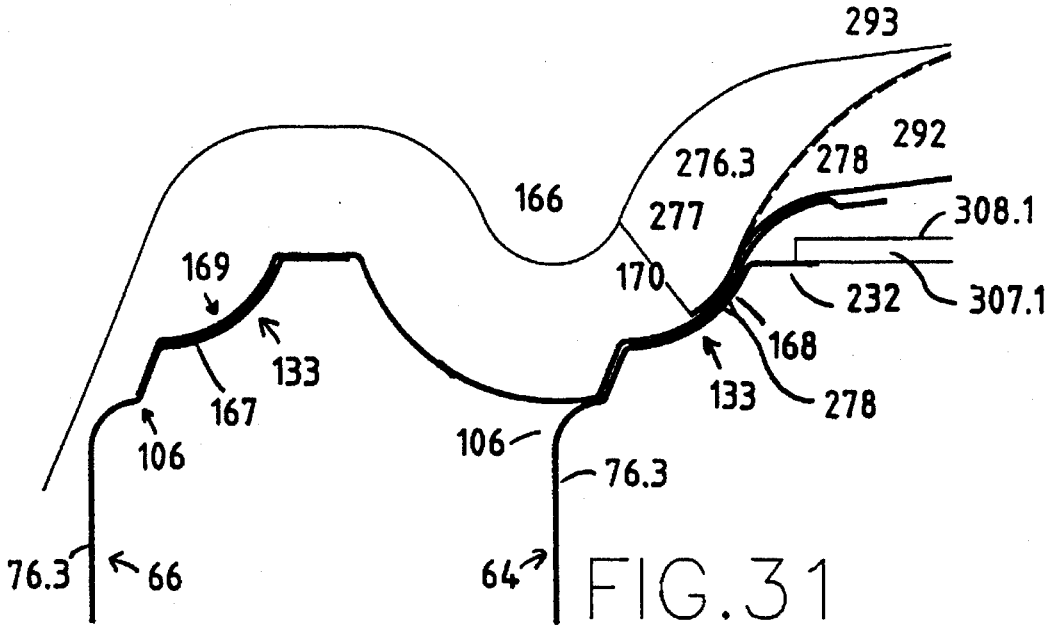
FIG. 31 is an elevation on section 31—31 shown in FIG. 1 typically showing the respective attachments of the roof and gutter to the respective top sub-panels of the spaced apart wall panels.

A typical attachment is shown in FIG. 16 where the top sub-panel 76.3 of the left set 76 of the wall panel 66 of the second set 60.2 of wall panels is attached to the top sub-panel 76.3 of the left set 76 of the wall panel 64 of the first set 60.1 of wall panels by means of a gutter 166. FIG. 31 shows the attachment in more detail. Attachment is accomplished by means of the profiles shown and the Velcro 167, 168. It is shown that the curved edges 169, 170 of the gutter 166 are complementary to the top attachment formations 133 of the top sub-panels 76.3. The gutter 166 extends along the top edges 106 of the respective wall panels 64, 66.

A typical elongate intermediate panel 171 is shown in FIGS. 39 and 39A, which extends between the bottom edges 90, 95 of the bottom sub-panels 76.1, 77.1 and the respective top edges 97, 100 of the middle sub-panels 76.2, 77.2. The intermediate panel 171 typically attaches the outer, second set 60.2 bottom and middle sub-panels 76.1, 76.2 to the inner first set 60.1 bottom and middle sub-panels 76.1, 76.2. Each removable panel 72 shown in FIGS. 39 and 39A has an upstanding flange 172, with an inner edge 173 and an outer edge 174 of the intermediate panel 171 attached to the respective upstanding flanges 172 and the respective inner flanges 113 of the bottom sub-panels 76.1. Fasteners 165 and Velcro 176 are employed. The fasteners 165 employed here, each has a flat clamp plate 165 which minimises damage to the clamped surface. It will be understood that the inner flange 121 of the middle sub-panel 76.2 are also attached to the intermediate panel 171 typically as described above. A second intermediate panel (not shown) having the mirror image of the shown intermediate panel 171 is used to attach the respective bottom and middle sub-panels 77.1, 77.2 of the first set 60.1 of sub-panels 61 to 64 to the respective bottom and middle sub-panels 77.1, 77.2 of the second set 60.2 of sub-panels. Last-mentioned arrangement will, of course, have the mirror image arrangement of that shown in FIG. 39.

Referring to section 39A—39A in FIG. 1 where only a corner portion 39.1 of a bottom sub-panel 76.1 of a second set 60.2 wall panel 60.2 is shown, the attachment arrangement is generally the same as shown in FIGS. 39, 39A where the intermediate panel 171 attaches the respective bottom sub-panels 76.1 to each other.

Further referring to FIG. 39A the support flange 154.1 of the support member 148.1, the upstanding flange 172 of the inner removable panel 72, the inner flange 113 of the bottom sub-panel 76.1 and the inner edge 173 of the intermediate panel 171 are attached with a plurality of fasteners, one fastener 165 shown. Velcro 161 is used between the support flange 154.1 and the inner flange 113. The fastener 157 may be used, but as an alternative. It will be understood that the inner flange 121 of the middle sub-panel 76.2 is in the same manner attached to the support flange 154.1, the upstanding flange 172 and the inner edge 173. A mirror image arrangement (not shown) is found at the opposite edge 201 of the removable panel 72.

Referring to FIG. 38 it is typically shown how two removable panels 72 (at their top edges 177) are interconnected with each other and how the top sub-panels 76.3 of a first set 60.1 of sub-panels and of a second set 60.2 of sub-panels are attached to the removable panels 72. The top edge 177 of each removable panel 72 has a flange 178 with an S-shape profile as shown. Three elongate, intermediate profiled panels 179, 180, 181 are employed and co-act in the abovementioned inter-connection. The respective panels 180, 181 (having the same profile) fit the respective bottom formations 131 of the top sub-panels 76.3 and the respective flanges 178 of the removable sub-panels 72. The profiled bottom attachment formation 131 of each top sub-panel 76.3 co-acts with the complementary profile of the respective panels 180, 181. Velcro 190, 191 attach the bottoms 192.2 of the respective channels 192.1 to the respective upstanding flanges 180.1, 181.1 panels 180, 181. The co-acting channels 182, 183 of the panels 179, 181 are attached to each other by a bolt 184 and nut 185. The channels 182, 183 function as a gutter. Further, the panel 179 is attached to the channel 186 of the panel 180 by means of a bolt 187, nut 188 and Velcro 189.

Figure 34:
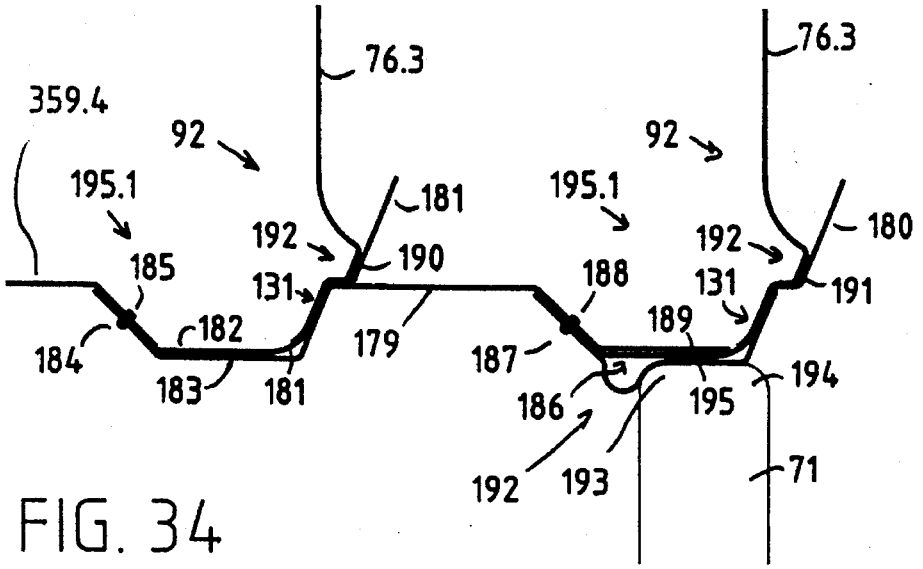
FIG. 34 is an elevation on section 34—34 shown in FIG. 1 through a bottom part of two top sub-panels, two gutters and a top part of a door.
Figure 35:
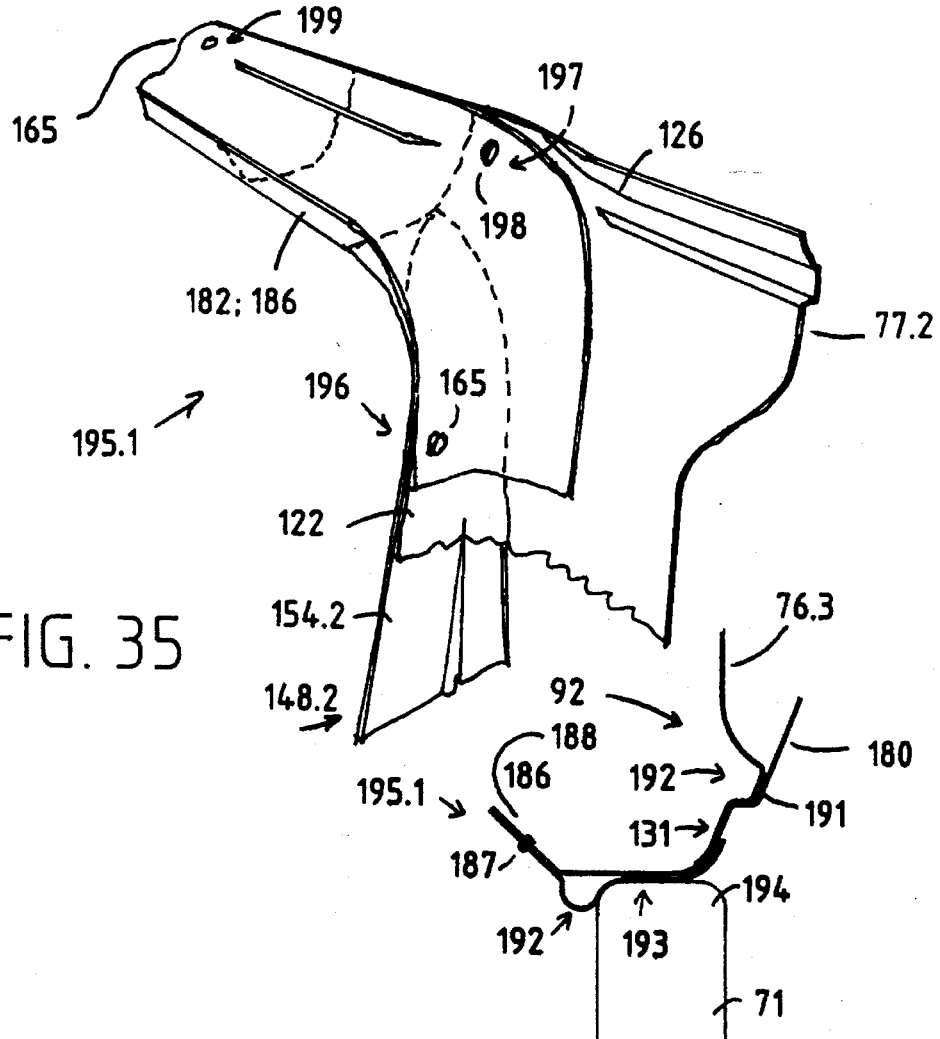
FIG. 35 is a view of one of the two gutters used above the door shown in FIG. 34.
Figure 36:
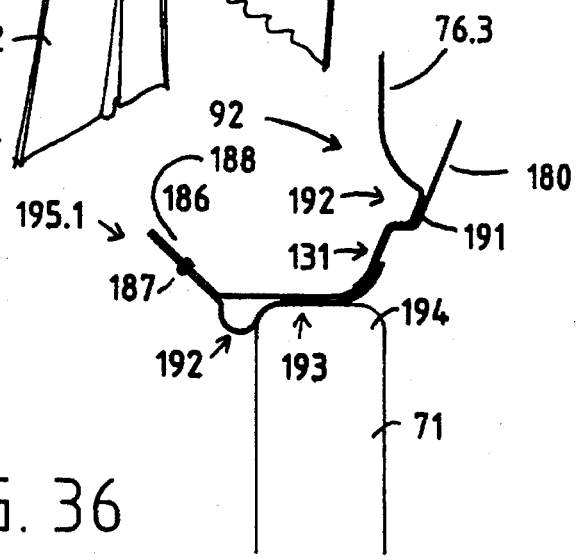
FIG. 36 is basically the same as FIG. 34, but with only one top sub-panel when only a first set of wall panels is employed.

Reverting to FIGS. 34, 35 and 36 it is typically shown how the top sub-panels 76.3 are arranged above the door 71. The channel shaped panels 180, 181 shown in FIG. 38 are employed in the same manner and thus like parts are indicated with like numerals. However, a modified channel shaped panel 192 having a rebate 193 for the top edge 194 of the door 71 is used beneath the panel 180 and attached thereto by Velcro 195 and the bolt 187 and nut 188. FIG. 36 shows where only one top sub-panel 76.3 is employed.

Another partial view of the abovementioned arrangements is shown in FIG. 35 which is applicable to the case where only a first set 60.1 of wall panels 61 to 64 is used and also where both the first and second sets 60.1, 60.2 of wall panels 61 to 66, 66.2, 66.3 are used. The arrangement in FIG. 35 is generally indicated by the numeral 195.1 in the FIGS. 1, 34 and 35. A mirror image arrangement 196.1 of the gutter is also shown in FIG. 1. The channel 186 bends downwards and is attached at 196 to the inner flange 122 of the middle sub-panel 77.2 and to the support flange 154.2 of the support member 148.2 However, the second channel 182 which also bends downwards is not attached to the support flange 154.2, but to the outer edge 174 of an intermediate panel 171. A fastener 165 as shown in FIG. 32 can be used here. Alternatively, the deformation attachment discussed above can be used. At 197 the channel 182 is attached to the top attachment formation 126 of the middle sub-panel 77.2 by means of a suitable fastener 198 extending through the channel 182 and the middle sub-panel 77.2. At 199 a fastener 165 or alternatively the deformation attachment 166.1 can be used to attach the channel 182 to the top sub-panel 77.3.

Figure 37:
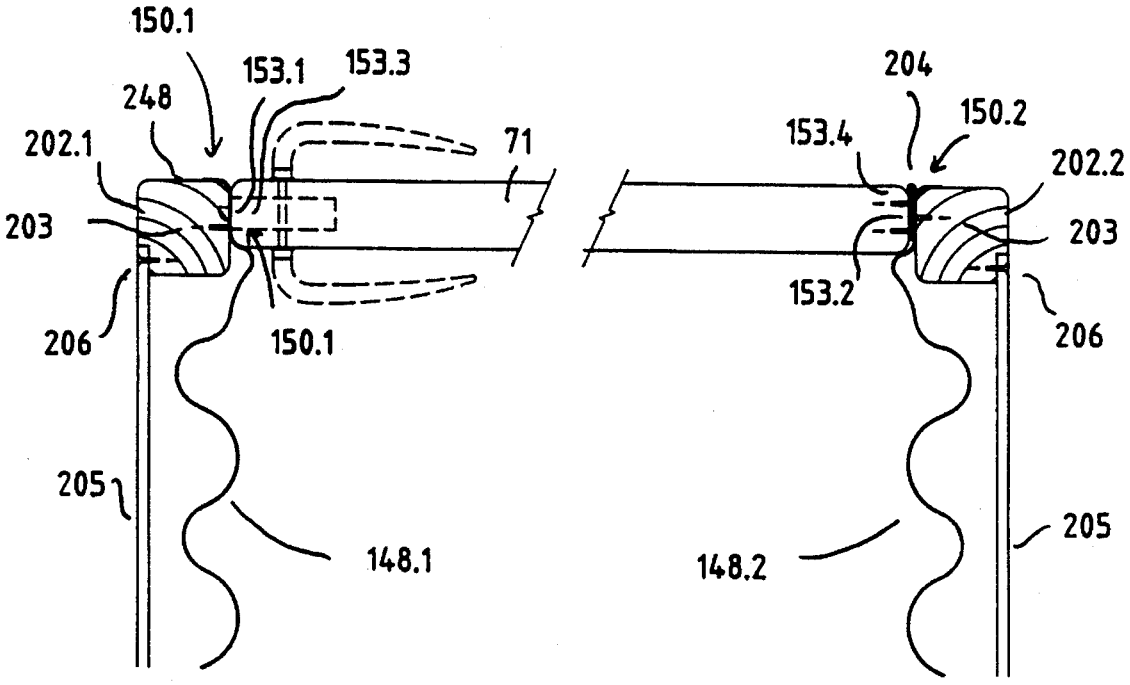
FIG. 37 is an elevation on section 37—37 shown in FIG. 8 through a door and two support elements, section 37—37 in a plane parallel with the ground.

Reference is now made to FIG. 37 which shows the attachment of the door 71 to the pair of support members 148.1, 148.2. It can be seen that the upright side edge 153.3 of the door 71 fits in the rebate 153.1 of the support member 148.1 while the upright side edge 153.4 of the door 71 fits in the rebate 153.2. The respective upright side edges 150.1, 150.2 of the support members 148.1, 148.2 are attached to timber supports 202.1, 202.2 by means of nails 203. The upright edge 153.4 of the door 71 is attached to the rebate 153.2 and timber support 202.2 via hinges; one hinge 204 shown. A gypsum board 205 is located next to each support member 148.1, 148.2, one edge 206 nailed to the timber support 202.1, 202.2.

Referring to FIG. 39 it is shown that the rebate 153.1 of the support member 148.1 accommodates an upright side edge 207 of a cupboard door 208. Also here the upright edge 150.1 of the support member 148.1 is nailed to a timber support 202.1. A gypsum board 205 is also shown.

More detail of the profiles of the respective wall sub-panels 76.1, 76.2, 76.3, 77.1, 77.2, 77.3, the support members 148.1, 148.2 and removable panel 72 will now be discussed.

Figure 21:
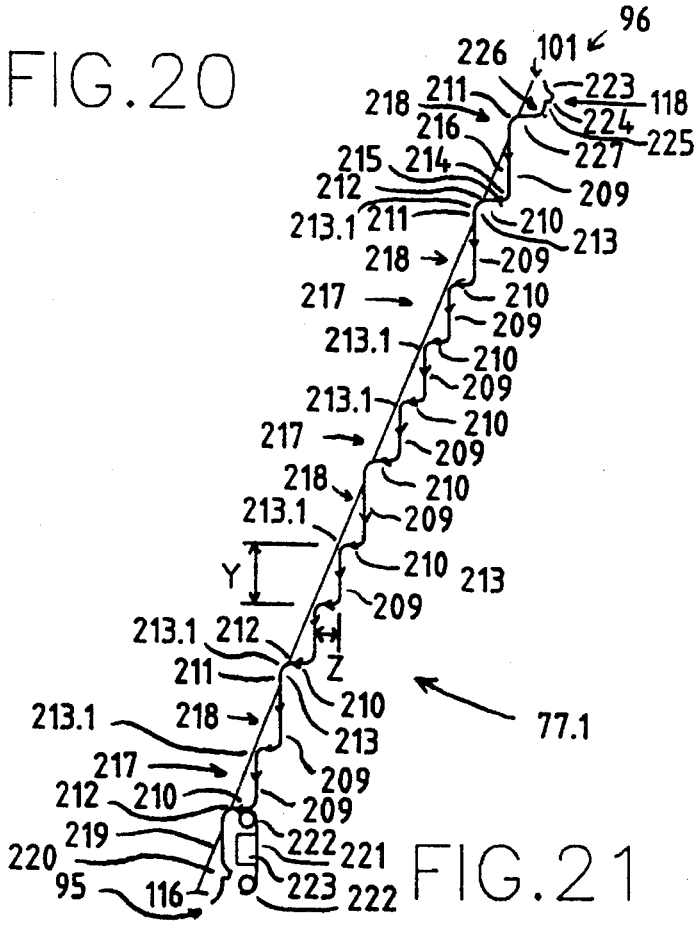
FIG. 21 is an elevation on section 21—21 shown in FIG. 1 through a bottom sub-panel.

FIG. 21 shows a typical profile of a bottom sub-panel 76.1, 77.1 of the building 60, 66A. FIG. 21 specifically shows the bottom sub-panel 77.1 of the wall panel 64 of the first set 60.1 of wall panels. The profile defines a plurality of Ls with each L comprising a first upstanding leg 209 having a distal end 211 and a second leg 210 which is transverse to the first leg 209, the second leg having a distal end 212. When travelling from the top edge 101 to the bottom edge 95 of the wall panel 64 along the profile as indicated by the arrows, the second leg 210 is directed to the outside of the building 60, 66A. The second leg 210 preferably, slightly slopes towards the outside to allow water to flow to the ground 105. The first transverse leg 209 of an L is longer than the second transverse leg 210 of an L with the distal end 211 of a first leg 209 of an L attached to the distal end 212 of another L. A radius 213 forming a crest 213.1 is formed between the distal ends 211, 212. A further radius 214 is formed between the proximal ends 215, 216 of the first and second legs 209, 210 of an L. FIG. 21 further shows that two types of Ls are employed, a first L 217 having a shorter first upstanding leg 209 than the first upstanding leg 209 of a second L 218 with the second transverse leg 210 of a first L 217 shorter than the second transverse leg 210 of a second L 218. The lengths Y, Z of the first and second legs 209, 210 are governed by the equations $\sqrt{X/X}=Y$ and $X-Y=Z$ with X being a suitable starting figure for example 121,32 mm for a first L 217 and 171,57 for a second L 218. The L-shaped profile imparts structural rigidity to the bottom sub-panel 77.1. The second leg 210 of an L 217 at the bottom of the profile has a depending leg 219 attached to its distal end 212. The depending leg 219 proceeds into a channel 220 to which the curved bottom depending flange 216 is attached at the bottom edge 95. A bracket 221 is provided to accommodate service lines 222 and a plug socket. 223. The top attachment formation 118 at the top edge 96 has a channel shape 224 with an upwardly extending curved flange 223. The channel 224 is attached to the top first upstanding leg 225 of an L 226 having a transverse leg 227 attached to the distal end 211 of the first upstanding leg 209 of the top L 218.

Figure 20:
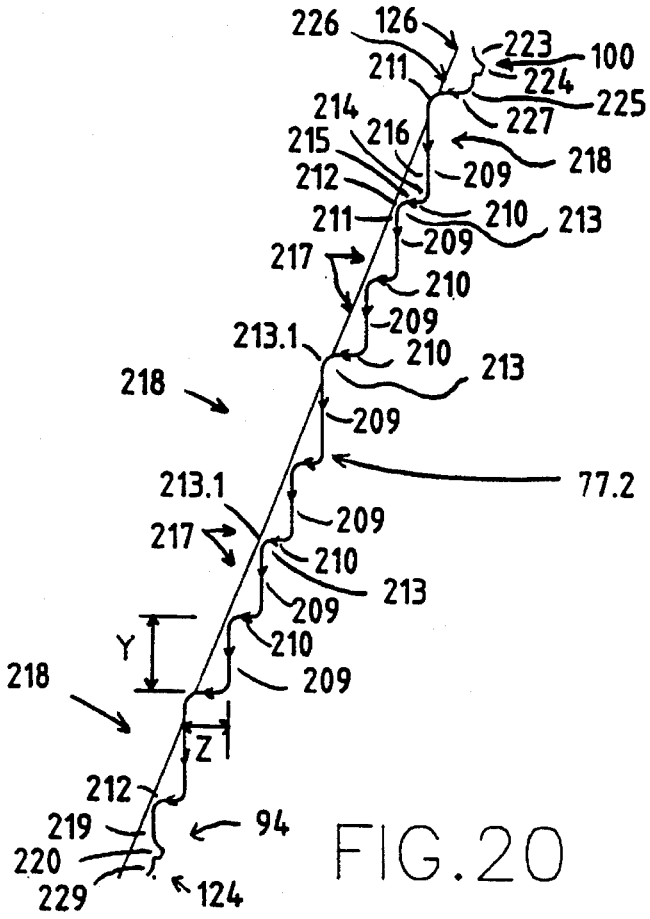
FIG. 20 is an elevation on section 20—20 shown in FIG. 1 through a middle sub-panel.

FIG. 20 shows a typical profile of a middle sub-panel 76.2, 77.2. FIG. 20 specifically shows the middle sub-panel 77.2 of the wall panel 64 of the first set 60.1 of wall panels. The Ls of the L-profile are basically the same as shown in FIG. 21 and like numerals refer to like pans. However, the arrangement of the types of Ls 217, 218 differ. The top attachment formation 126 has the profile as shown. The bottom attachment formation 124 includes the channel 220 and the curved, depending flange 229. A removable panel 72 also has an L-shaped profile akin to that shown in FIGS. 20, 21, but with the top edge 177 as shown in FIG. 38 and a bottom edge 243 (see FIG. 1) the same as that of a bottom sub-panel 76.1, 77.1. The arrangement of the Ls of a removable panel 72 is that of the bottom and middle sub-panels 76.1 (77.1), 76.2 (77.2) combined. Thus, the bottom half of a removable panel 72 has the L-shaped profile of a bottom sub-panel 76.1 (77.1) and the top half of a middle sub-panel 76.2 (77.2).

Figure 17:
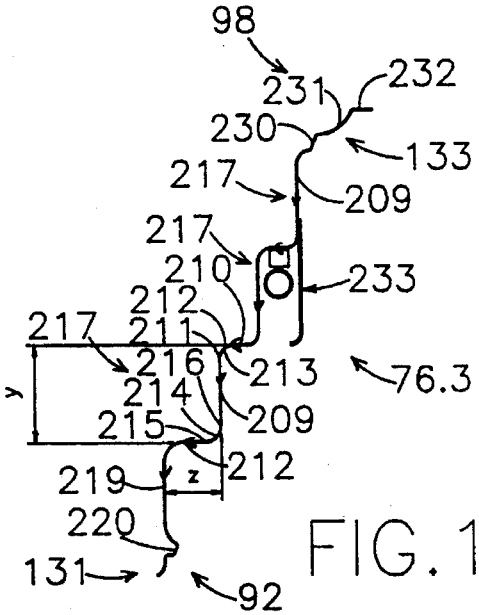
FIG. 17 is an elevation on section 17—17 shown in FIG. 1 through a typical top sub-panel.
Figure 18:
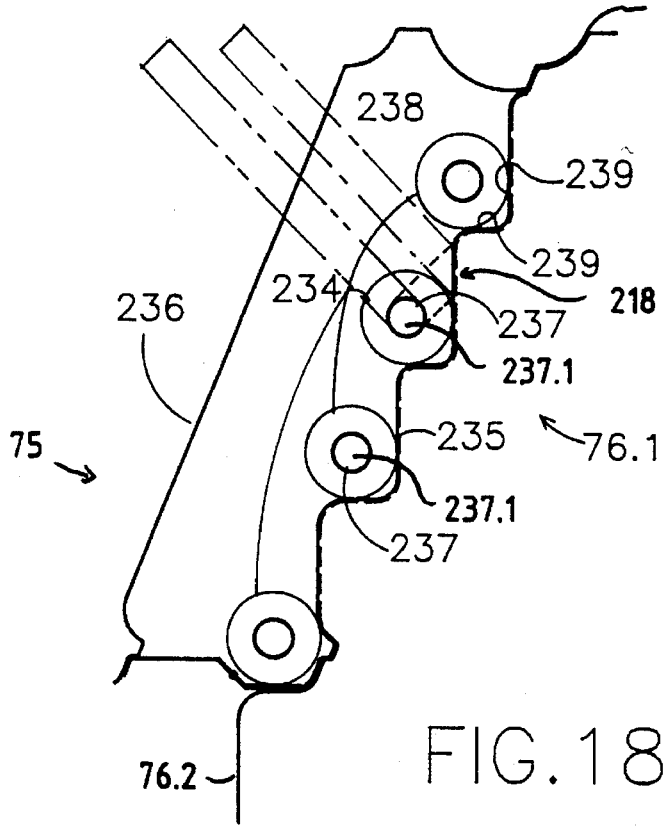
FIG. 18 is an elevation on section 18—18 shown in FIG. 1 through a top sub-panel.
Figure 19:
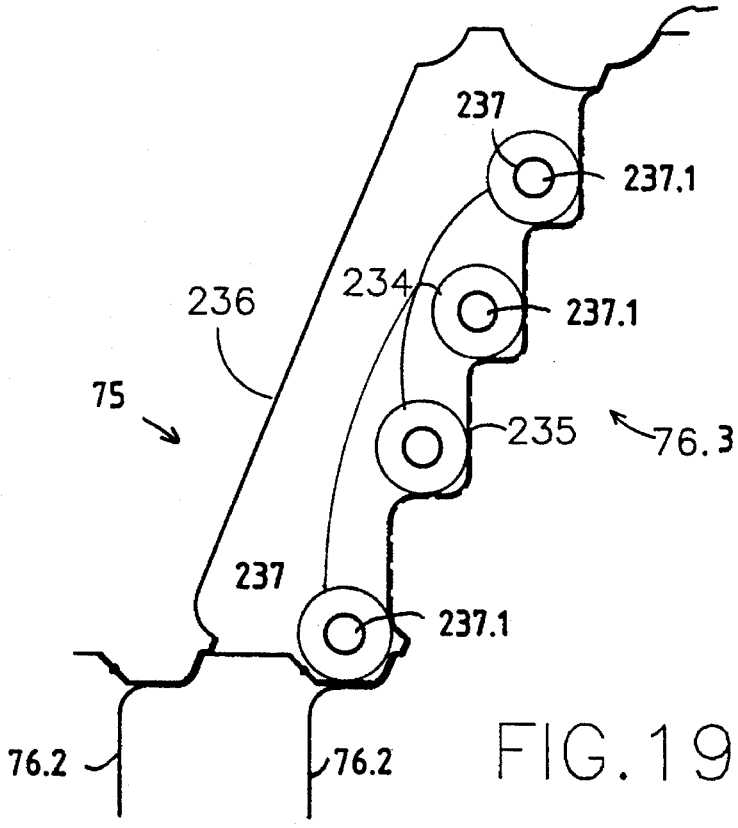
FIG. 19 is basically the same as FIG. 18, but with the added part of the middle sub-panel of the second set of wall panels.

Reference is now made to a typical sub-panel 76.3, 77.3 profile shown in FIGS. 17, 18, 19. The profile also defines Ls, but only of the first type 217. Note that like numerals refer to like pans in the FIGS. 20 and 21. The bottom attachment formation 131 is basically identical to the bottom attachment formation 124 of the middle panel shown in FIG. 20. The top attachment formation 133 has the shown profile. The first upstanding leg 209 curves into an inclined strip 230 which proceeds into a valley 231 which proceeds into a ceiling support strip 232. Light means 233 is provided.

An important advantage of the L-shaped profile of the sub-panels 76.1, 76.2, 76.3, 77.1, 77.2, 77.3 and thus of each wall panel 61 to 66, 66.2, 66.3 is that the L-shaped profile provides structural rigidity. A further important advantage of the L-shaped profile, in particular the orientation of the transverse second legs 210 of the Ls 217, 218 is that a suitable insulating screed 161.1 shown in FIG. 1 can be applied onto the outside of a wall panel 61 to 66, 66.2, 66.3.

An example of an insulating screed is a mixture of exfoliated vermiculite, portland cement and hydrated building time mixed with a dash of water. The applied screed 161.1 will be arrested on and by the transverse second legs 210 of the Ls 217, 218. Another important advantage of the L-shaped profile is that it renders the sub-panels 76.1, 76.2, 76.3, 77.1, 77.2, 77.3, particularly similar sub-panels, and also the removable panels 72 stackable which is, of course, beneficial for transportation thereof.

FIGS. 18 and 19 show tubes 237 and an insulation material 235 attached to a top sub-panel 76.3 A cover plate 236 is located over the tubes 234. The L-shaped profile are advantageous regarding the heating of water in the bores 237.1 of the tubes 237. Incoming sun rays 238 are reflected from the reflective outer surfaces 239 to the bores 237.1 of the tubes 237, spaced from the outer surfaces 239 by spacers 234, where the water is heated. The tubes 237 are interconnected with a central storage tank 240 below the base of the building 66A (FIGS. 2 to 5) and an underfloor piping network 135.1 shown in FIG. 8 to provide underfloor heating. The tubes 237 are further connected to another water storage tank 135.2 shown in FIG. 8.

Figure 22:
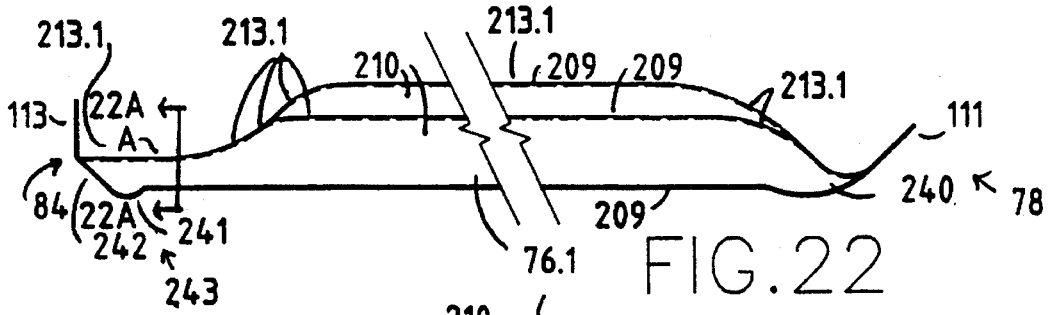
FIG. 22 is an elevation on section 22—22 shown in FIG. 1 through a bottom panel, section 22—22 in a plane towards the ground on the inside of the building, the angle between the ground and the plane being 22°30'.
Figure 22A:
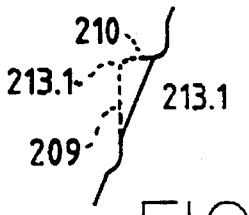
FIG. 22A is an elevation on section 22A—22A shown in FIG. 22.
Figure 23:
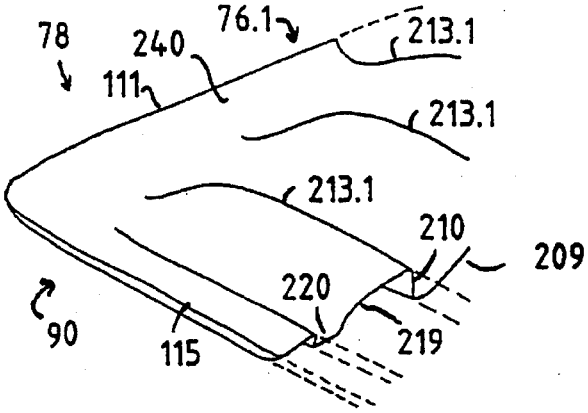
FIG. 23 is a view in the direction of arrow 23 in FIG. 1 of a corner of a bottom sub-panel.

FIG. 22 is a typical profile through a bottom, middle and top sub-panel 76.1, 76.2, 76.3 of the left set 76 of sub-panels. The profile of the bottom, middle and top sub-panels 77.1, 77.2, 77.3 of the right set 77 has a mirror image. The bottom sub-panel 76.1 shown has its inner flange 113 (at the inner edge 84) in a plane normal (90°) to a plane in which a second transverse leg 210 of an L 217, 218 is located and also normal to a plane in which the first upstanding leg 209 is located. The outer flange 111 at the outer edge 78 is bent at an obtuse angle, to the plane in which first upstanding leg 209 of an L 217, 218 is located. FIG. 22 shows that the crests 231.1 curve downwards towards level A and then meet the inner flange 113. In FIG. 22A the dotted outline shows the original position of a crest 213.1. A hollow 241 is formed between the proximal ends 215, 216 of a first upright leg 209 and the second transverse leg 210. The hollow 241 curves upwards towards the crest 213.1 at level A. Slope 242 forms part of the curve upwards towards the crest 213.1. FIG. 22 further shows that the crests 213.1 curve downwards towards the outer flange 111 with a valley 240 formed between two adjacent downwardly curving crests 213.1. Last mentioned feature is also illustrated in FIGS. 23 and 32.

Figure 25:
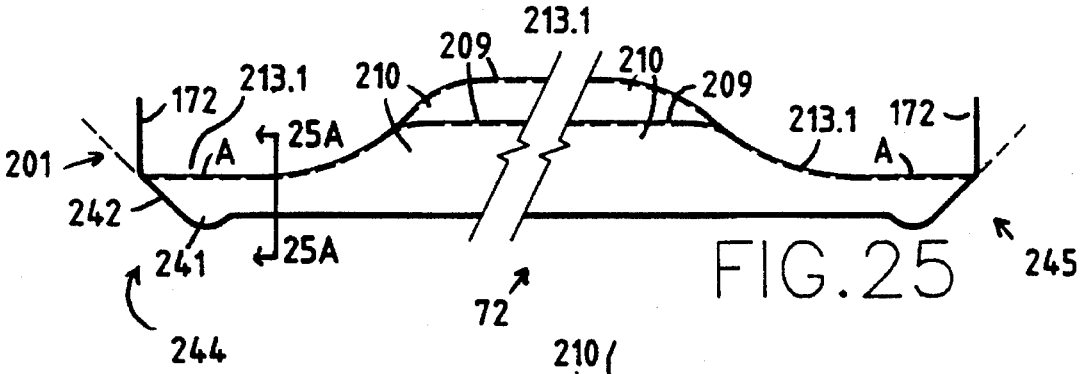
FIG. 25 is an elevation on section 25—25 shown in FIG. 1 through a removable panel, section 25—25 in a plane towards the ground on the inside of the building, the angle between the ground and the plane being 22°30.
Figure 25A:
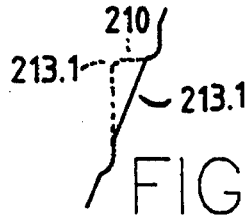
FIG. 25A is an elevation on section 25A—25A shown in FIG. 25.

FIG. 25 shows a profile of a removable panel 72 having two upstanding flanges 172 each located in a plane normal (90°) to a plane in which the transverse second leg 210 of an L 217, 218 is located and also normal to a plane in which the first upstanding leg 210 of an L 217, 218 is located. The upstanding flanges 172 are parallel to each other. The configuration shown at 243 in FIG. 22 is identical to the configuration 244 shown in FIG. 25 with the configuration at 245 in FIG. 25, a mirror image of that at 244. The profile at section 25A—25 A in FIG. 25 is thus the same as the profile at section 22A— 22A in FIG. 22.

Figure 24:
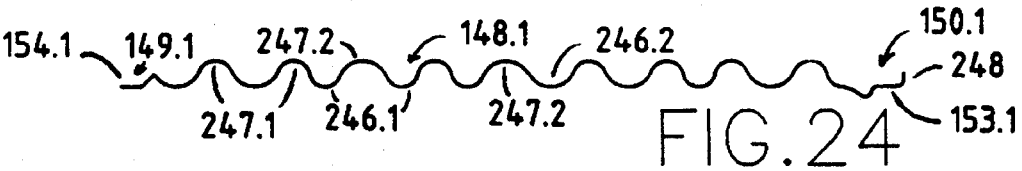
FIG. 24 is an elevation on section 24—24 shown in FIG. 1 through a support member.

FIG. 24 shows a profile of the support member 148.1, the profile defining a plurality of valleys 246.1, 246.2 and crests 247.1, 247.2. The valleys 246.1 and crests 247.1 have the same radii which is smaller than the radii of the crests 247.2 and valleys 246.2 for which the radii are the same. The sloping edge 149.1 has the support flange 154.1. The upright side 150.1 edge has the rebate 153.1 and a bent over flange 248 normal to the rebate 153.1. The flange 248 in use abuts the timber support 202.1 as shown in FIG. 37. It will be appreciated that the profile of the support member 148.2 has the mirror image of the profile shown in FIG. 24.

Figure 40:
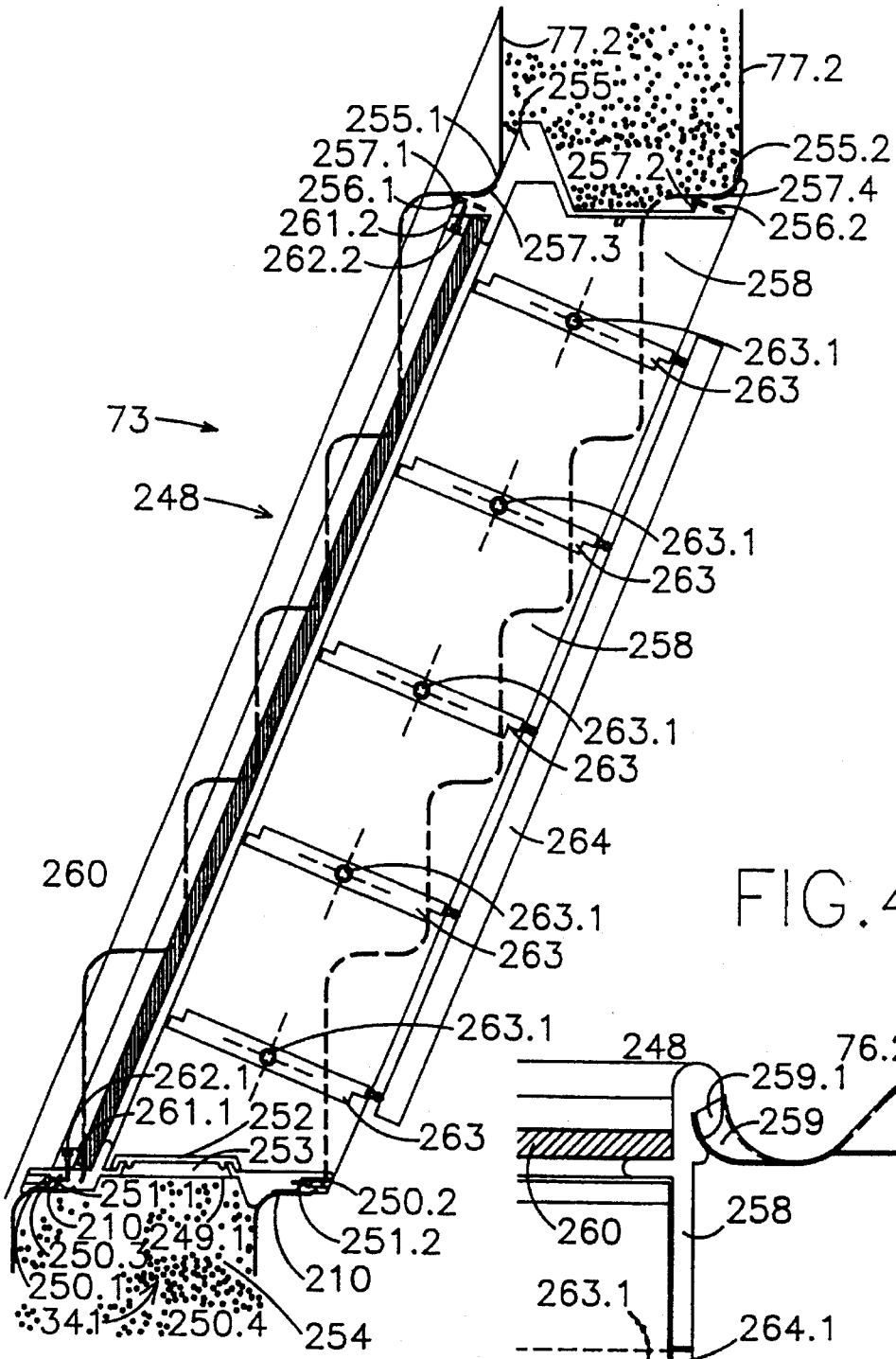
FIG. 40 is an enlarged view of the window shown in FIG. 16.
Figure 41:
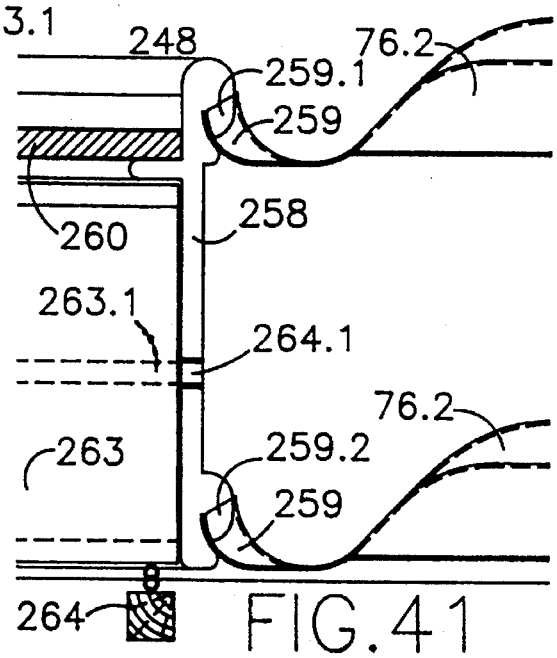
FIG. 41 is an elevation on section 41—41 shown in FIG. 1 through the window, section 41—41 in a plane towards the ground on the inside of the building, the angle between the ground and the plane being 22°30'.

FIGS. 16, 40 and 41 show typical views of a window 73. The window 73 includes a frame 248 attached to and between two middle sub-panels 76.2. The frame 248 comprises a base plate 249.1 attached to an upstanding flange 251.1, 251.2 by means of fasteners 250.1, 250.2 and to the transverse second legs 210 by Velcro 250.3, 250.4. A removable access plate 252 spans an opening 253 in the base plate 249.1. The access plate 252 can be removed when desired and loose insulating filler material 254 can then be introduced between the two middle sub-panels 76.2. The frame 248 further comprises a top plate 255 attached between and to the two middle sub-panels 767.2 by means of fasteners 256.1, 256.2 to the two depending flanges 257.1, 257.2 as shown. Velcro 257.3, 257.4 is used to attach the top plate 255 to the curved portions 255.1, 255.2. The frame 248 is completed by two upwardly extending side plates, one side plate 258 shown in FIGS. 40 and 41. Both side plates 258 are attached to outwardly extending flanges 259 of the middle sub-panels 76.2, the flanges 259 fit into slits 259.1, 259.2 in the side plate 258. A glass panel 260 is kept in position by a bottom bead 261.1 and a top bead 261.2 respectively fastened to the base plate 249.1 and the top plate 255 by fasteners 262.1, 262.2. Louvre blinds 263 attach to a spindle 263.1 and which are operable by a timber lever 264 are provided. FIG. 41 shows that the one end 264.1 of the spindle 263.1 is rotatably attached to the side plate 258.

Figure 42:
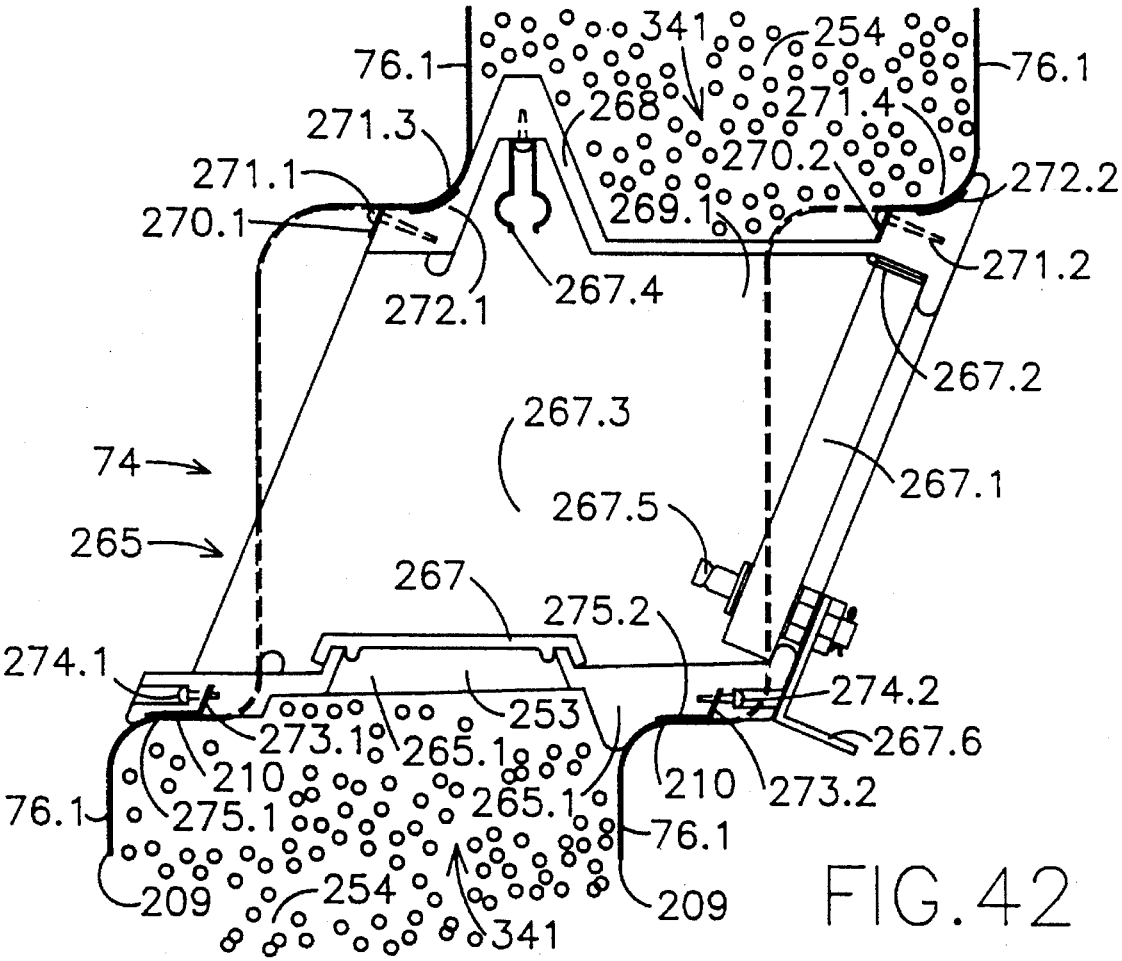
FIG. 42 is an enlarged view of the air inlet shown in FIG. 16.
Figure 43:
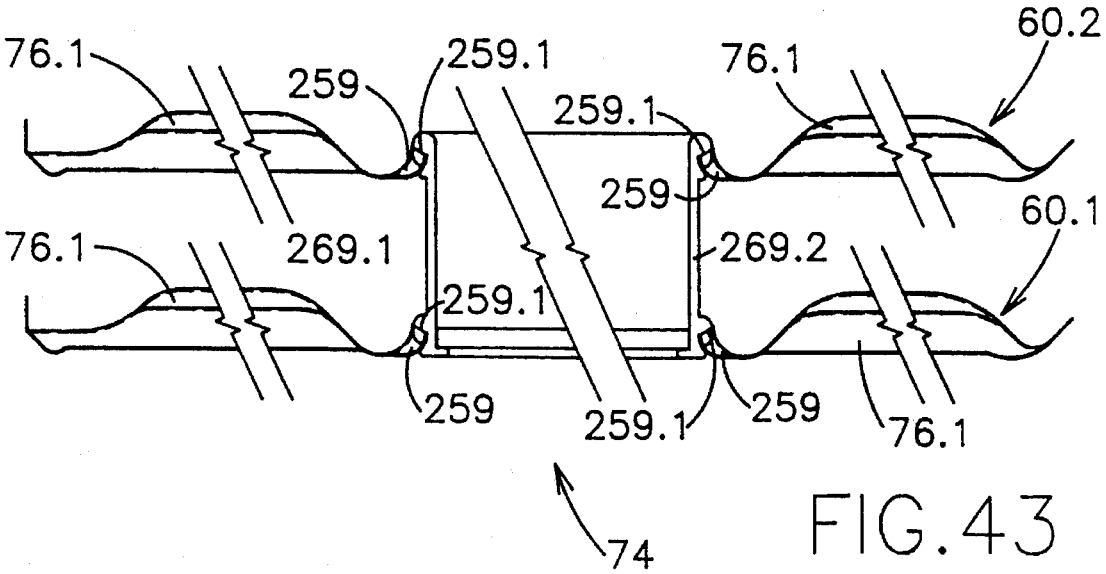
FIG. 43 is an elevation on section 43—43 shown in FIG. 1 through an air inlet and bottom sub-panels, section 43—43 in a plane towards the ground on the inside of the building, the angle between the ground and the plane being 22°30'.

Typical views of an air inlet 74 are shown in FIGS. 16, 42 and 43. The air inlet 74 comprises a frame 265 which includes a base plate 265.1, a removable access plate 267, a top plate 268, and two side plates 269.1, 269.2. The frame 265 is attached to and between two bottom sub-panels 76.1. The top plate 268 is attached to the two depending flanges 270.1, 270.2 by means of the fasteners 271.1, 271.2 and to the arcuate portions 271.3, 271.4 by Velcro 272.1, 272.2. The base plates 265.1 are attached to the upstanding flanges 273.1, 273.2 by means of the fasteners 274.1, 274.2 and to the transverse second legs 210 by Velcro 275.1, 275.2. The two side plates 269.1, 269.2 are attached to outwardly extending flanges 259 of the bottom sub-panels 76.1. The flanges 259 fit into slits 259.1, 259.2 in the side plates 269.1, 269.2. The air inlet 74 is provided with an air inlet panel 267.1 hingedly attached to the top plate 268 at 267.2. When desired, the air inlet panel 267.1 can be hinged upwards as indicated by the arrow 267.3 and attached to the clip 267.4 using the grooved pin 267.5 A movable catch 267.6 can keep the air inlet panel 267.1 in the closed position as shown in FIG. 42.

Reference is now made to the roof 67. The roof 67, as mentioned previously includes eight roof panels 67.1 to 67.8 each having a trapezoidal shape as shown in FIG. 6. The roof panels 67.1 to 67.8 extend between the top edges 106 of the wall panels 61 to 64 of the first set 60.1 and the dome 68 in the centre of roof 67.

Figure 6A:
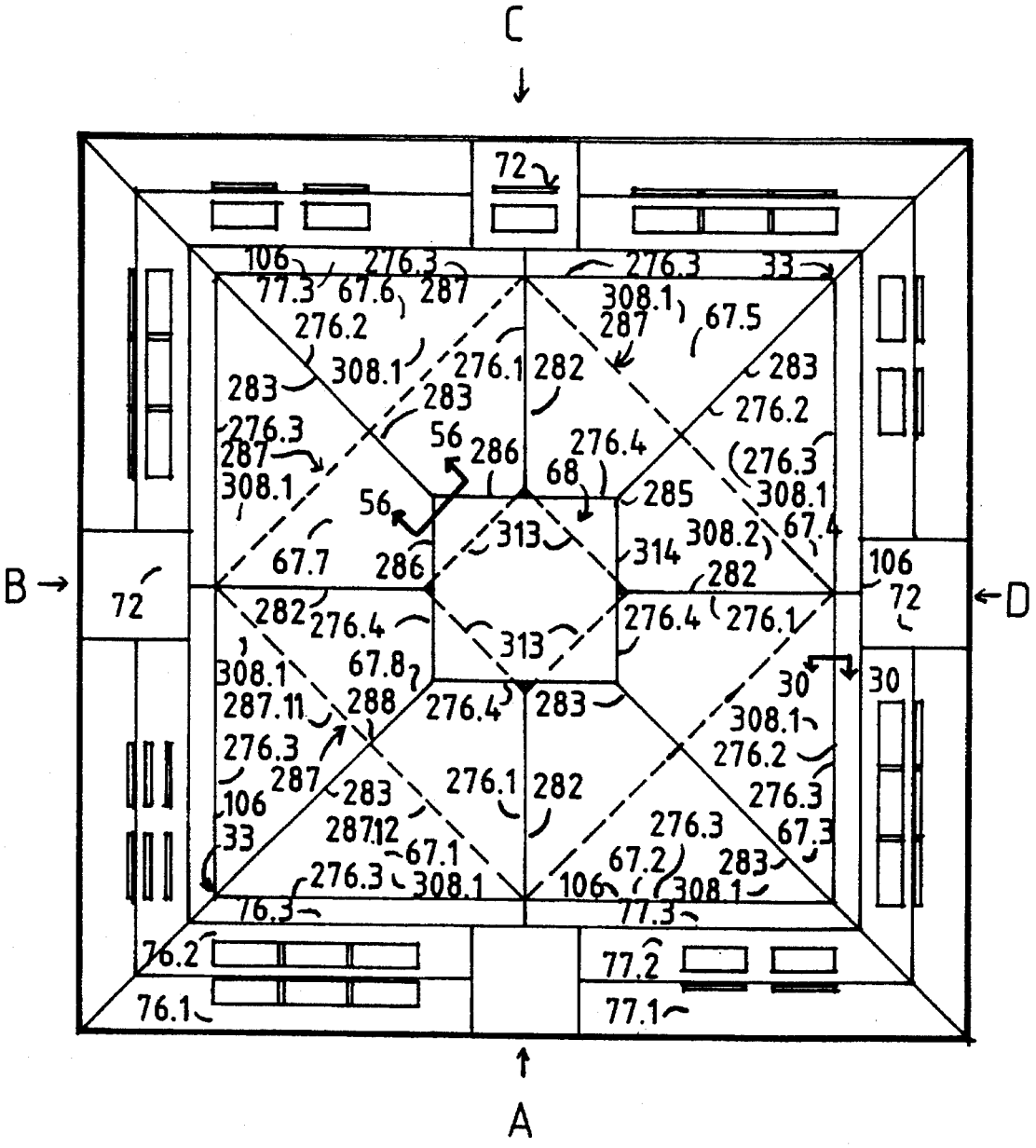
FIG. 6A is the same view of the basic unit as shown in FIG. 6 with further reference numerals and sections.
Figure 30:
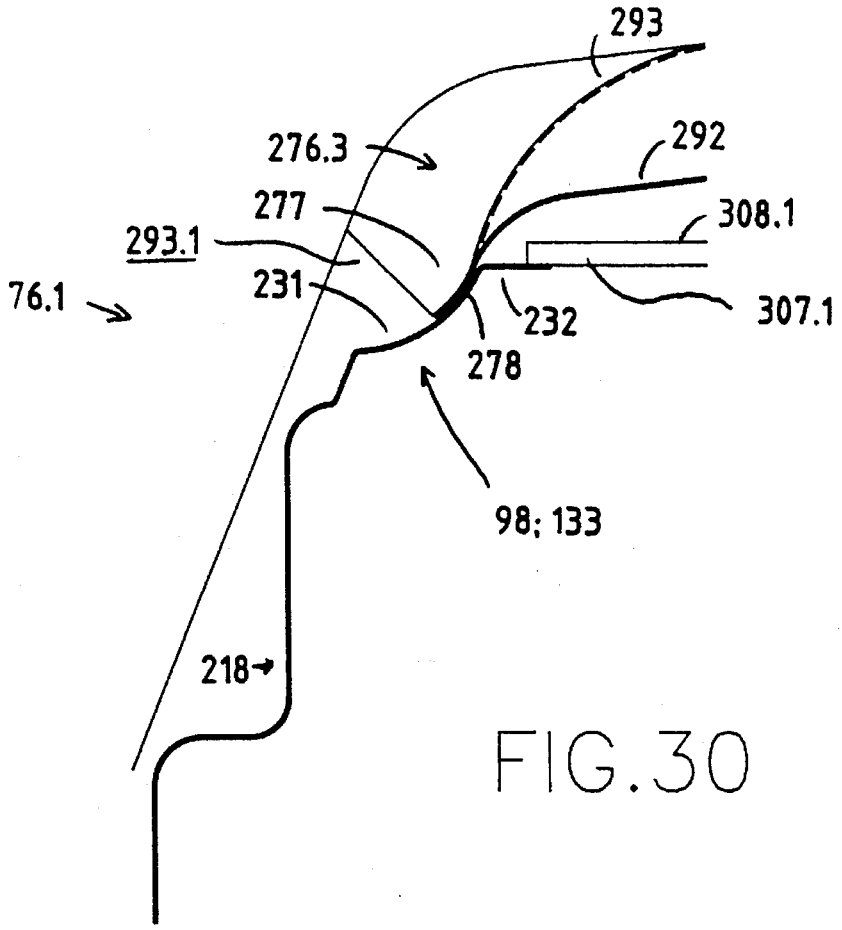
FIG. 30 is an elevation on section 30—30 shown in FIG. 1 typically showing an attachment of a roof panel to a top sub-panel when only one set of wall panels is employed.

FIG. 6A shows that each roof panel 67.1 to 67.8 has an inner edge 276.1, an outer edge 276.2 opposite the inner edge 276.1, a wall facing edge 276.3 and a dome facing edge 276.4 parallel to the wall facing edge 276.3 Each wall facing edge 276.3 has a depending flange 277 slightly C-curved as shown in FIGS. 30 and 31. FIG. 31 shows that the depending flange 277 is typically attached to the top attachment formation 133 of the top sub-panel 77.3 of the first set (60.1) wall panel 61 by means of the S-shaped gutter edge 170 and strategically located Velcro 278. FIG. 30 shows the typical attachment when the gutter 166 being omitted when only a first set 60.1 of wall panels is used as in the case of the basic unit 66A.

The dome facing edges 276.4 of the roof panels 67.1 to 67.8 are attached to the dome 68 as will be explained in more detail below.

The roof 67 further includes two sets of ceiling support members. The ceiling support members of the first set comprises four pairs of short ceiling support members 282 and four pairs of long ceiling support members 283, the location thereof diagrammatically shown in FIG. 6A. Each pair of long ceiling support members 283 extend between a typical top corner 33 of the building 60, 66A and a typical corner 285 of the dome 68. Each pair of the short ceiling support members 282 extend normally between a typical side 286 of the dome 68 and the middle of the top edge 106 of the building 60, 66A. The second set ceiling support members comprises four pairs of transverse ceiling support members 287 each pair extending between the middle of two adjacent top edges 106 of the building 60, 66A. Each pair of transverse ceiling support members 287 comprises two sub-pairs of ceiling support members 287.11, 287.12, the division made by a pair of long ceiling support members 276.2 typically at 288. Thus, seen in plan as shown in FIG. 6, the pairs of transverse ceiling support members 287 are arranged to form a square.

Figure 44:
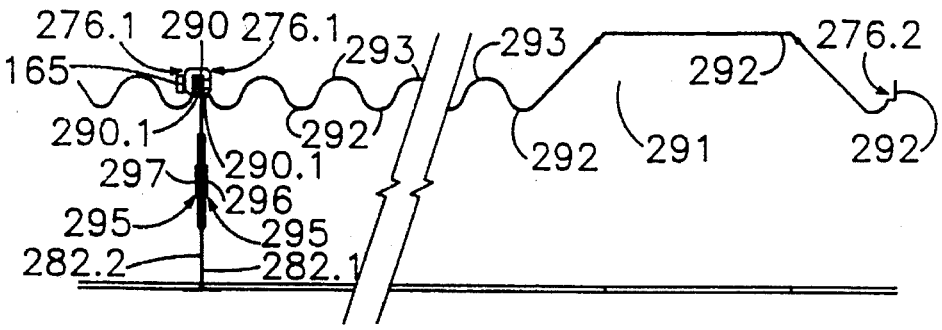
FIG. 44 is an elevation on a vertical section 44—44 shown in FIGS. 1 and 6 through two roof panels, a pair of short ceiling support members and two ceiling panels.
Figure 45:
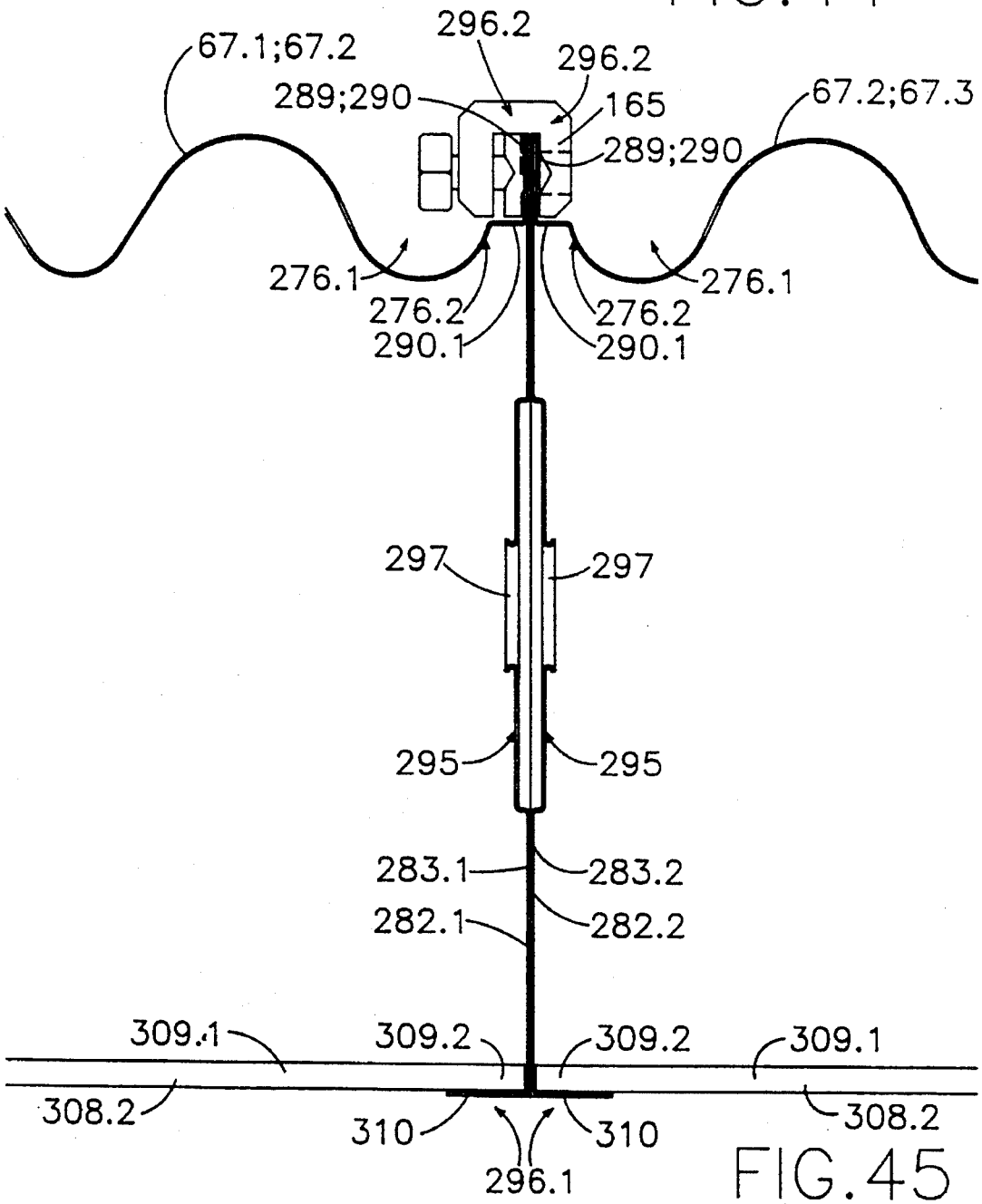
FIG. 45 is a typical elevation on the two vertical sections 45—45 shown in FIG. 6 through two attached roof panels, a pair of ceiling support members and two ceiling panels.

Reverting to FIGS. 6, 44 and 45 a typical profile of a roof panel 67.1 to 67.8 is shown. An upstanding flange 289 is provided at the outer edge 276.2 and another upstanding flange 290 at the inner edge 276.1. An elongate depression 290.1 extending along each of the inner and outer edges 276.1, 276.2 and beneath the upstanding flanges 289, 290 is provided. A chimney hole 291 closed by a cover plate 292 is located next to the outer edge 276.2 with a corrugated profile between the chimney hole 291 and the inner edge 276.1.

The corrugated profile defines a plurality of valleys 292 and crests 293 with the radius of a crest 293 larger than the radius of a valley 293. The advantage of this difference in radii resides therein that less insulating screed 294 (shown in FIG. 1) is needed and rendering the screed less prone to thermal cracking. The crests 293 of each roof panel 67.1 to 67.8 curves down to the C-shaped depending flanges 277 as typically shown in FIGS. 30 and 31. The valleys 292 are also shown in FIGS. 30 and 31. However, the two crests 293 next to each inner edge 276.1 of each roof panel 67.1 to 67.8 do not curve down in the aforegoing manner as to leave an opening 293.1 to allow access to services (not shown) beneath the roof panels 67.1 to 67.8.

Figure 46:
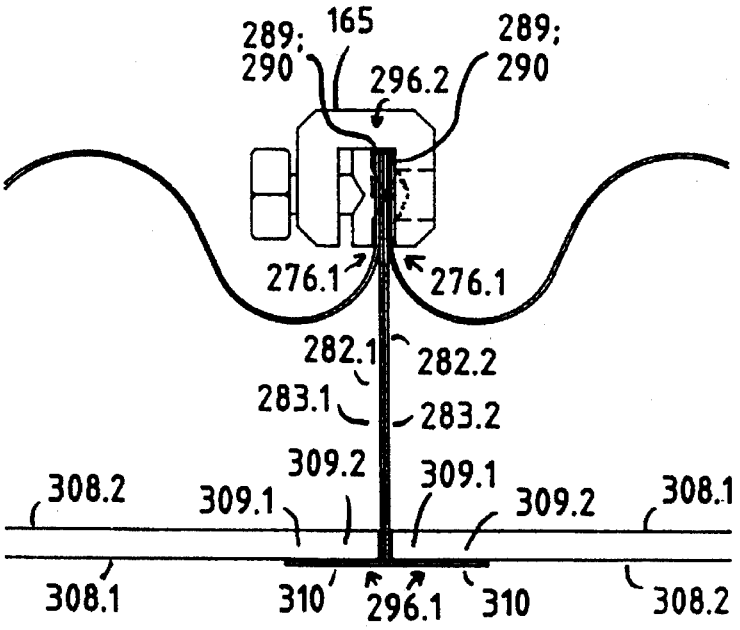
FIG. 46 is a typical elevation on the two vertical sections 46—46 shown in FIG. 6 through two attached roof panels, a pair of ceiling support members and two ceiling panels.

FIGS. 44, 45 and 46 show that a pair of short and long ceiling support members 282, 283 comprises two mirror image ceiling support members, thus either two short ceiling support members 282.1, 282.2 or two long ceiling support members 283.1, 283.2, are located next to and against each other. Each ceiling support member 282.1, 282.2, 283.1. 283.2 has a rectangular cross-section and comprises strengthening means in the form of a plurality of pressed out areas 295 between its two long top and bottom sides 296.1, 296.2. Each pressed out area 295 has holes 297 through it to allow service cables (not shown) for example electrical cables, to extend therethrough. A short and long ceiling support member 282, 283 generally have a trapezoidal shape when viewed from the side. FIG. 45 typically shows the attachment of the two upstanding flanges, namely the upstanding flanges 289, 290 of the adjacent roof panels 67.2, 67.3 to the long sides 296.2 of the two long ceiling support members 283.1, 283.2. Fasteners 165 can be used. FIG. 45 also typically shows the attachment of the two upstanding flanges 289, 290 of the adjacent roof panels 67.1, 67.2 to the top long sides 296.2 of the two short ceiling support members 282.1, 282. Fasteners 165 can also be used here. The arrangement in FIG. 46 shows a section through two short ceiling support members 282.1, 282.2. This arrangement is basically the same for the section 46—46 through two long ceiling support members 283.1, 283.2. An alternative to the typical arrangement shown in FIG. 46 where two outer edges 276.2 of roof panels 67.1, 67.8 are adjacent each other is to employ only one of the long ceiling support members 283.1, 283.2 and to use, in a back-to-back manner, one of the transverse ceiling support members 287.2, 287.2. In using this arrangement and referring to FIG. 55 an end portion 283.3 of the relevant long ceiling support member 283.1, 283.2, an inclined section 290.1 and the attachment flange 290.2 attached thereto will be substituted with a section extending between the positions 283.4, 283.5 and having the shape of the end portion 283.3, inclined section 290.1 and flange 290.2.

Figure 48:
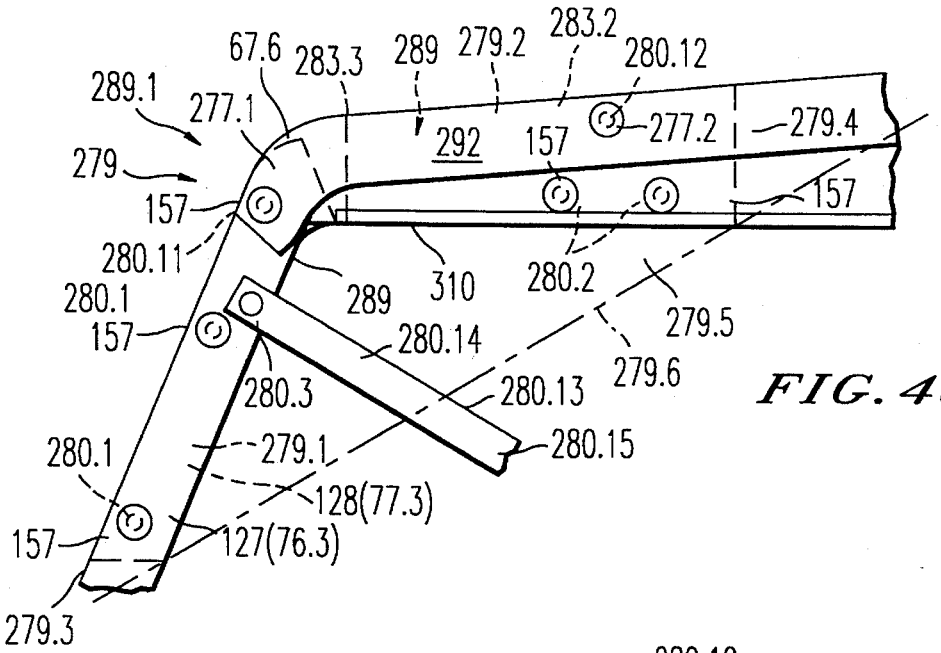
FIG. 48 is an elevation on a vertical section 48—48 shown in FIG. 6 through an attachment arrangement typically at a top corner.

FIG. 48 typically shows a typical attachment arrangement at top corner 33. Typically, a bent L-shaped attachment member 279 having a first leg 279.1 and a second leg 279.2 attaches the pair of long ceiling support members 283 to the two adjacent top sub-panels 76.3, 77.3. More particularly, the first leg 279.1 which extends down to the dotted line 279.3 fits between the outer flanges 127, 128 of the top sub-panels 76.3, 77.3 and attached thereto by two fasteners 157, the protrusion 157.3 thereof (shown in FIG. 32A) through holes 280.1 in the outer flanges 127, 128 and first leg 279.1. Two adjacent roof panels 67.6, 67.7 are also attached at 277.1 and 277.2 to the attachment member 279 by fasteners 157 through holes 280.11 and 280.12. The second leg 279.2 which extend up to dotted line 279.4 fits between two adjacent long ceiling support members 283.1, 283.2 ending at 283.3 (only 283.2 visible on section 48—48). Last-mentioned arrangement fits between the two upstanding flanges 289 of the two adjacent roof panels 67.6, 67.7 with the flanges 289 ending at 289.1. Fasteners 157 through the holes 280.2 extending through the second leg 297.2 and ceiling support members 283.1, 283.2 are used. An end 280.14 of a wind strut 280.13 for use, for example durnig wind storms, is attachable via a hole 280.3 through only the first leg 279.1 of the attachment member and an end 280.15 attachable at the ground 105. The L-shaped attachment member 279 may form part of two inclined side edges of a trinagular plate 279.5 having a long side edge 279.6. The triangular plate 279.5 may be advantageous in earthquake stricken areas.

Figure 33:
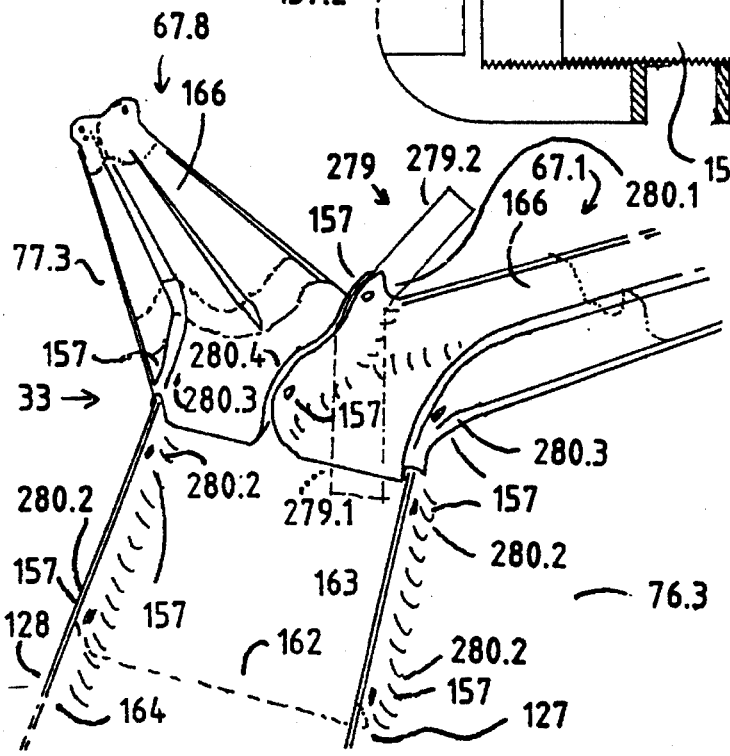
FIG. 33 is a view in the direction of arrow 33 of a corner of the building shown in FIG. 1.

FIG. 33 typically shows the attachment of the chute 162 to the two adjacent gutters 166 and between the two outer flanges 127, 128 of the two adjacent top sub-panels 76.3, 77.3 of the second set 60.2 of wall panels 65, 66, 66.2 66.3. The webs 163, 164 are respectively attached to the outer flanges 127, 128 using fasteners 157 through the holes 280.2 and/or fasteners 165, 166.1. The gutters 166 are attached to each other by a fastener 157 through holes 280.1, 280.4 or fasteners 165, 166.1. The gutters 166 are further attached to the first leg 279.1 of the attachment member 279 using a fastener 157 through the hole 280.11.

Figure 49:
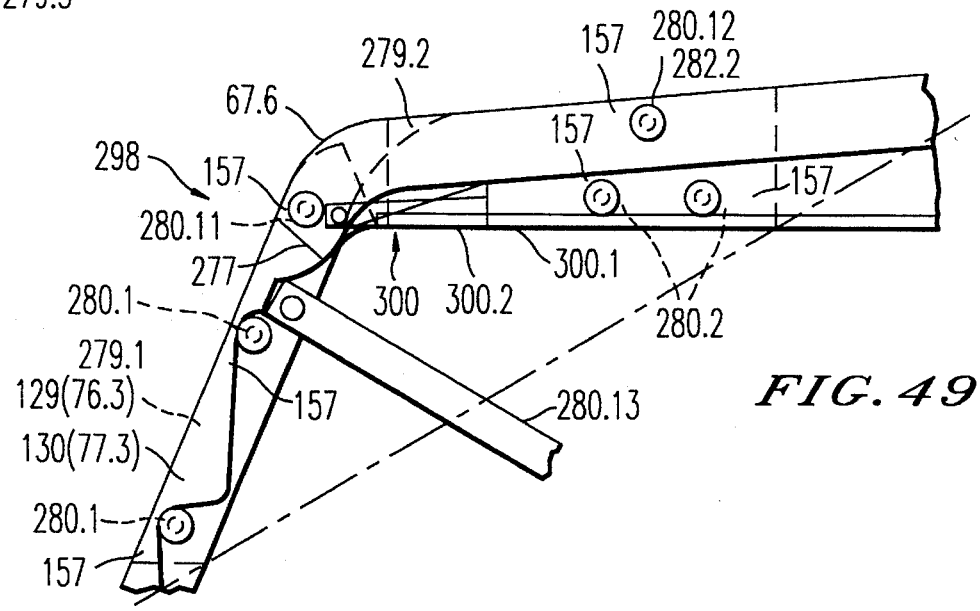
FIG. 49 is an elevation on a vertical section 49—49 shown in FIG. 6 through an attachment arrangement typically at the top in the middle of a wall panel.
Figure 50:
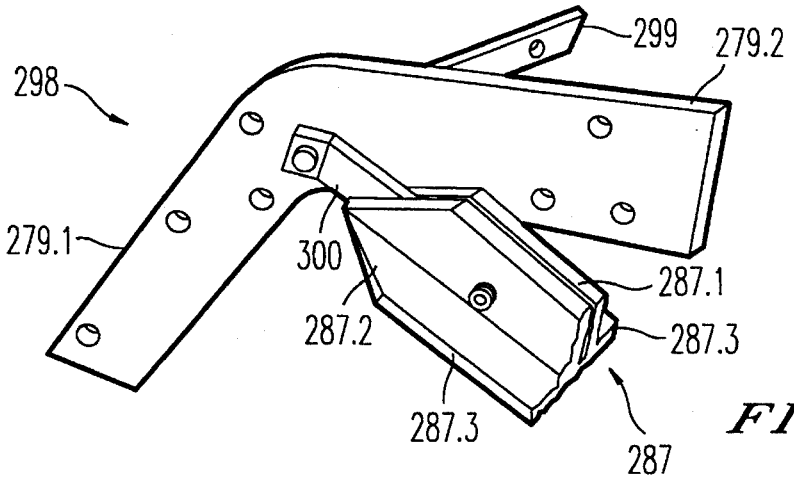
FIG. 50 is a view of an attachment member used in the attachment arrangement shown in FIG. 49.

FIG. 49 typically shows the attachment arrangement of a pair of short ceiling support members 282 to a top edge 106 of a wall panel and also of the roof panels 67.1 to 67.8 to the wall panel. The roof panel 67.6 shown is attached to the top edge 106 of the wall panel 63. An attachment member 298 shown in FIG. 50 is employed in the manner shown. The attachment member 298 is made up of the L-shaped attachment member 279 shown in FIG. 48 but with a more acute angle between its first and second legs 279.1, 279.2 provided with two transverse arms 299, 300. The first leg 279.1 of the attachment member 298 fits between two adjacent inner flanges 129, 130 of the two top sub-panels 76.3, 77.3 and attached thereto by typically using fasteners 157 extending through the holes 280.1. The second leg 279.2 fits between two adjacent short ceiling support members 282.1, 282.2 (only 282.2 visible on section 49—49). Last-mentioned arrangement fits between the two upstanding flanges 290 of the two adjacent roof panels 67.5, 67.6. The protrusions 157.5 of the fasteners 157 through the holes 280.2 extend through the second leg 297.2 and ceiling support members 282.1, 282.2. One pair of transverse ceiling support members 287 are attached to the transverse arm 299 and another pair attached to the transverse arm 300. The roof panel attachments described with reference to FIG. 48 equally applies here.

Two sets of ceiling panels are used beneath the roof panels 67.1 to 67.8. A first set comprises eight triangular shaped ceiling panels 308.1. A second set comprises eight four sided polygonal ceiling panels 308.2 FIGS. 45 and 46 typically show how the ceiling panels 308.1, 308.2 to 308.8 are supported at their outer edges 309.1, inner edges 309.2 dome facing edges 309.4 and wall facing edges 307.1. The outer edges 309.1 rest on transverse flanges 310 at the bottom long sides 296.1 of the long ceiling support members 283.1, 283.2. The inner edges 309.2 rest on transverse flanges 310 at the bottom long sides 296.1 of the short ceiling support members 282.1, 282.3. At their wall facing edges 307.1 typically shown in FIGS. 30 and 31 the ceiling panels 308.1 are supported on the ceiling support strips 232. At their dome facing edges 309.4 typically shown in FIG. 52 the ceiling support panels 308.2 are supported on L-shaped flanges 309.3 of the dome side panels 311 by fasteners 157.

Figure 47:
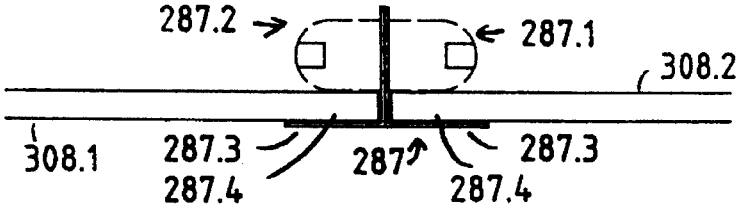
FIG. 47 is an elevation on a vertical section 47—47 shown in FIG. 6 through a pair of transverse ceiling support members.
Figure 47A:
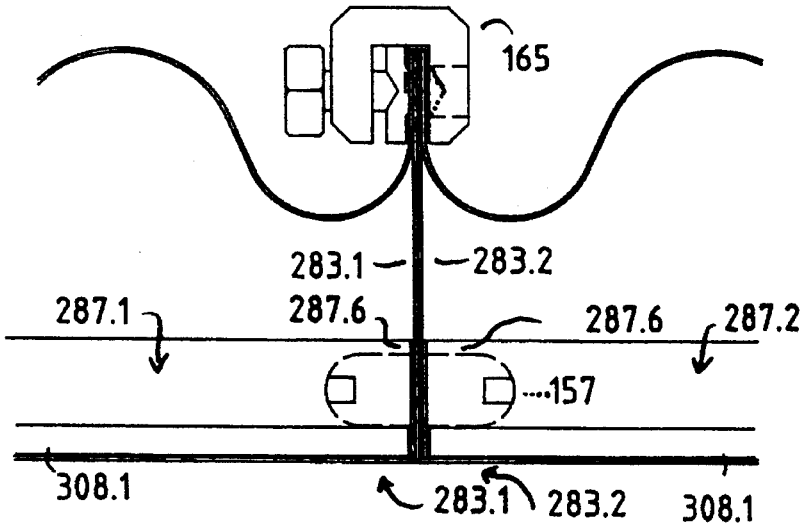
FIG. 47A is an elevation on section 47A—47A shown in FIG. 6 through a pair of long ceiling support members.

FIG. 47 shows that each transverse ceiling support member 287.1, 287.2 is L-shaped and arranged back-to-back. The transverse ceiling panel edges 287.4 are supported on the transverse flanges 287.3 of the transverse ceiling support members 287.1, 287.2. FIG. 47A shows that each transverse ceiling support member 287.1, 287.2 has an upstanding flange 287.6 which is attached to a long ceiling support member 283.1, 283.2.

Figure 51:
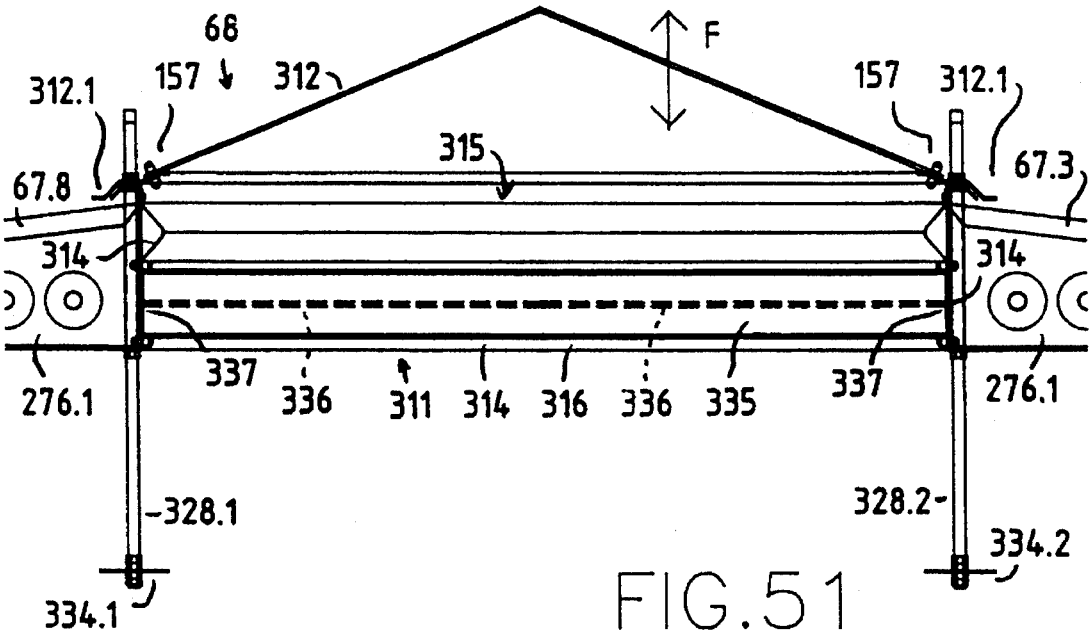
FIG. 51 is an elevation on a vertical section 51—51 shown in FIG. 6 through a dome in the roof.

Referring to FIG. 51 it is shown that the dome 68 includes a dome well 311 and a dome roof 312 attached to a dome roof frame 312.1 by fasteners 157. FIG. 6 shows that four support members 313 are attached to the dome well 311.

Figure 52:
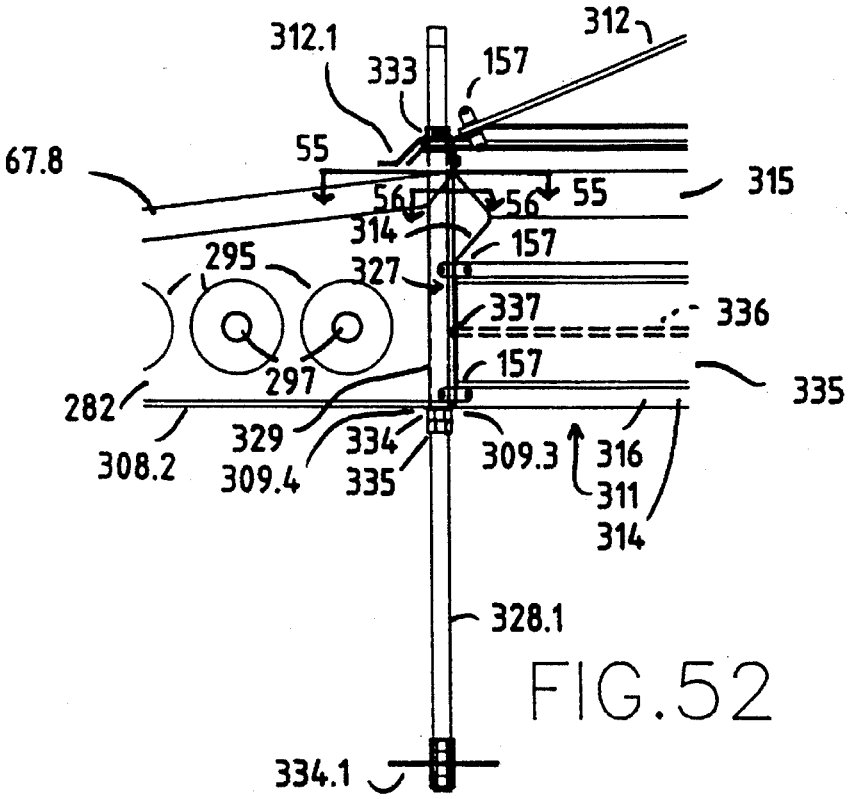
FIG. 52 is a an enlarged view of a left part of the dome shown in FIG. 51.
Figure 53:
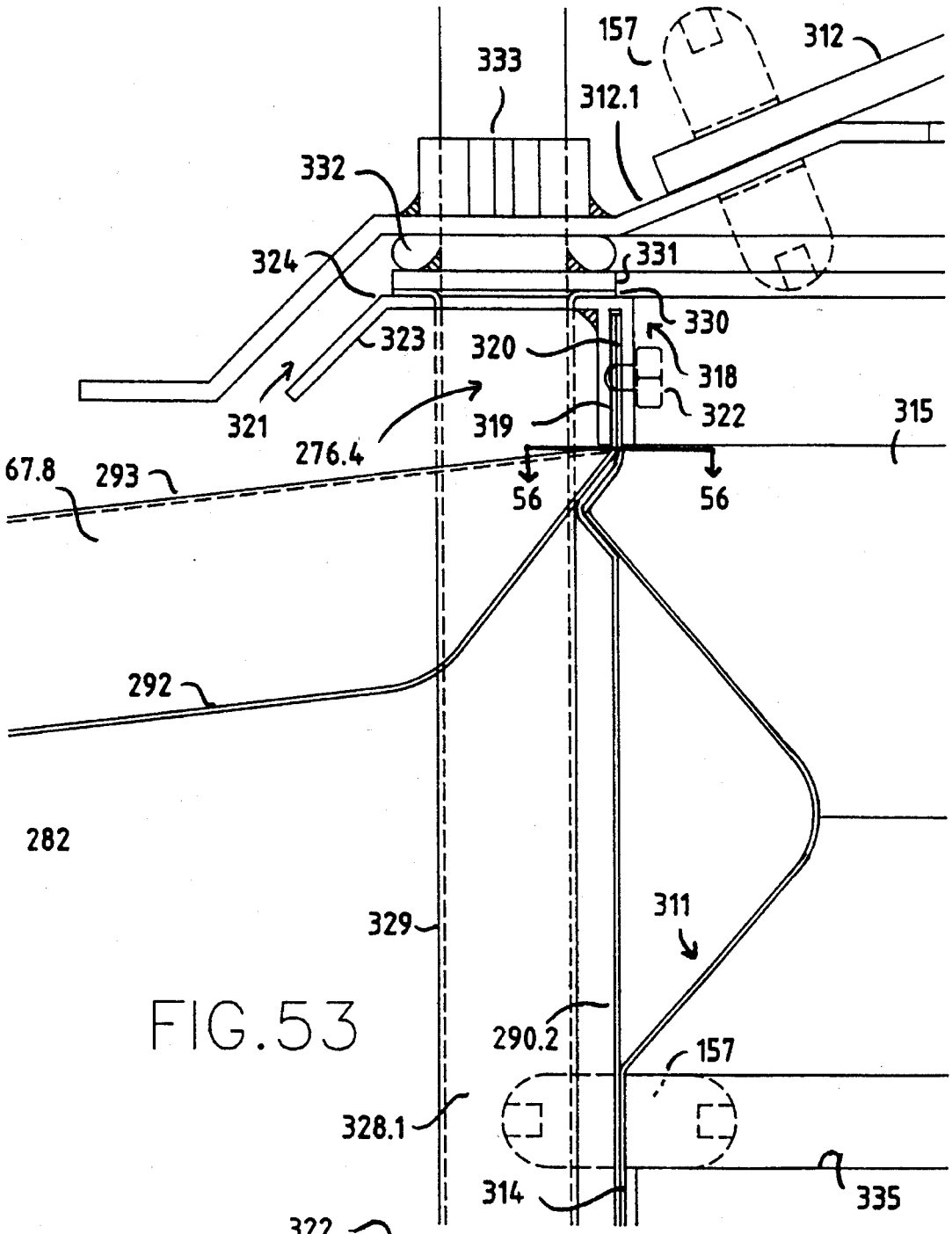
FIG. 53 is a further enlarged view of the left part of the dome shown in FIG. 52.

The dome frame 311 comprises four side panels 314 attached generally to form a square as shown in FIG. 6A. Each side panel 314 has a top region 315 presenting a V-shaped profile as shown in FIGS. 51, 52 and 53 and a bottom region 316 in the form of a strip having a flange 309.3. In FIG. 53 the roof panel 67.8, at its dome facing edge 276.4, is attached to the top edge 318 of the dome side panel 314. In this regard an upstanding flange 319 of the roof panel 67.8 and the top edge 318 fit into a slit 320 of a dome well frame 321 and attached to the dome well frame 321 by a bolt 322. Thus, the dome well frame 321 comprises four identical dome well frame members 323 each having the modified L profile shown in FIG. 53. Each dome frame member 323 has a horizontal support strip 324.

Figure 54:
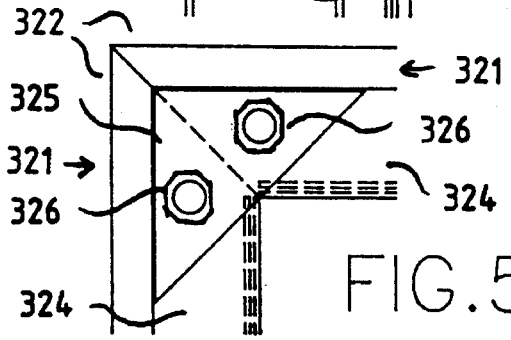
FIG. 54 is a plan view of a corner formed by two dome well frame members on top of one side of the dome shown in FIG. 53.

Two adjacent support dome well flames 321 at their corners as shown in FIG. 54 are attached to each other by a triangular plate 325 and two bolts 326.

Figure 55:
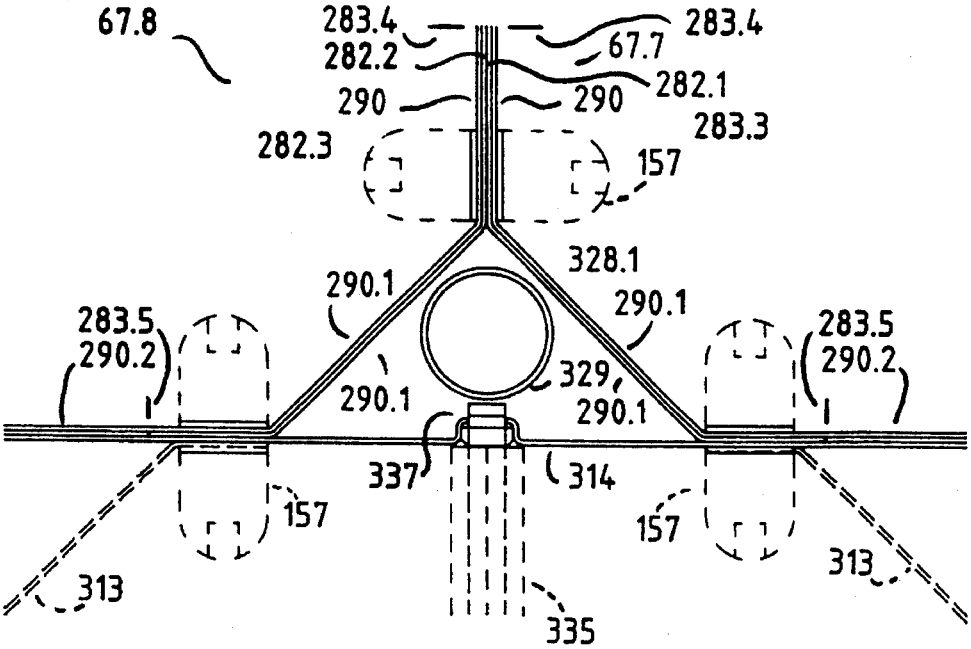
FIG. 55 is an elevation on a horizontal section 55—55 shown in FIGS. 6 and 52 through a left part of the dome.

FIG. 55 typically shows two adjacent upstanding flanges 290 of the adjacent roof panels 67.7, 67.8 and the attachment of the short ceiling support members 282 by a fastener 157 to each other and further the attachment of the two short ceiling support members 282.1. 282 to the dome side panel 314. Each short ceiling support member 282.1, 282.2 proceeds into an inclined section 290.1 which proceeds into an attachment flange 290.2 which is attached to the bottom region 316 of the dome side panel 314 by means of a fastener 157. The attachment flange 290.2 extends upwards along the dome side panel 314 and is attached to the bottom region 316 of the dome side panel 314 just beneath the top region 315 at 327 by a fastener 157 as shown in FIG. 53.

FIG. 55 further shows the attachment of two support members 313 to the dome side panel 314 by means of the fasteners 157.

Figure 56:
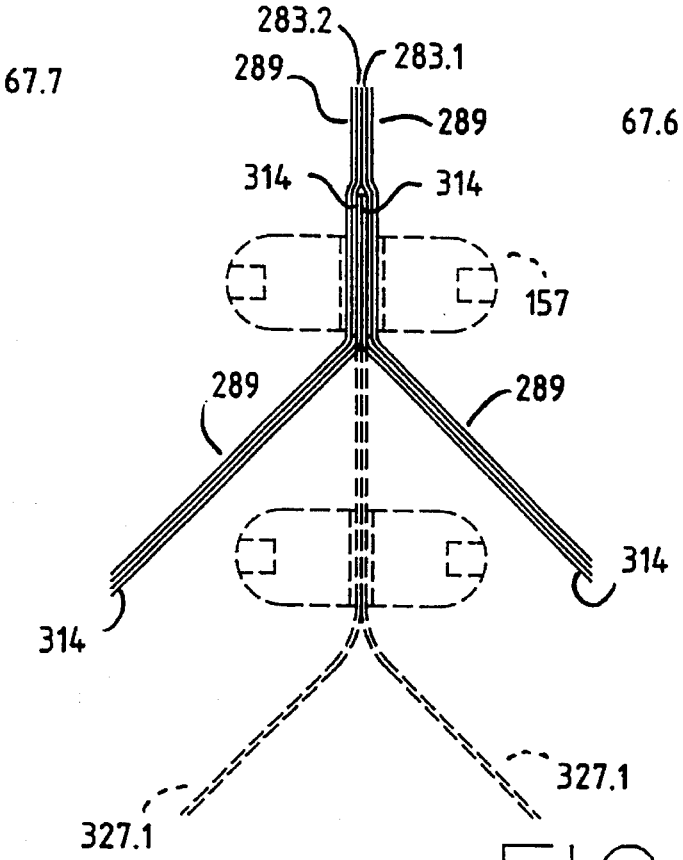
FIG. 56 is an elevation on a horizontal section 56—56 shown in FIG. 53 through a left part of the dome.

FIG. 56 on horizontal section 56—56 in FIG. 52 typically shows the attachment of two long ceiling support members 283.1, 283.2 to the dome side panel 314 of the dome well 311. It further shows the upstanding flanges 289 of the roof panels 67.6, 67.7. The dotted lines 327.1 indicate where the section 56—56 cuts through the V-shape profile of the top region 315.

The height of the dome roof 312 above the dome well 311 is adjustable in the direction indicated by arrow F by means of two threaded spindles 328.1, 328.2. The spindle 328.1 as typically shown in FIGS. 52 and 53 is located within and extends through a tube 329 adjacent the dome well 311. The top end of the tube 329 is flared open to form a flange 330 which is in contact with the support strip 324 of the dome well frame 321. A washer 331 which fits around and welded to the spindle 328.1 rests on the flange 330 of the tube 329. A square shaped sealing ring 332 fits onto the four support strips 324. A threaded nut 333 is welded to the dome roof frame 312.1. Two locking nuts 334, 335 are provided as shown in FIG. 52. To adjust the height of the dome roof 312 the spindles 328.1, 328.2 are suitably rotated using the handles 334.1, 334.2. During rotation, the washer 331 rotates on the flange 330 while each of the spindles 328.1, 328.2 co-act with its threaded nut 333 to cause the adjustment in height.

The dome 68 is provided with a louvre 335 attached to a spindle 336 to adjust the amount of light falling in. The two ends 337 of the spindle 336 are each rotatably attached to a dome side panel 314.

All the panels mentioned in this detailed description are preferably pressed from galvanised steel sheeting. A suitable aluminium alloy can be used as an alternative. If desired a protective paint can be applied on the outsides of these panels. Alternatively, the galvanised steel can be suitably copper plated for aesthetical reasons. Further alternatives include water resistant panels impregnated with paper pulp or low thermal conductive composite sheets.

It will be appreciated that for the building 60 where two sets 60.1, 60.2 of wall panels are used the thermal bridging between the first set 60.1 of wall panels 61 to 64 and the second set of 60.2 of wall panels 65, 66, 66.2, 66.3 is minimised. Where there is an inter-connection between the two sets 60.1, 60.2 of wall panels the various Velcro shown in the drawings minimise thermal transfer. Thus, not only heat transfer, but also "cold" transfer is minimised.

A preferred method of constructing the building 60, 66A will now be described.

Initially a site 105 on which the building 60, 66A is to be constructed is suitably prepared including levelling the ground 105. A suitable size square typically 156 as shown in FIG. 28 is marked out on the ground 105 and holes dug for the columns 138, alternatively furrows where concrete bars are to be used, generally along the edges of the square. A plurality of the base plates 138.1 and their corresponding threaded bolts 139 and the columns 138 are then suitably placed in the furrows with the columns 138 spaced from one another as shown in FIG. 28. In this method the two sets 60.1, 60.2 of wall panels 61 to 66, 66.2, 66.3 will be used. However, when it is desired to initially only construct the basic unit 66A having one set 60.1 of wall panels 61 to 64, only those base plates 138.1 and their corresponding threaded bolts 139 and the columns 138 needed will be placed in the furrows. At a later stage when it is desired to upgrade the basic unit 66A, furrows can be dug on the outside and adjacent the wall panels 61 to 64 of the basic unit 66A and the base plates 138.1 and their corresponding threaded bolts 139 and the columns 138 for the second set 60.2 of wall panels placed therein.

The anchor base members 141 are then placed over the threaded bolts 139 with their protruding ends 144 through the holes 143. The anchor base members 141 are levelled by adjusting the nuts 145.2. Subsequently, the anchor base members 141 are attached to the protruding ends 144 by fastening the nuts 145.3. The triangular corner plates 146 shown in FIG. 27 are then attached to the adjacent anchor base members 141. The arranged anchor base members 141 now form a suitable base 135.

The area between the arranged anchor base members 141 is then filled and compacted to render a suitable floor 142. Desired underfloor services, for example piping 135.1 shown in FIG. 8 for heating and the water tank 240 shown in FIGS. 2 to 5 are to be located before filling and compacting.

The holes or furrows are then filled with ground. It will be appreciated that a concrete floor need not be established at this stage, such a floor can be added later. However, should a concrete floor be desired from the start, only the base plates 138.1 shown in FIGS. 16 and 26 with upright threaded bolts 139 can be placed in the furrows. The concrete floor 142 will then be established which will surround and thus suitably anchor the base plates 138.1 and threaded bolts 139.

The pairs of triangular support members 148.1, 148.2 are then arranged in an upright position by sliding their depending flanges 152.1, 152 into the slits 136 of the respective inwardly directed 147.1 anchor base members 141.

The bottom sub-panels 76.1, 77.1 of the first set 60.1 of wall panels 61 to 64 are then arranged on the base 135 by sliding their depending flanges 115, 116 into the slits 136 of the respective anchor base members 141. Preferably, the depending flange 115, 116 of a bottom sub-panel 76.1, 77.1 is slid into the slit 136 from above an anchor base member 141. The bottom sub-panels 76.1, 77.1 are then tilted towards the floor 42 until the respective inner and outer flanges 111, 112 touches each other and with the respective punch marks 338 shown in FIG. 1A on the flanges 111, 112 in register with each other. The Velcro 159 on the flanges 111, 112 shown in FIG. 32 is employed during the alignment of the flanges 111, 112 with each other. The inner flanges 113, 114 are arranged against the respective sloping support flanges 154.1, 154.2 of the support members 148.1, 148.2 using the Velcro 161 shown in FIG. 39A. The flanges 111 to 114 and 154.1, 154.2 are then suitably attached using fasteners 165, the deformation attachment 166.1 and/or fasteners 157 as desired.

Subsequently, all the middle sub-panels 76.2, 77.2 are arranged and attached as described previously in the detailed description also employing the Velcro 159, 161 and the fasteners 157, 165, 166.1 and further the Velcro 160 shown in FIG. 29. Take note that the bottom attachment formations 123, 124 of each respective middle sub-panel 76.2, 77.2 are initially arranged over the respective top attachment formations 117, 118 of the bottom sub-panels 76.1, 77.1 and the middle sub-panels 76.2, 77.2, then tilted towards the inside 66.1 of the building 60.

The panels 180 shown in FIGS. 35 and 36 (and their mirror image panels) are then attached to the respective middle sub-panels 76.2, 77.2 and the support flanges 154.1, 154.2 of the support member 148.1, 148.2 as described previously.

The panel 180 shown in FIG. 38 is attached in a similar manner as referred to in the previous paragraph.

Then all the top sub-panels 76.3, 77.2 are attached to the middle sub-panels 76.2, 77.2 and the panels 180, 192 mentioned above. As desired, the fasteners 157, 165, 166.1 are used.

The first legs 279.1 of four attachment members 279 are attached between the adjacent outer flanges 127, 128 of the respective adjacent top sub-panels 76.3, 77.3.

The first legs 279.1 of four L-shaped attachment members 298 are then attached between the adjacent inner flanges 129, 130 of all the top sub-panels 76.3, 77.3.

Subsequent to the above steps the four wall panels 61 to 64 will lean towards the inside of the building and towards one another.

The dome well 111 is then constructed within the building 60, 66A by attaching the four dome side panels 314 to one another. The louvre 335 and the support members 313 are also provided.

Still inside the building 60, 66A the pairs of long and short ceiling support members 282, 283 are attached to the dome side panels 314 as shown in FIGS. 51 to 53, 55 and 56.

The dome well 311 with the attached long and short ceiling support members 282, 283 are then lifted. The long and short ceiling support member 282, 283 are then attached to the respective second legs 279.1 of the L-shaped attachment members 279, 298.

The pairs of transverse ceiling support members 287 are then attached to the respective transverse legs 299, 300 of the attachment members 298 and to the respective long ceiling support members 283.

Each of the sixteen ceiling panels 308.1, 308.2 are arranged with their respective edges 287.4, 287.5, 307.1, 309.1, 309.2, 309.4 on the respective ceiling support strips 232, flanges 287.3, 310 of the short, long and transverse ceiling support members 282, 283,287 and the flange 309.3 as shown in the FIGS. 30, 31, 45, 46, 47, 47A and 52.

Service piping (not shown) can at this stage be located, for example, above the ceiling panels 308.1, 308.2 and through the holes 297 in the short and long ceiling support members 282, 283.

The roof panels 67.1 to 67.2 are placed in position using the Velcro 278 shown in FIGS. 30, 31. The respective upstanding flanges 289, 290 are attached to the top long side 296.2 of the long and short ceiling support member 282, 283 typically as shown in FIGS. 45 and 46. The dome well frame members 323 are located onto and over the top edges 318 of the dome side panels 314 and the respective upstanding flanges 319 of the roof panels 67.1 to 67.8. The adjacent dome well frame members 323 are attached to each other as shown in FIG. 54. It will be understood that the fasteners 157, 165 in a permanent or temporary way, can be used or the deformation attachments 166.1 typically shown in FIG. 32. The upstanding flanges 319 of each of the roof panels 67.1 to 67.8 are located in the slits 320 of the dome well frame 321 and fastened using bolts 322 as shown in FIG. 53.

The removable panels 72, of course, for the first set 60.1 of wall panels, are subsequently attached typically as shown in FIG. 39, 39A.

The U-shaped sealers 159.1 typically shown in FIG. 32 can now be located on edges and flanges where desired.

Reverting to FIGS. 51, 52, 53 the spindles 328.1, 328.2 and their respective tubes 329 are attached to the dome 68 proceeding from above the dome 68. The nuts 334, 335 and handles 334.1, 334.2 are provided thereafter.

The dome roof 312 and dome roof frame 312 are located as shown in FIG. 51.

The window frames 248 and louvres 263 are located and attached as shown in FIGS. 16, 40 and 41. Glass panels 241 are provided. Also the air inlets 74 are constructed as shown in FIGS. 16, 42 and 43. Note that the FIGS. 16, 40, 41, 42 and 43 are for a first set 60.1 and a second set 60.2 of wall panels. At this stage of construction, however, only the first set 60.2 of wall panels 61 to 64 will have been located.

Figure 7:
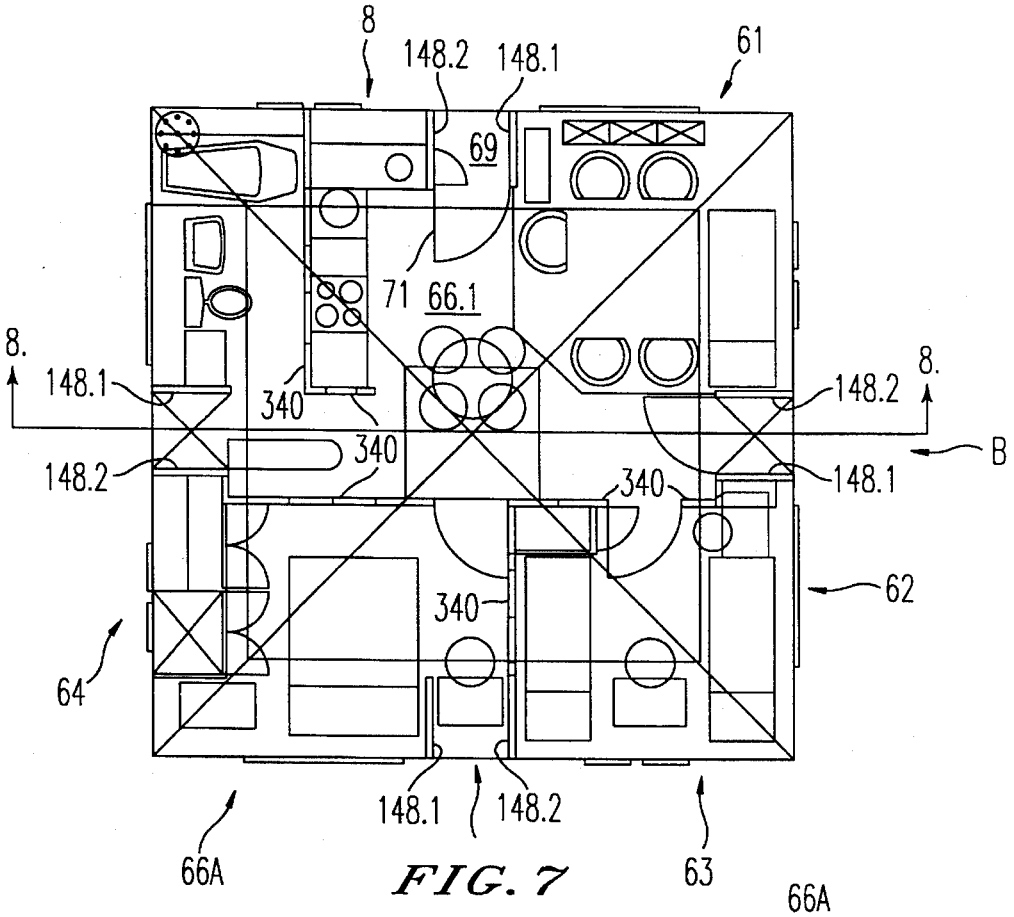
FIG. 7 is a schematic plan view of the basic unit of the building shown in FIG. 1 with some articles of furniture indicated.
Figure 8:
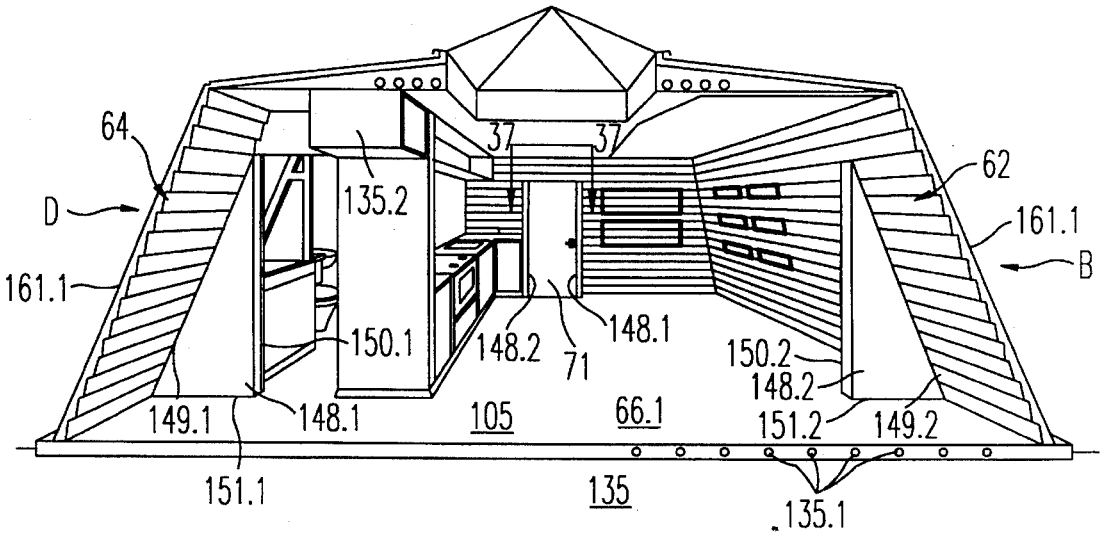
FIG. 8 is an elevation on section 8—8 shown in FIGS. 6 and 7 through the building.

The panels 340 shown in FIG. 7 can now be located on the inside 66.1 of the building 60, 66A.

The services typically shown at 221, 222, 223 in FIG. 21 and the light means 233 in FIG. 17 can be provided.

The solar heating means shown in FIG. 18 is also provided.

The outer surfaces of the wall panels 61 to 64 can now be prepared for the thermal, insulating screed 161.1 shown in FIG. 1. The wall panels 61 to 64 are firstly given a sealing treatment, for example, by applying a suitable bitumen substance thereover. Then, some suitable sand is manually thrown against the wall panels 61 to 64 the effect of which will adhance the adherence of the insulating screed 166.1 to the wall panels 61 to 64. The insulating screed 166.1 is then applied.

An alternative to the use of the screed 161.1, thermal upgrading can be effected by locating the bottom, middle and top sub-panels 76.1, 76.2, 76.3, 77.1, 77.2, 77.3 of the second set 60.2 of wall panels over the first set 60.1 of wall panels 61 to 64 and providing of the loose insulating filler material 254. FIG. 16 shows a typical profile through such an arrangement.

Preferably, initially the respective intermediate panels 171 are attached typically as shown in FIGS. 39, 39A and the panels 179, 181 shown in FIGS. 34 and 38 attached thereto.

It is preferred that the bottom, middle and top sub-panels 76.1 to 76.3 and 77.1 to 77.3 of the second set 60.2 of wall panels are then arranged and basically attached in the same manner as described above for the sub-panels 76.1 to 76.3 and 77.1 to 77.3 of the first set 60.1 of wall panels 61 to 64 with the exception of use of chutes 162 which will be arranged as shown in FIGS. 32 and 33. The outer removable panels 72 can now be attached as shown in FIGS. 39, 39A.

As an alternative to the insulating screed 161.1 shown in FIG. 1 and referred to earlier in the construction method, the spaces 341 typically shown in FIGS. 16, 40 and 42 between the adjacent first and second sets 60,1 60.2 of wall panels can be filled with loose insulating filler material 254, for example suitable granules. The access plates 252, 267 shown in FIGS. 40, 42 can be removed and the filler material 254 introduced through the opening 253. It is preferred that the loose insulating filler material 254 is suitably treated to avoid compaction over time of the filler material 254. It will be appreciated that as an alternative to the loose filler material 254 a blanket type of insulating material can be suitably located against each wall panel 61 to 64 of the first set 60.1 of wall panels before constructing the second set 60.2 of wall panels.

The gutters 166 are subsequently attached as shown in FIGS. 31 and 33. It will be understood that the roof panels 67.1 to 67.8, especially at their wall facing edges 276.3, will have to be lifted to accommodate the curved edges 170 of the gutters 166.

It will also be understood that before constructing the second set 60.2 wall panels, the windows 73 and air inlets 74 must be removed and replaced after construction of the second set 60.2 wall panels.

The cover plate 236 shown in FIG. 19 and the screed 294 on top of the roof panels 67.1 to 67.8 can now be provided.

Brief reference is now made to FIGS. 9 to 14, 57 and 58.

Figure 9:
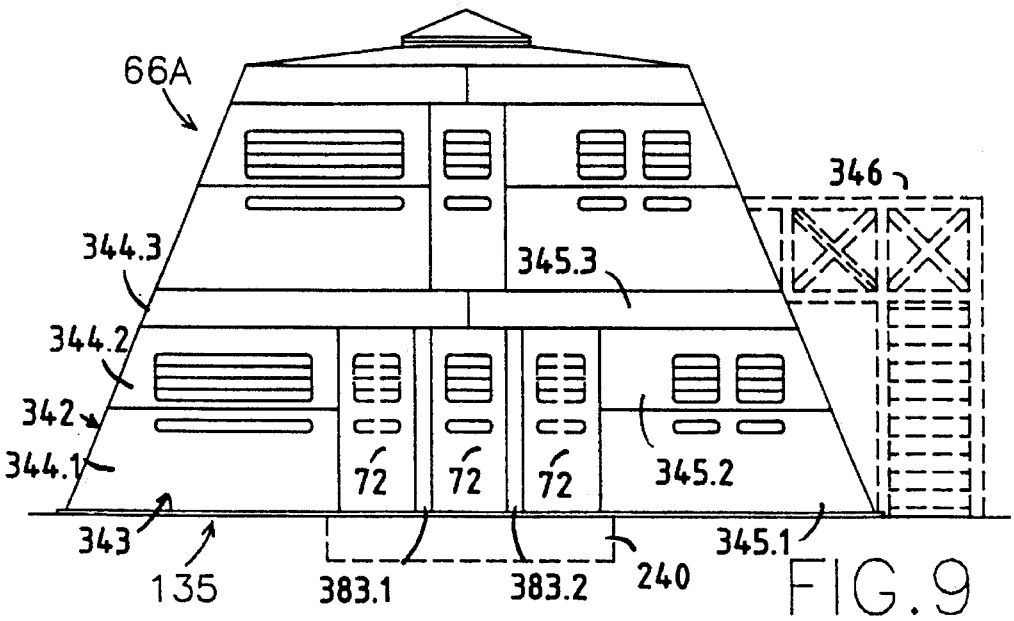
FIG. 9 is a front view of a double storey building in accordance with the invention with the first storey generally made up by the basic unit of the building shown in FIG. 1.

In FIG. 9 a basic unit 66A shown in FIGS. 2 to 8 is added as a first storey to a building 342 which also comprises four profiled, trapezoidal wall panels (only one wall panel 343 shown). The wall panel 343 comprises bottom sub-panels 344.1, 345.1, middle sub-panels 344.2, 345.2 and top sub-panels 344.3, 345.3 and two elongate panels 383.1, 383.2. Access to the basic unit 66A is via the staircase 346 here shown on the outside, although the staircase 346 may be located on the inside of the building 342.

Figure 10:
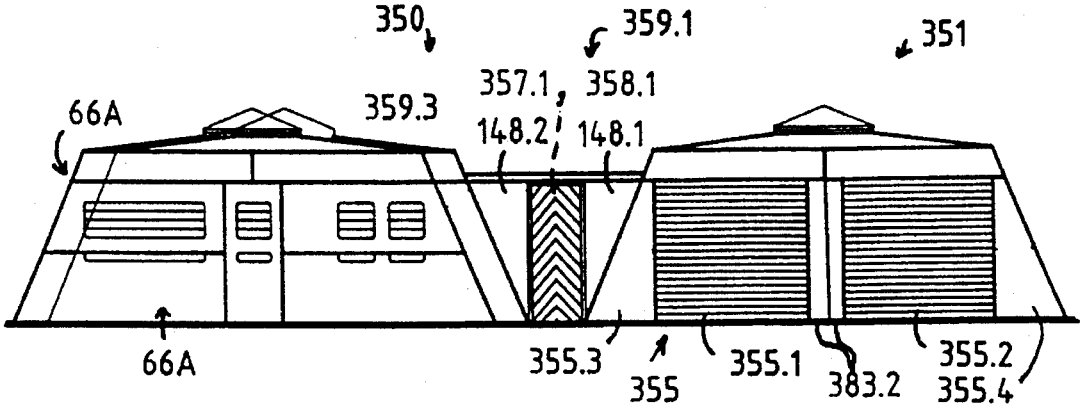
FIG. 10 is a front view of a multi-building in accordance with the invention.
Figure 11:
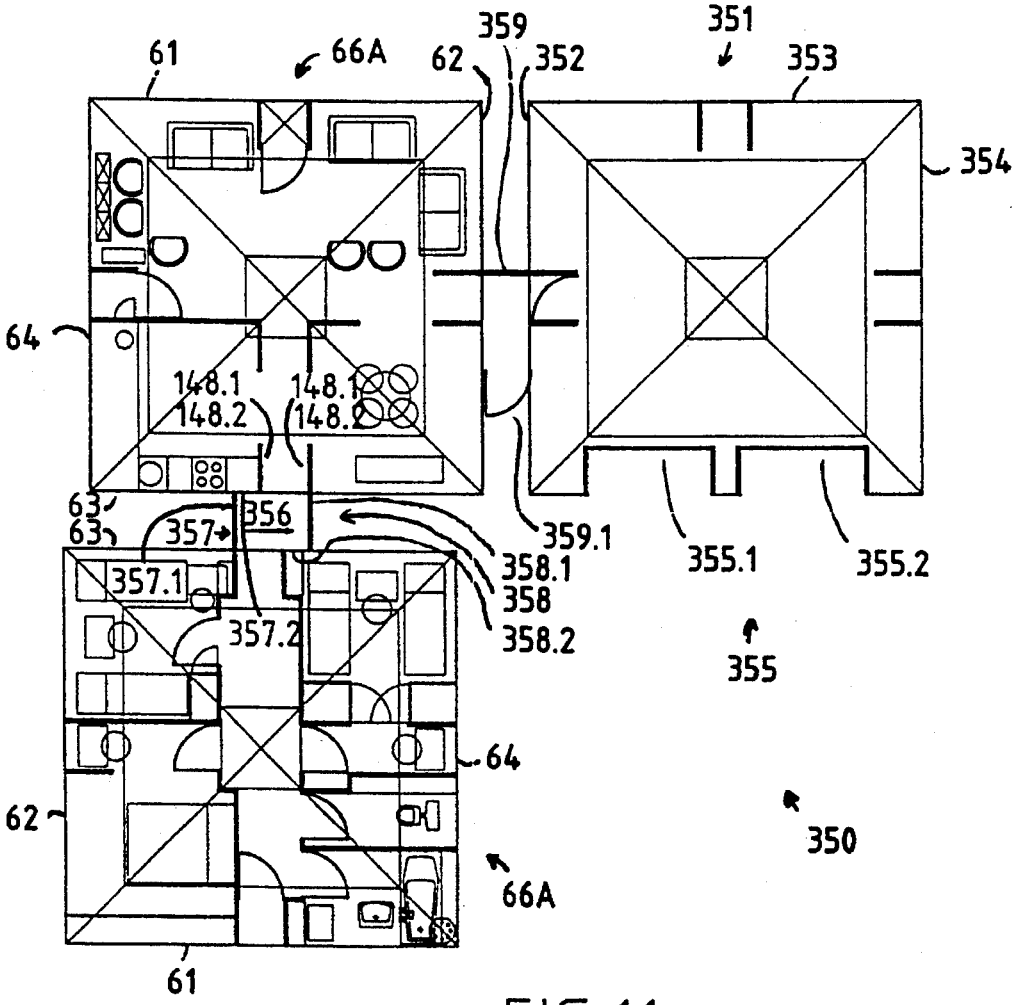
FIG. 11 is a plan view of the multi-building shown in FIG. 10.

The multi-building 350 shown in FIGS. 10 and 11 comprises two linked basic units 66A with the one basic unit 66A linked to a double garage 351. The wall panels 352, 353, 354 of the garage 351 are each basically the same as the wall panels 61 to 64 of the basic units 66A. The wall panel 355 of the garage 351 is, however, adapted to accommodate two garage doors 355.1, 355.2. The wall panel 355 includes two minor image trapezoidal shaped panels 355, 355.4 and two elongate panels 383.1, 383.2. The link between the two basic units 66A form a passage 356. The passage 356 is established by removing the removable panels 72 from the wall panels 63 and forming each of the side walls 357, 358 using two triangular support members 148.1, 148.2 for each of the side walls 357, 358 and a rectangular panel 357.1, 358.1 such an arrangement typically shown at 359.1. Rectangular panels 357.2, 358.2 are used at the wall panels 63. A roof 359.3 having a roof edge 359.4 typically shown in FIG. 34 is provided. The side wall 359 between the basic unit 66A and the garage 355 also comprises two triangular support elements 148.1, 148.2. A door 359.1 is provided.

Figure 12:
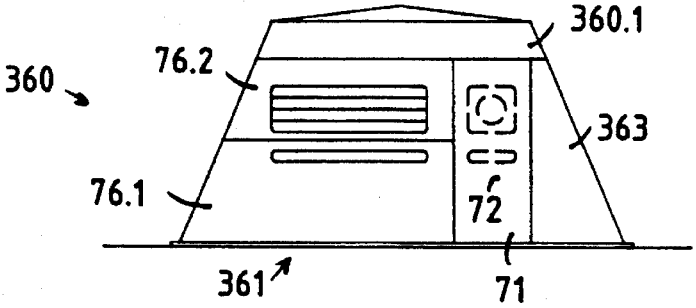
FIG. 12 is a front view of another embodiment of a building in accordance with the invention.

FIG. 12 shows a smaller building 360 when compared to the building 60, 66A. The wall panel 361 comprises a left set 66 including the bottom and middle and top sub-panels 76.1, 76.2 which are the same as that of the buildings 60, 66A. A modified top sub-panel 360.1 is used. A door 71 or, alternatively, a removable panel 72 is provided with one panel 363 to the right. It will be appreciated that the wall panel 361 can, alternatively, include the bottom and middle sub-panels 77.1, 77.2 of the right set 77 of sub-wall panels as discussed previously in this specification with the door 71 (or removable panel 72) on the left hand side thereof. The other three wall panels (not shown) may have similar sub-panels as those of the wall panel 361.

Figure 13:
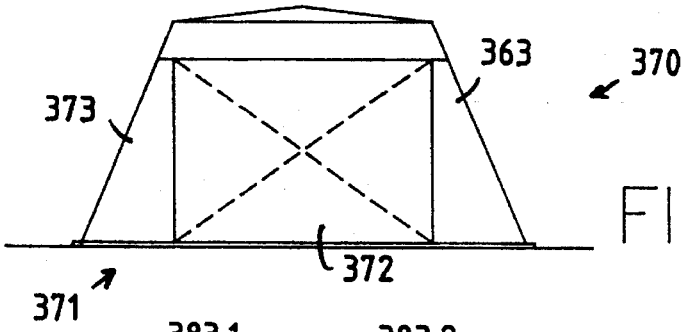
FIG. 13 is a front view of yet another embodiment of a building in accordance with the invention.

The single garage 370 shown in FIG. 13 has a wall panel 371 adapted to accommodate a garage door 372. The wall panel 371 includes a panel 363 as shown in FIG. 12 and a panel 373 which has the mirror image of panel 363. The other three wall panels (not shown) may be the same as those of the building 360 in FIG. 12.

Figure 14:
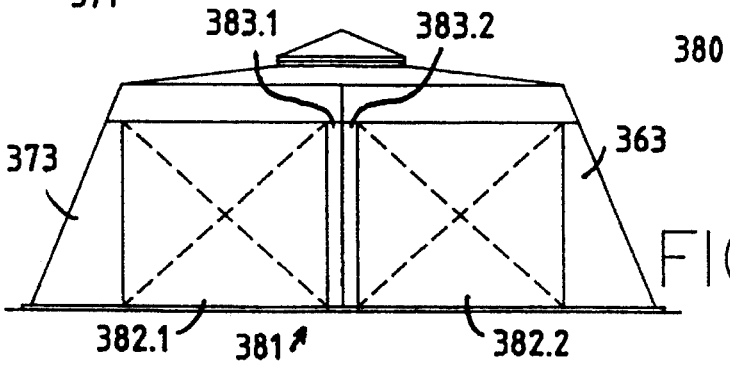
FIG. 14 is a front view of yet another embodiment of a building in accordance with the invention.

The double garage 380 in FIG. 14 is basically the same as that in FIG. 10.

Figure 57:
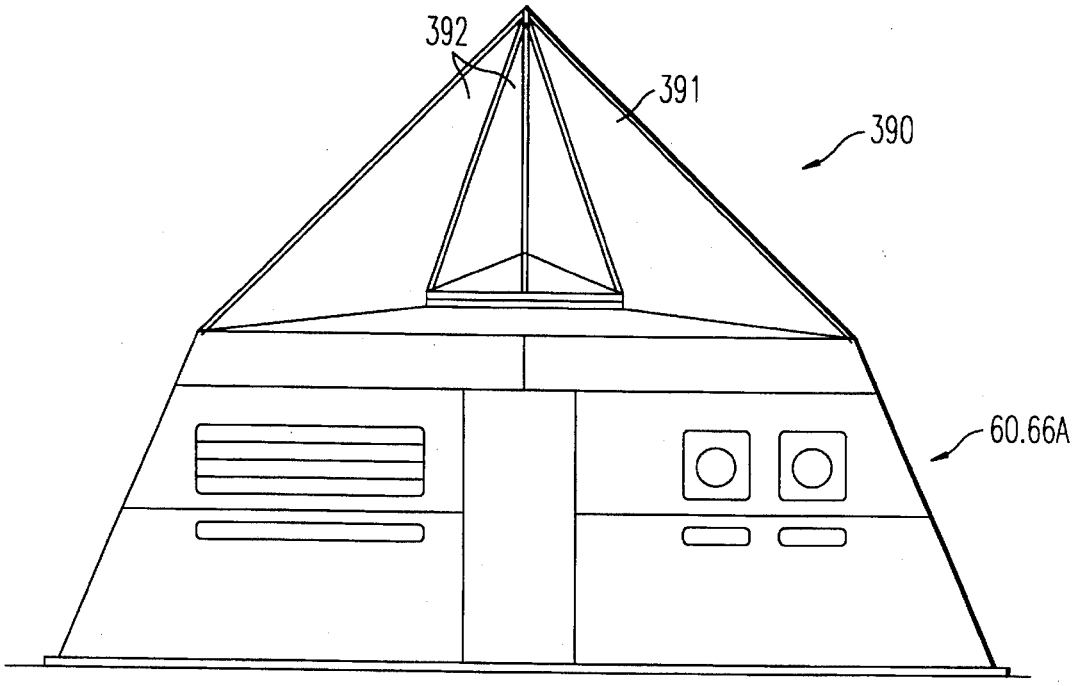
FIG. 57 is a side elevation of the building shown in FIG. 1 provided with a snow tent.

FIG. 57 shows the building 60, 66A provided with a snow tent 390 which comprises a suitable, flexible material 391 attached to a plurality of support members 392.

Figure 58:
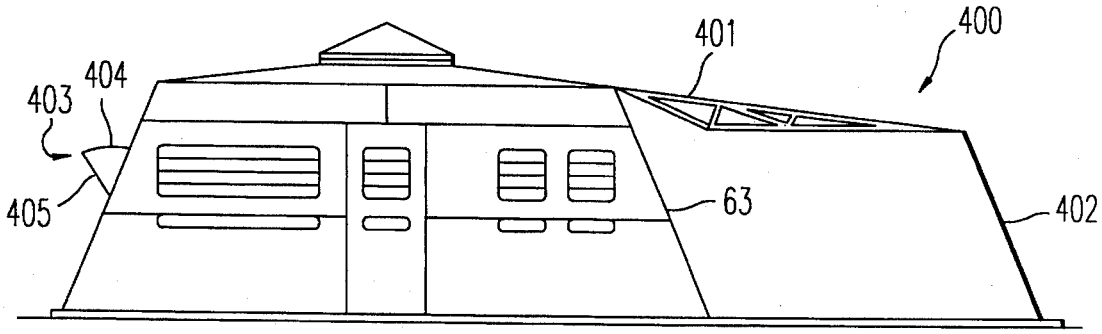
FIG. 58 is a side elevation of the building shown in FIG. 1 provided with a shelter attached to a side of the building.

The shelter 400 shown in FIG. 58 comprises a frame 401 supported on the wall panel 63 and supports 402 of which only one is shown. A window shade 403 which comprises a roof 404 and a support 405 is also shown. The roof 404 has a profile similar to the profile of the middle sub-panel 76.3 which roof 404 has been pressed from said middle sub-panel 76.3.

The claims which follow are to be considered an integral part of the disclosure.

We claim:

1. A building which includes:

a roof;

a first set of at least four trapezoidal shaped walls each wall in the form of a wall panel each wall panel comprising;

a left side edge;

a right side edge which is opposite the left side edge the left and right side edges extending between the ground and the roof;

a bottom edge at the ground and extending between the left and right side edges; and a top edge at the roof the top edge opposite and generally parallel to the bottom edge and extending between the left side and right side edges, with the left side edge of one wall panel adjacent and attached to the right side edge of one other wall panel, all the wall panels arranged in this manner so that the wall panels lean towards one another and towards the inside of the building; and an opening provided in any one of the wall panels which opening can give access to the inside of the building.

2. A building as claimed in claim 1, in which each wall panel has a suitable profile.

3. A building as claimed in claim 1, further including an upright, elongate removable panel provided in any one of the wall panels not being the wall panel having an access opening the removable panel having a bottom edge thereof at the ground.

4. A building as claimed in claim 1, in which a cross-section extending between the bottom and top edges of each wall panel presents a profile defining a plurality of Ls with each L comprising:

a first upstanding leg having a distal end; and a second leg which is transverse to the first leg and directed to the outside of the building when travelling from the top edge to the bottom edge of the wall panel along its profile and which second leg has a distal end;

the first leg of the L longer than the second leg of the L, the distal end of a first leg of an L attached to the distal end of a second leg of another L, the majority of Ls arranged in this manner.

5. A building as claimed in claim 1, in which the left side edge has a left side flange and the right side edge has a right side flange the left side flange of the left side edge of one wall panel attached to an adjacent right side flange of a right side edge of one other wall panel all the wall panels attached in this manner.

6. A building as claimed in claim 1, further including a base which is provided with a plurality of slits in its top surface and the bottom edge of each wall panel having a depending flange which fits into a co-acting slit in the base the wall panels thereby attached to the base.

7. A building as claimed in claim 4, in which each wall panel includes a plurality of sub-panels.

8. A building as claimed in claim 7, in which each wall panel comprises a left side set and a right side set of trapezoidal shaped sub-panels each set comprising three sub-panels namely a bottom sub-panel, a middle sub-panel and a top sub-panel each of the three sub-panels comprising:

an outer side edge;

an inner side edge which is opposite the outer side edge the outer side and inner side edges extending between the ground and the roof;

a bottom edge extending between the outer side and inner side edges; and a top edge opposite and generally parallel to the bottom edge and extending between the outer and inner side edges;

the three sub-panels of each set arranged so that:

the bottom sub-panel is located adjacent the ground with its bottom edge at the ground;

the top sub-panel is located adjacent the roof with its top edge at the roof;

the middle sub-panel is located between the bottom and top sub-panels with the bottom edge of the middle sub-panel adjoined to the top edge of the bottom sub-panel, the top edge of the middle sub-panel adjoined to the bottom edge of the top sub-panel, and for each wall panel:

the outer side edges of the three sub-panels of a left side set aligned with one another to form the left side edge of the wall panel, the outer side edges of the three sub-panels of a right side set aligned with one another to form the right side edge of the wall panel, the bottom edges of the two bottom sub-panels of said left side and right side sets aligned with each other to form the bottom edge of the wall panel, the top edges of the two top sub-panels of said left side and right side sets aligned with each other to form the top edge of the one wall panel.

9. A building as claimed in claim 8, further including a plurality of support members on the ground with the inner side edges of a bottom and middle sub-panel of a set of sub-panels aligned with each other and attached to a support member.

10. A building as claimed in claim 9, in which each of the support members is in the form of a profiled triangle each support member having a sloping side edge and an upright side edge the sloping side edge having a support flange with the aligned inner side edges of the bottom and middle sub-panels each having a flange these flanges of said bottom and middle sub-panels adjoined to the support flange of a support member, the upright side edge of each support member having a longitudinally extending rebate to accommodate an upright edge of a door.

11. A building as claimed in claim 8, further including a base which is provided with a plurality of slits in its top surface and the bottom edge of each bottom sub-panel having a depending flange which fits into a co-acting slit in the base the wall panels thereby attached to the base.

12. A building as claimed in claim 7, further comprising a plurality of elongate ceiling support members for supporting a ceiling of the building each of the support members having a rectangular cross-section and comprises strengthening means in the form of a plurality of pressed out areas between the two long sides of the support member each pressed out area having a hole through it.

13. A building as claimed in claim 1 or claim 7, further including a suitable insulating screed on the outside surface of each wall panel.

14. A building as claimed in claim 1, further including a second set of at least four profiled, trapezoidal shaped walls over the first set of walls, each wall of the second set in the form of a wall panel with a wall panel of the second set spaced from and generally parallel to a wall panel of the first set each wall panel of the second set comprising:

a left side edge;

a right side edge which is opposite the left side edge the left and right side edges extending between the ground and the roof;

a bottom edge at the ground and extending between the left side and right side edges; and a top edge at the roof the top edge opposite and generally parallel to the bottom edge and extending between the left and right side edges, with the left side edge of one wall panel of the second set adjacent and attached to the right side edge of one other wall panel of the second set all the wall panels of the second set arranged in this manner so that the wall panels of the second set lean towards one another and towards the inside of the building; and an opening in any one of the wall panels of the second set which wall panel is located over the wall panel of the first set having the access opening the two openings aligned with each other so that they can give access to the inside of the building.

15. A building as claimed in claim 14, in which each wall panel of the second set includes a plurality of sub-panels each sub-panel having a profile defining a plurality of Ls with each L comprising:

a first upstanding leg having a distal end; and a second leg which is transverse to the first leg and directed to the outside of the building when travelling from the top edge to the bottom edge of the wall panel along its profile and which second leg has a distal end;

the first leg of the L longer than the second leg of the L, the distal end of a first leg of an L attached to the distal end of a second leg of another L, the majority of Ls arranged in this manner.

16. A building as claimed in claim 14 or claim 15, including a gutter which extends between and along the top edges of a first set wall panel and a second set wall panel which second set wall panel is located over the first set wall panel.

17. A sub-panel for use in the building as claimed in claim 7, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile the distal end of a first leg of an L attached to the distal end of a second leg of another L, the majority of the Ls arranged in this manner.

18. A sub-panel as claimed in claim 17, which has a trapezoidal shape.

19. A sub-panel for use as the bottom sub-panel of a set of sub-panels of the building of claim 9, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile, the distal end of a first leg of an L attached to the distal end of a second leg of another L, the majority of the Ls arranged in this manner, the bottom sub-panel having:

an outer flange at its outer side edge;

an inner flange at its inner side edge;

bottom flange at its bottom edge; and a top attachment formation at its top edge, the outer flange attachable to an outer flange of a bottom sub-panel of an adjacent wall panel, the inner flange attachable to a support member, the bottom flange attachable at the ground and the top attachment formation of the top edge attachable to a bottom attachment formation of the bottom edge of the middle sub-panel of the set of sub-panels.

20. A sub-panel as claimed in claim 19, in which the bottom flange is a depending flange which can be fitted into a co-acting slit of a base of the building.

21. A sub-panel for use as the middle sub-panel of a set of sub-panels of the building of claim 9, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use the directed to the outside of the building when travelling from the top edge to the bottom edge of the wall panel along its profile, the distal end of a first leg of an L attached to the distal end of a second leg of another L, the majority of the Ls arranged in this manner, the middle sub-panel having:

an outer flange at its outer side edge;

an inner flange at its inner side edge;

a bottom attachment formation at its bottom edge; and a top attachment formation at its top edge, the outer flange attachable to an outer flange of a middle sub-panel of an adjacent wall panel, the inner flange attachable to a support member, the bottom attachment formation of the bottom edge attachable to a top attachment formation of the top edge of the bottom sub-panel of the set of sub-panels and the top attachment formation of the top edge attachable to a bottom attachment formation of the bottom edge of the top sub-panel of the set of sub-panels.

22. A sub-panel for use as the top sub-panel of a set of sub-panels of the building of claim 9, which sub-panel has a profile defining a plurality of Ls with each L comprising:

a first leg having a distal end; and a second leg which is transverse to the first leg which second leg has a distal end, the first leg of the L longer than the second leg of the L, the first leg and its distal end in use facing upwards and the second leg in use directed to the outside of the building when travelling from the top edge to the bottom edge of the wall panel along its profile, the distal end of a first leg of an L attached to the distal end of a second leg of another L, the majority of the Ls arranged in this manner, the top sub-panel having:

an outer flange at its outer side edge;

an inner flange at its inner side edge;

a top attachment formation at its top edge; and a bottom attachment formation at its bottom edge, the outer flange attachable to an outer flange of a top sub-panel of an adjacent wall panel, the inner flange attachable to an inner flange of a top sub-panel of another set of sub-panels of the same wall panel, the bottom attachment formation of the bottom edge attachable to a top attachment formation of the top edge of the middle sub-panel of the set of sub-panels and the top attachment formation of the top edge attachable to the roof.

23. A support member for use in the building as claimed in claim 10, which support member is profiled and generally in the form of a triangle the support member having a sloping side edge having a support flange which support flange is attachable to the aligned inner flanges of the inner edges of the bottom and middle sub-panels of a set of sub-panels the support member further having an upright side edge having rebate to accommodate an upright edge of a door when the support member is in use.

24. A ceiling support member for use in the building as claimed in claim 12, which ceiling support member has a rectangular cross-section and comprises strengthening means in the form of a plurality of pressed out areas between the two long sides of the support member each pressed out area having a hole through it.

* * * * *